US006640734B2

(12) United States Patent
Hayashi et al.

(10) Patent No.: US 6,640,734 B2
(45) Date of Patent: Nov. 4, 2003

(54) LOWER THREAD WINDING DEVICE

(75) Inventors: Minoru Hayashi, Chofu (JP); Kiyoshi Matsuzawa, Chofu (JP); Fumio Wada, Chofu (JP); Naofumi Fukuba, Chofu (JP); Hiroyuki Kotaki, Chofu (JP)

(73) Assignee: Juji Corporation, Tokyo (JP)

( * ) Notice: Subject to any disclaimer, the term of this patent is extended or adjusted under 35 U.S.C. 154(b) by 0 days.

(21) Appl. No.: 10/160,549

(22) Filed: May 30, 2002

(65) Prior Publication Data

US 2003/0010270 A1 Jan. 16, 2003

(30) Foreign Application Priority Data

May 31, 2001 (JP) ..... 2001-163536

(51) Int. Cl.[7] ..... D05B 59/00
(52) U.S. Cl. ..... 112/279
(58) Field of Search ..... 112/279, 278, 112/231, 186; 242/118, 130, FOR 102, FOR 105, FOR 108

(56) References Cited

U.S. PATENT DOCUMENTS 3,374,756 A * 3/1968 Blackwood et al. ..... 112/184
3,693,566 A * 9/1972 Ketterer ..... 112/184
4,259,914 A * 4/1981 Johnson ..... 112/184
4,481,897 A * 11/1984 Odermann et al. ..... 112/279
5,622,127 A * 4/1997 Chang ..... 112/279

FOREIGN PATENT DOCUMENTS

JP 3-27230 4/1991
JP 11-47480 2/1999

* cited by examiner

*Primary Examiner*—Ismael Izaguirre
(74) *Attorney, Agent, or Firm*—Merchant & Gould P.C.

(57) ABSTRACT

There are provided an upper shaft clutch mechanism 140, a bobbin 22 including a slit 39, a horizontal holder 4 including an inner holder 18 and a blade tip 42, a bobbin driving member 11, bobbin driving member moving means 94 for moving the bobbin driving member 11 to freely advance or retreat between two positions having a separating position and a connecting position, a thread holding and catching member 48 including an upper thread holding portion 59, an upper thread engaging portion 60 and a thread position regulating portion 58 which are always set in a retreat position and are set in an entry position during a thread winding operation, thread holding and catching member moving means 53 for moving the thread holding and catching member 48 to freely advance or retreat between two positions having a retreat position and an entry position, and a thread winding operation control portion 193 for controlling the operation of each portion during the thread winding operation.

16 Claims, 33 Drawing Sheets

LOWER THREAD WINDING DEVICE

BACKGROUND OF THE INVENTION

1. Field of the Invention

The present invention relates to a lower thread winding device and a lower thread winding amount control device, and more particularly to a lower thread winding device suitable for supplying a lower thread to a bobbin without removing the bobbin from a horizontal holder.

2. Description of the Related Art

Conventionally, there have been proposed various lower thread winding devices capable of supplying a lower thread to a bobbin without removing the bobbin from a horizontal holder.

These conventional examples have been described in JP-A-11-47480. This publication has described that a needle bar is separated from an upper shaft by means of a needle bar separating mechanism and is held in an upper position during a thread winding operation, and at the same time, an outer holder and a bobbin are rotated through a lower shaft by means of a sewing machine motor and a thread is wound upon the bobbin, thereby carrying out lower thread winding.

[Problems that the Invention is to Solve]

In the conventional lower thread winding device, however, the needle bar separating mechanism is operated to disconnect the upper shaft from the needle bar, thereby stopping the needle bar in the upper position while the thread is wound upon the bobbin.

For this reason, even if the needle bar separating mechanism is operated to stop the needle bar, a thread take-up interlocking with the upper shaft does not stop but continues a vertical motion. For example, consequently, an upper thread is intermittently pulled and loosened by the thread take-up moving vertically while the thread pulled out of the supplied thread is wound by the lower thread winding device. In the case in which a sewing operation is automatically restarted after the lower thread winding operation is ended, therefore, a stitch formed immediately after the start of stitch formation is loosened.

Moreover, in the case in which a thread to be wound as a lower thread by the lower thread winding device is set to be an upper thread subjected to upper thread winding and the upper thread is pulled out and is wound upon the bobbin through a needle, a thread tension is changed by the thread take-up moving vertically. Therefore, there is a problem in that a great load is applied to each member of a thread winding mechanism through which the upper thread passes and thread fastening for the lower thread to be wound upon the bobbin fluctuates.

In some cases in which the upper thread acts violently and is thus entangled with a component on a thread path or slips out of the needle by the vertical motion of the thread take-up during the thread winding operation or the upper thread is to be wound upon the bobbin, moreover, the thread is pulled so that the upper thread cannot be appropriately guided to a winding position. Furthermore, the needle bar separating mechanism is incorporated around the needle bar. Therefore, there is also a problem in that a structure is complicated in the vicinity of the needle bar.

SUMMARY OF THE INVENTION

The invention has been made in consideration of these respects and has an object to stop a needle bar and a thread take-up while a lower thread is supplied to a bobbin without removing the bobbin from a horizontal holder by a lower thread winding device.

In order to achieve the object, a first aspect of the invention is directed to a lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread holding member including a thread holding portion capable of holding a thread end of the thread supplied to the bobbin during the thread winding operation and a thread position regulating portion for positioning the supplied thread on a supply side by the thread holding portion during the thread winding operation to abut on the upper flange, the thread holding portion being movable to a retreat position in the vicinity of an outer peripheral surface of the outer holder and an entry position in which the supplied thread is caused to enter an inner upper part of the inner holder to be positioned above the upper flange during the thread winding operation;

second moving means for moving the thread holding portion of the thread holding member to the retreat position and the entry position;

an upper shaft clutch mechanism (410, a needle oscillation stepping motor 446) provided between a drive shaft (a lower shaft 414) to be driven by a sewing machine motor and a reciprocating member (a thread take-up crank 456) for reciprocating a needle bar and a thread take-up in a vertical direction and capable of carrying out electrical switching into a connecting state in which the drive shaft is connected to the reciprocating member during the sewing operation and a holding state in which the connection is released and the thread take-up and the needle bar can be held in an upper position during a lower thread winding operation; and thread winding operation control means (193, 193A) for operating the first moving means and the second moving means to cause a supplied thread connected between the thread holding portion and the thread position regulating portion to enter the slit and for bringing the upper shaft clutch mechanism into a release state so that the thread can be wound upon the bobbin without vertically moving the thread take-up and the needle bar during the thread winding operation. By employing such a structure, it is possible to easily supply the bobbin with the thread to be used for embroidering without removing the bobbin from the horizontal holder. In addition, since the thread take-up is not moved vertically during the thread winding operation, the thread does not act violently and the upper thread can be prevented from being entangled or cut.

Moreover, a second aspect of the invention is directed to a lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread holding member including a thread engaging portion capable of holding a thread end of an upper thread supplied to a needle during the thread winding operation and a thread position regulating portion for positioning the upper thread on a supply side by the thread engaging portion during the thread winding operation to abut on the upper flange, the thread engaging portion being movable to a retreat position in the vicinity of an outer peripheral surface of the outer holder and an entry position in which the supplied thread is caused to enter an inner upper part of the inner holder to be positioned above the upper flange during the thread winding operation;

second moving means for moving the thread engaging portion of the thread holding member to the retreat position and the entry position;

an upper shaft clutch mechanism (410, the needle oscillation stepping motor 446) provided between a drive shaft (the lower shaft 414) to be driven by a sewing machine motor and a reciprocating member (the thread take-up crank 456) for reciprocating a needle bar and a thread take-up in a vertical direction and capable of carrying out electrical switching into a connecting state in which the drive shaft is connected to the reciprocating member during the sewing operation and a holding state in which the connection is released and the thread take-up and the needle bar can be held in an upper position during a lower thread winding operation; and thread winding operation control means (193, 193B) for bringing the upper shaft clutch mechanism into the connecting state to drive a sewing machine, thereby catching the upper thread connected to the needle by means of the blade tip of the outer holder and separately rotating the upper thread in upper and lower parts of the inner holder, then causing the thread engaging portion of the thread holding member to catch the upper thread passing over the inner holder, and thereafter operating the first moving means and the second moving means to cause the supplied thread connected between the thread engaging portion and the thread position regulating portion to enter the slit and bringing the upper shaft clutch mechanism into a release state so that the thread can be wound upon the bobbin without vertically moving the thread take-up and the needle bar during the thread winding operation. By employing such a structure, it is possible to easily supply the bobbin with the upper thread to be the lower thread without removing the bobbin from the horizontal holder. In addition, since the thread take-up is not moved vertically during the thread winding operation, the thread does not act violently and the upper thread can be prevented from being entangled or cut.

Furthermore, a third aspect of the invention is directed to a lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread catching and holding member including a thread holding portion provided in a tip portion and serving to hold a thread supplied during the thread winding operation and a thread engaging portion for engaging an upper thread, and a thread position regulating portion provided on a rear end side from the thread holding portion and the thread engaging portion and serving to position a supplied thread on a supply side by the thread holding portion and the thread engaging portion or the upper thread supplied as a lower thread during the thread winding operation to abut on the upper flange of the bobbin, in which a tip portion is always placed in a retreat position in the vicinity of an outer peripheral surface of the outer holder and is placed in an entry position in which the tip portion enters an inner upper part of the inner holder during the thread winding operation;

second moving means for moving the thread holding portion and the thread engaging portion in the thread catching and holding member to freely advance or retreat between two positions including the retreat position and the entry position;

an upper shaft clutch mechanism (410, the needle oscillation stepping motor 446) capable of carrying out electrical switching into a connecting state in which a drive shaft (the lower shaft 414) to be driven by a sewing machine motor is connected to a reciprocating member (the thread take-up crank 456) for reciprocating a needle bar and a thread take-up in a vertical direction during the sewing operation and a holding state in which the connection is released and the thread take-up and the needle bar can be held in an upper position during a lower thread winding operation;

a first thread winding operation control portion (193A) for operating the first moving means and the second moving means to cause the supplied thread connected between the thread holding portion and the thread position regulating portion to enter the slit and for bringing the upper shaft clutch mechanism into a release state so that the thread can be wound upon the bobbin without vertically moving the thread take-up and the needle bar during the thread winding operation; and a second thread winding operation control portion (193B) for bringing the upper shaft clutch mechanism into the connecting state to drive a sewing machine during the thread winding operation, thereby catching the upper thread connected to a needle by means of the blade tip of the outer holder and separately rotating the upper thread in upper and lower parts of the inner holder, then causing the thread engaging portion and the thread position regulating portion in the thread catching and holding member to catch the upper thread passing over the inner holder, and thereafter operating the first moving means and the second moving means to cause the supplied thread connected between the thread holding portion and the thread position regulating portion to enter the slit and bringing the upper shaft clutch mechanism into a release state so that the thread can be wound upon the bobbin without vertically moving the thread take-up and the needle bar during the thread winding operation.

By employing such a structure, it is possible to easily supply the bobbin with the supplied thread to be used for embroidering or the upper thread to be the lower thread without removing the bobbin from the horizontal holder. In other words, it is possible to easily select the type of the lower thread to be supplied to the bobbin depending on a stitch. In addition, since the thread take-up is not moved vertically during the thread winding operation, the thread does not act violently and the upper thread can be prevented from being entangled or cut.

Moreover, a fourth aspect of the invention is directed to the lower thread winding device according to the first or third aspect of the invention, further comprising:

a thread separating portion (an inclined surface 47 for thread separation) protruded from the outer peripheral surface of the outer holder and capable of moving the supplied thread positioned in the vicinity of the outer peripheral surface of the outer holder in a separating direction from the outer holder when the outer holder is normally rotated; and a reholding operation control portion (a lower thread reholding operation control portion 194) for setting the thread holding member or the thread catching and holding member into a thread catching position which is placed above the retreat position, then rotating the outer holder to move the supplied thread positioned in the vicinity of the outer peripheral surface of the outer holder in the separating direction from the outer holder, thereby operating the thread holding member or the thread holding portion (an upper thread holding portion 59) of the thread catching and holding member to hold the supplied thread after the thread winding operation is completed. By employing such a structure, it is possible to efficiently carry out the thread winding operation when using the supplied thread.

Furthermore, a fifth aspect of the invention is directed to the lower thread winding device according to the second or third aspect of the invention, further comprising an upper thread reeling mechanism (120) including thread loosening means (130) for releasing the upper thread supplied as the lower thread at time of start of the thread winding operation; and an upper thread control portion (195) for causing an amount of reeling of the upper thread reeled from the upper thread reeling mechanism to be a set amount at time of the start of the thread winding operation and for operating the thread loosening means to release the upper thread when the bobbin winds the upper thread to be the low thread. By employing such a structure, it is possible to easily and reliably supply the bobbin with the upper thread to be the lower thread without removing the bobbin from the horizontal holder.

Moreover, a sixth aspect of the invention is directed to the lower thread winding device according to the first aspect of the invention, further comprising a thread catching hook (46) formed on the outer peripheral surface of the outer holder, an outer holder reverse rotating mechanism (205) for reversely rotating the outer holder, lower thread tension means (25) including a thread introducing port fixed to the inner holder and serving to introduce the lower thread to be the supplied thread to move along an upper surface of the inner holder when the outer holder is reversely rotated by means of the outer holder reverse rotating mechanism, and a lower thread tension applying portion (196) for setting the lower thread connected to the bobbin into the retreat position to be positioned below an upper surface of the outer peripheral surface of the outer holder and causing the thread catching hook to catch the lower thread connected to the bobbin, then reversely rotating the outer holder and operating the lower thread connected to the bobbin to enter the thread introducing port after the thread winding operation is completed. By employing such a structure, it is possible to easily apply a proper tension to the lower thread wound upon the bobbin after the thread winding operation is ended.

Furthermore, a seventh aspect of the invention is directed to the lower thread winding device according to the sixth aspect of the invention, further comprising a cutting blade fixed to the outer peripheral surface of the outer holder to be opposed to the blade tip in an almost tangential direction; and an opening portion formed on the outer peripheral surface of the outer holder at this side in a direction of rotation to be adjacent to the cutting blade when the outer holder is reversely rotated. By employing such a structure, it is possible to easily cut the lower thread wound upon the bobbin from the supply side after the thread winding operation is ended.

Moreover, an eighth aspect of the invention is directed to a lower thread winding device, further comprising thread winding amount setting means for setting an amount of winding of the lower thread to be wound upon the bobbin, thread winding diameter detecting means for detecting a maximum thread winding diameter of the lower thread to be wound upon the bobbin, thread winding number measuring means for detecting a thread winding rotation number during the thread winding operation of the bobbin, and a thread winding amount control portion for carrying out the thread winding operation until the thread winding diameter detecting means detects the maximum thread winding diameter of the lower thread wound upon the bobbin if the thread winding amount of the lower thread is set to have a maximum set value by the thread winding amount setting means, and carrying out the thread winding operation until the thread winding number measuring means detects the thread winding rotation number of the bobbin which is stored and set depending on the thread winding amount set by the thread winding amount setting means if the thread winding amount set by the thread winding amount setting means is less than the maximum set value. By employing such a structure, it is possible to reliably supply the bobbin with the lower thread in a proper amount.

Furthermore, a ninth aspect of the invention is directed to the lower thread winding device according to the first or third aspect of the invention, further comprising thread hold detecting means for detecting that the thread supplied during the thread winding operation is held in the thread holding member or the thread catching and holding member. By employing such a structure, it is possible to easily detect the suitability of the start of the thread winding operation using the supplied thread.

Moreover, a tenth aspect of the invention is directed to the lower thread winding device according to the first, second or third aspect of the invention, further comprising a sewing data storage portion for storing a plurality of pattern sewing data, pattern selecting means for selecting desirable pattern sewing data from the pattern sewing data, and an automatic setting portion for automatically setting selection of the lower thread to be supplied to the bobbin depending on the pattern sewing data selected by the pattern selecting means and/or a thread winding amount of the lower thread. By employing such a structure, it is possible to automatically set the selection of the lower thread and the thread winding amount of the lower thread depending on the pattern sewing data. Consequently, it is possible to easily carry out the operation.

DESCRIPTION OF THE PREFERRED EMBODIMENTS

The invention will be described below based on an embodiment with reference to the drawings.

FIGS. 1 to 21 show a first example of an embodiment of a lower thread winding device according to the invention.

The lower thread winding device according to the embodiment is used in a sewing machine for carrying out embroidering, and can select a supplied thread (supplied thread) or an upper thread as a lower thread to be supplied to a bobbin during a thread winding operation.

Figure 1:
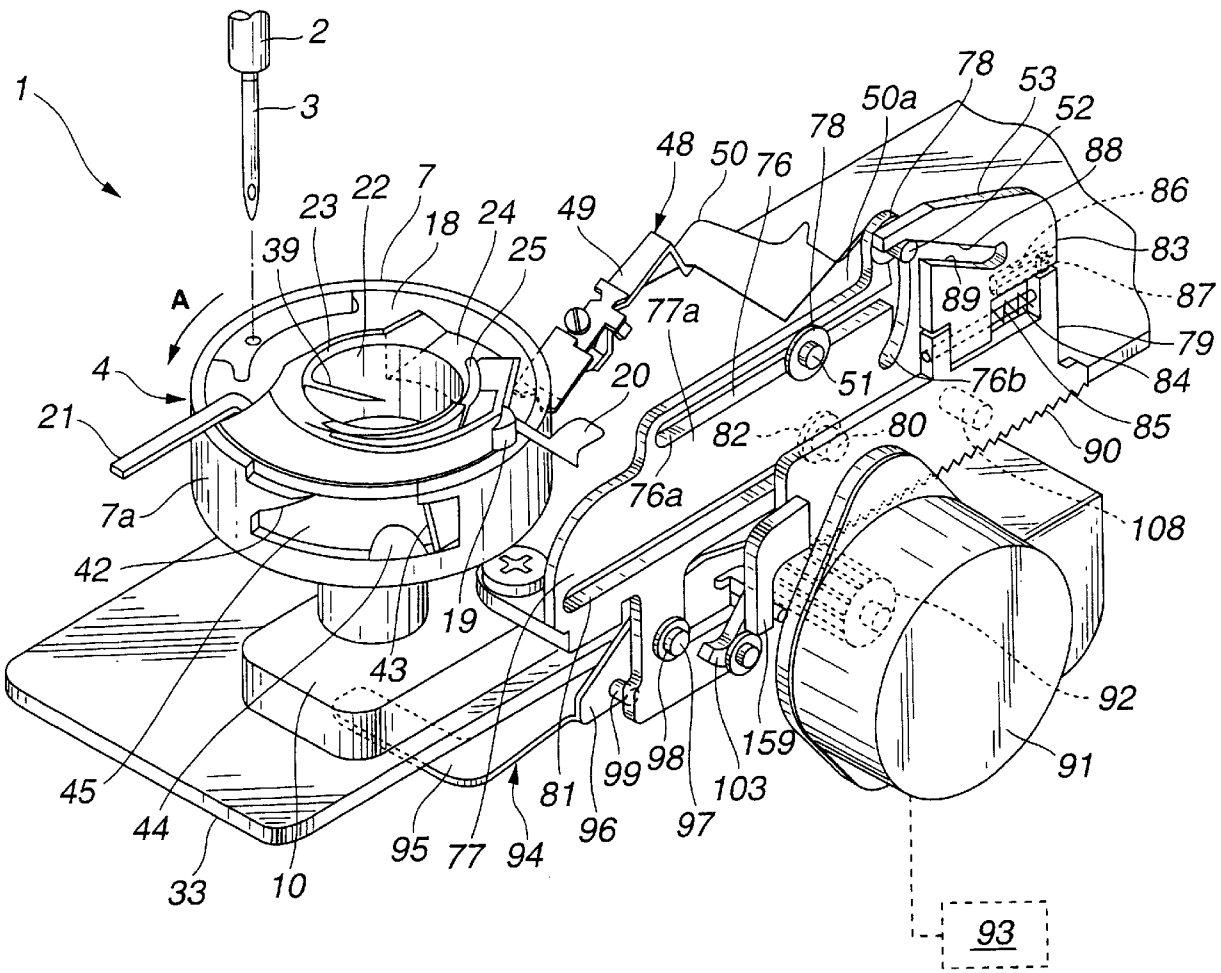
FIG. 1 is a perspective view showing the structure of a main part in the vicinity of a horizontal holder according to an embodiment of a lower thread winding device of the invention.
Figure 2:
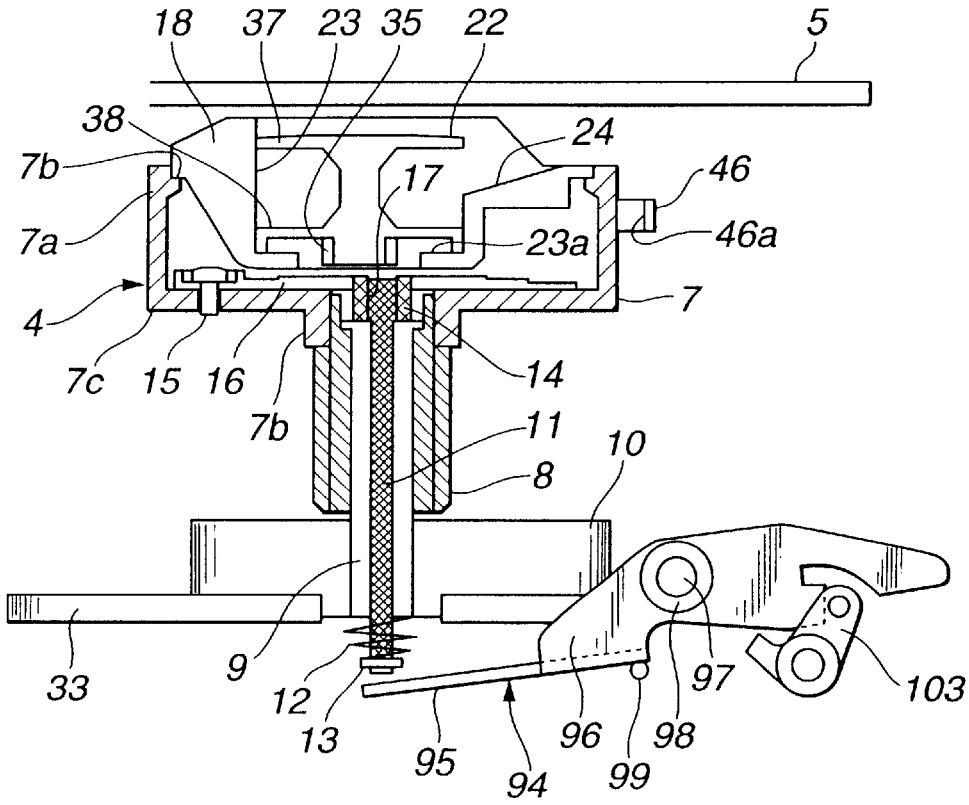
FIG. 2 is a partially sectional view showing the structure of the main part in the vicinity of the horizontal holder.
Figure 12:
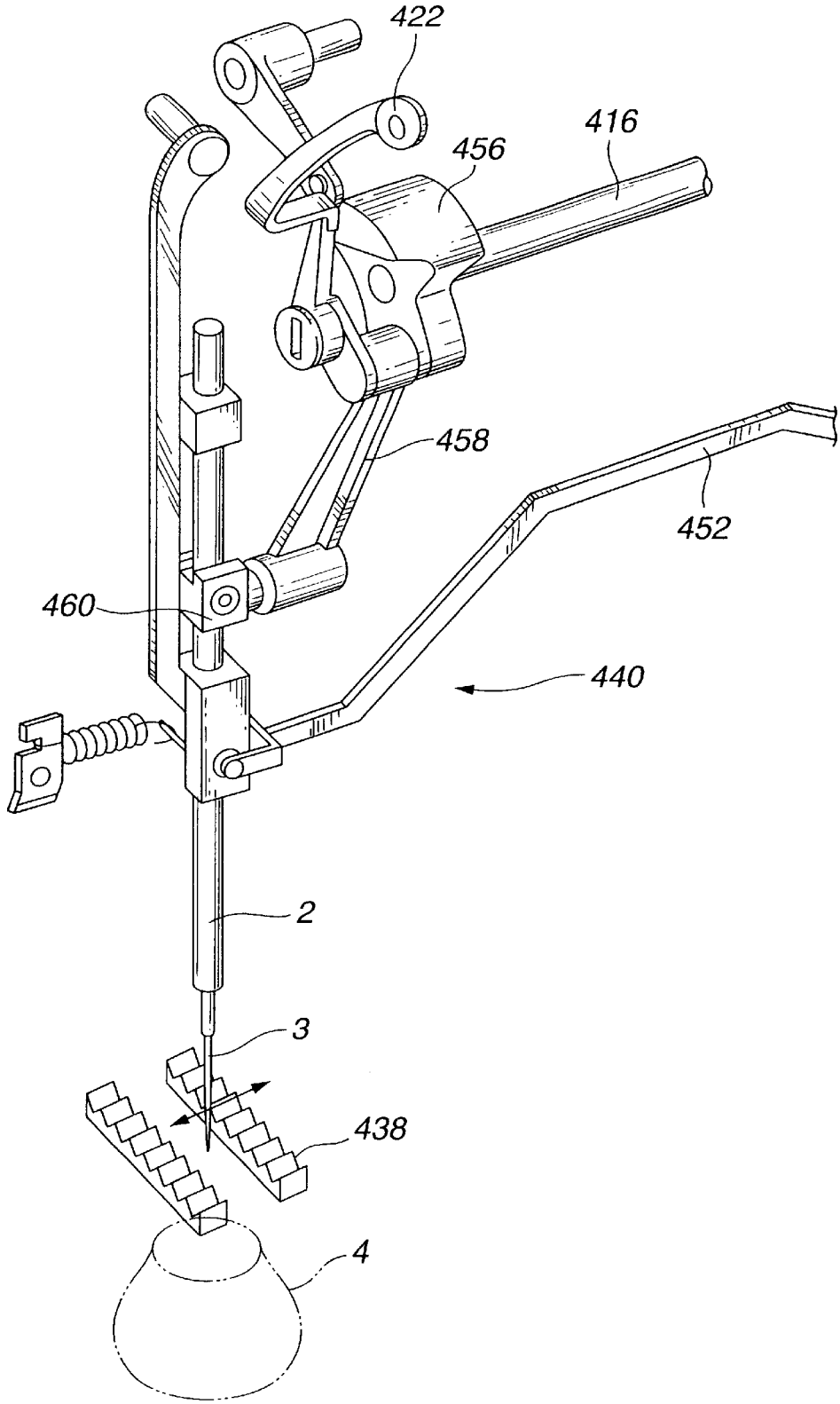
FIG. 12 is a perspective view showing the vicinity of a needle bar and a thread take-up in a sewing machine to which an upper shaft clutch mechanism is applied.

As shown in FIGS. 1 and 2, a lower thread winding device 1 according to the embodiment has a horizontal holder 4 provided ahead of a needle 3 attached to the tip portion of a needle bar 2 to be reciprocated in a vertical direction interlockingly with an upper shaft 416 during a sewing operation by means of a needle bar mechanism (FIG. 12). The horizontal holder 4 is provided in a sewing machine frame which is not shown so as to be positioned below a throat plate 5 shown in the upper part of FIG. 2 and serves to form a desirable stitch in cooperation with a needle bar mechanism, a thread take-up mechanism and a cloth feeding mechanism shown in FIG. 12 during the sewing operation. The reciprocating motion of the needle bar 2 in the vertical direction for reciprocating the needle 3 in the vertical direction interlockingly with the upper shaft during the sewing operation can separate the upper shaft 416 from a lower shaft 414 and an upper shaft pulley 424 which are to be driven by a sewing machine motor 413 during a thread winding operation to stop the reciprocating motions of the needle 3 and a thread take-up 422 in the vertical direction, thereby holding the needle 3 in an upper position by means of an upper shaft clutch mechanism 410 (FIG. 49) which will be described below.

The horizontal holder 4 has an outer holder 7 to be normally rotated in a counterclockwise direction seen from above as shown in an arrow A of FIG. 1 interlockingly with the lower shaft 414 to be driven by the sewing machine motor 413 during the sewing operation. The outer holder 7 is formed almost cylindrically in two steps including an upper part to be a large diameter portion 7*a* having a large diameter and a lower part to be a small diameter portion 7*b* having a small diameter as shown in FIG. 2. A screw gear 8 (FIG. 2) to be engaged with a screw gear (not shown) fixed to the lower shaft 414 is secured to the small diameter portion 7*b* of the outer holder 7, and the outer holder 7 is formed to be rotatable interlockingly with the rotating motion of the lower shaft 414 with the screw gear 8.

A holder shaft 9 formed almost cylindrically is provided in the axial center portion of the outer holder 7 to penetrate through the axial center portion of the screw gear 8 as shown in FIG. 2, and the lower end of the holder shaft 9 is fixed to a holder attachment table 10 shown in the lower part of FIG. 2 with a screw which is not shown. The holder attachment table 10 is attached to a base frame 33 fixed into the sewing machine frame which is not shown. A bobbin driving member 11 having both upper and lower ends protruded from both upper and lower ends of the holder shaft 9 is provided to be rotatable and movable in an axial direction, and the upper end of a bobbin driving member energizing spring 12 provided on the outer peripheral surface of the lower part of the bobbin driving member 11 is caused to abut on the holder shaft 9 or the lower end face of the holder attachment table 10 and the lower end of the bobbin driving member energizing spring 12 is caused to abut on the upper surface of a snap ring 13 attached into the vicinity of the lower end of the bobbin driving member 11 so that the bobbin driving member 11 is always energized downward. Moreover, the upper end of the bobbin driving member 11 is provided with a bobbin driving gear 14. The bobbin driving gear 14 is always fitted in the inner part of a step portion 7*c* connecting the large diameter portion 7*a* and the small diameter portion 7*b* in the outer holder 7, more specifically, a gear hole 17 having the same shape as that of the bobbin driving gear 14 provided to penetrate in a thickness direction in the axial center part of an outer holder bottom plate 16 fixed into the inner bottom part of the large diameter portion 7*a* with a screw 15 so that the bobbin driving member 11 is always rotated integrally with the outer holder 7.

An inner holder 18 having an opened upper part which is almost cup-shaped is provided in the large diameter portion 7*a* of the outer holder 7. The inner holder 18 is provided with an axial center thereof shifted leftward as seen from the upstream side in a cloth feeding direction with respect to the axial center of the outer holder 7, and furthermore, is rotatably supported with a race face 7*d* formed in the upper part of the inner peripheral surface of the large diameter portion 7*a* of the outer holder 7. The horizontal holder 4 provided with the axial center of the inner holder 18 shifted from that of the outer holder 7 can easily prevent a hitch stitch during a sewing operation so that quality of sewing can be enhanced and a space for providing a thread cutting device and a lower thread reeling device which are not shown can easily be maintained. The inner holder 18 is normally rotated together with the outer holder 7 by friction with the outer holder 7 when the outer holder 7 is normally rotated. The rotation of the inner holder 18 can be stopped by causing a projection 19 (FIG. 1) provided on the outer peripheral surface of the inner holder 18 positioned above the upper end of the outer holder 7 to abut on an inner holder detent 20 (FIG. 1) fixed to the sewing machine frame. Moreover, the reverse rotation of the inner holder 18 which is carried out when the outer holder 7 is reversely rotated can be stopped by an inner holder reverse rotation stopper 21 (FIG. 1) having an elasticity which is fixed to the sewing machine frame. Furthermore, a bobbin housing hole 23 for accommodating a bobbin 22 which will be described below is formed almost cylindrically in the axial center portion of the inner part of the inner holder 18. A concave groove 24 for bobbin attachment and removal which has an upper part to be an opening is formed in a part of the peripheral surface of the bobbin housing hole 23 in order to easily attach and remove the bobbin 22 to and from the bobbin housing hole 23. Furthermore, a part of the upper part of the bobbin housing hole 23 in a circumferential direction is provided with lower thread tension means 25 (FIG. 1) which also serves as a part of the bobbin housing hole 23.

Figure 3:
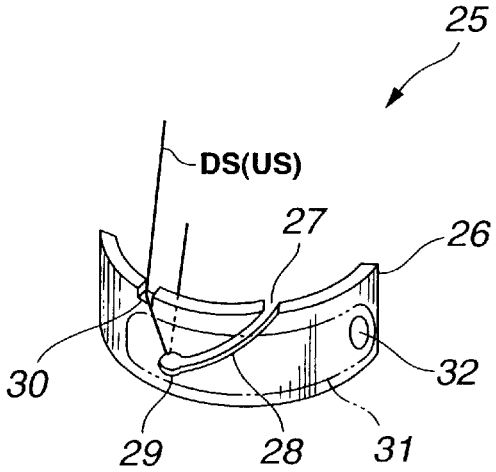
FIG. 3 is a perspective view showing lower thread tension means.

The lower thread tension means 25 serves to wind a lower thread DS and to supply the lower thread DS to the bobbin 22 and to then apply a proper tension to the lower thread DS during the sewing operation, and has a board 26 formed arcuately as shown in FIG. 3. The inner peripheral surface of the board 26 is formed to have a curvature which is almost equal to the inside diameter of the bobbin housing hole 23 or is slightly greater than the inside diameter of the bobbin housing hole 23 in order to form a part of the inner surface of the bobbin housing hole 23. The upper edge of the board 26 is provided with a thread introducing port 27 for introducing the lower thread DS to be moved from right toward left in FIG. 3 along the upper surface of the inner holder 18 when the outer holder 7 is rotated reversely, and the tip portion of a thread introducing groove 28 penetrating in a thickness direction with such a width that the lower thread DS can pass is connected to the thread introducing port 27. The rear end of the thread introducing groove 28 is connected to an almost circular thread engagement hole 29 formed in the lower left part of FIG. 3 from the thread introducing port 27 of the board 26 and penetrating in the thickness direction. Furthermore, a groove-like thread outlet 30 is concaved on the upper edge of the board 26 positioned in the left part of FIG. 3 from the thread engagement hole 29. Moreover, a lower thread presser leaf spring 31 shown in an imaginary line of FIG. 3 is provided in close contact with the outer peripheral surface of the board 26 in order to press the lower thread DS reaching the thread outlet 30 from the thread engagement hole 29, and the lower thread DS wound upon the bobbin 22 is connected to a stitch in such a state that a predetermined tension is applied with the lower thread presser leaf spring 31 between the thread engagement hole 29 and the thread outlet 30 as shown in FIG. 3. The lower thread presser leaf spring 31 is superposed on the outer peripheral surface of the board 26, and the lower thread presser leaf spring 31 and the board 26 are thus fixed to the inner holder 18 with a fixing screw 32.

Figure 4:
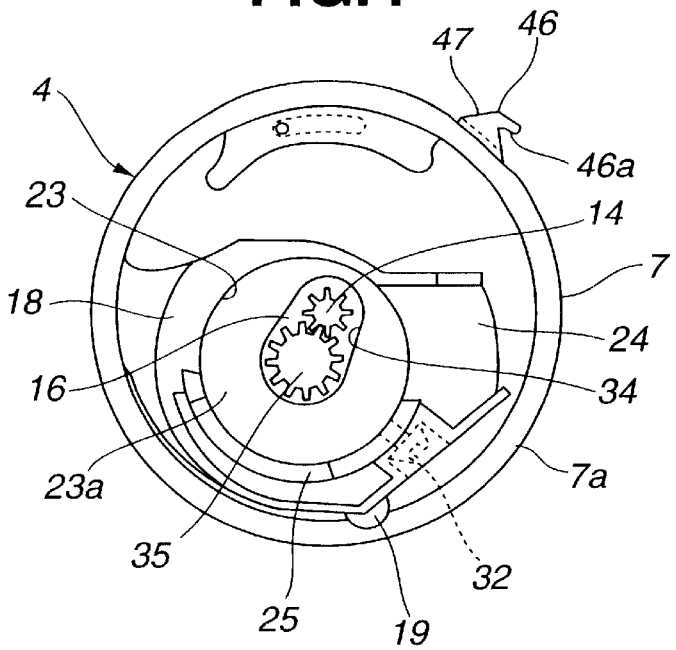
FIG. 4 is a plan view showing the vicinity of the bottom portion of an inner holder.

An inner holder through hole 34 penetrating in the thickness direction is formed to include the axial center of the bobbin 22 coincident with that of the inner holder 18 and the axial center of the outer holder 7 as shown in FIG. 4 in a bottom portion 23*a* of the bobbin housing hole 23 which is shown in the lower part of FIG. 2, and the bobbin driving gear 14 provided on the upper end of the bobbin driving member 11 can enter the inner holder through hole 34 when the bobbin driving member 11 is lifted against the energizing force of the bobbin driving member energizing spring 12. When the bobbin driving gear 14 enters the inner holder through hole 34, it can be engaged with a bobbin driven gear 35 formed in the bobbin 22 which will be described below.

Figure 5:
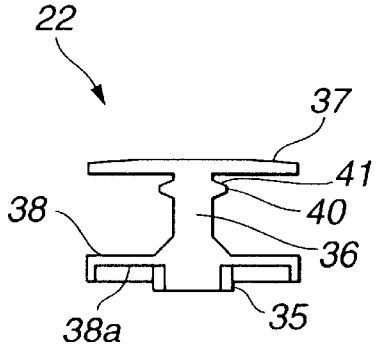
FIG. 5 is a longitudinal sectional view showing a bobbin.
Figure 6:
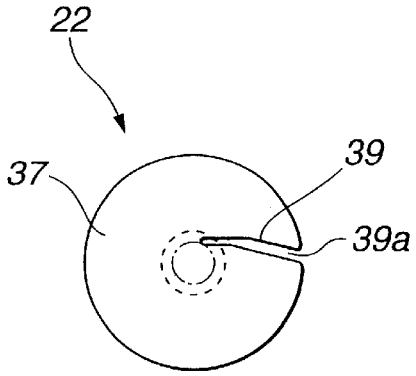
FIG. 6 is a plan view showing a state in FIG. 5.

As shown in FIG. 5, the bobbin 22 has a bobbin center shaft 36 through which the lower thread DS is wound upon an outer peripheral surface, and an upper flange 37 and a lower flange 38 are provided on both ends of the bobbin center shaft 36 to be opposed to each other. In other words, the upper flange 37 is provided on the upper end of the bobbin center shaft 36 and the lower flange 38 is provided on the lower end. A lower end face 38*a* of the lower flange 38 shown in the lower part of FIG. 5 is provided with the bobbin driven gear 35 having an axial center thereof equal to that of the lower flange 38, that is, the bobbin 22. The bobbin driven gear 35 can be engaged with the bobbin driven gear 14 provided on the upper end of the bobbin driving member 11 when the bobbin driving member 11 is lifted against the energizing force of the bobbin driving member energizing spring 12. Moreover, a slit 39 having an opening 39*a* on an outer peripheral edge is formed on the upper flange 37 as shown in FIG. 6. Furthermore, the upper flange 37 and the lower flange 38 is provided in parallel to be opposed to each other with an interval through the bobbin center shaft 36. Moreover, an almost annular wall portion 40 protruded toward the outside in a radial direction is formed in the connecting part of the bobbin center shaft 36 and the upper flange 37 as shown in FIG. 5, and a concave groove 41 is formed between the upper surface of the wall portion 40 and the lower surface of the upper flange 37.

Returning to FIG. 1, the outer peripheral surface of the large diameter portion 7*a* of the outer holder 7 is provided with a blade tip 42 for catching an upper thread loop to form a stitch during the sewing operation, a cutting blade 43 for cutting the lower thread DS after the thread winding operation and an inducing portion 44. Furthermore, an opening portion 45 is formed on this side in a rotating direction shown in the left part of FIG. 1 of the cutting blade 43 which is adjacent to the cutting blade 43 when the outer holder 7 is rotated reversely. As shown in FIGS. 2 and 4, moreover, a thread catching hook 46 is protruded from the outer peripheral surface of the large diameter portion 7*a* of the outer holder 7. The thread catching hook 46 is provided with a hook portion 46*a* (FIG. 4) having an almost L-shaped plane and serving to catch the lower thread DS wound upon the bobbin 22 and supplied after the thread winding operation which is to be normally opposed to the rotating direction when the outer holder 7 is reversely rotated. The back face of the hook portion 46*a* of the thread catching hook 46 is provided with an inclined surface 47 for thread separation which is movable in such a direction as to separate the lower thread DS positioned in the vicinity of the outer peripheral surface of the outer holder 7 from the outer holder 7 when the outer holder 7 is normally rotated as shown in FIG. 4. Moreover, the cutting blade 43 is fixed to the outer peripheral surface of the outer holder 7 in such a direction as to be opposed to the blade tip 42 in an almost tangential direction, and the thread catching hook 46 and the cutting blade 43 have a positional relationship set to hold the state in which the cutting blade 43 is separated from the portion of the lower thread DS reaching a thread catching and holding member 48 from the thread catching hook 46 which is wound upon the outer peripheral surface of the outer holder 7 until the thread catching hook 46 completes the thread guarding for the lower thread DS over the lower thread tension means 25 and to cause the cutting blade 43 to abut on the portion of the lower thread DS reaching the thread catching and holding member 48 from the thread catching hook 46 which is wound upon the outer peripheral surface of the outer holder 7 after the thread catching hook 46 completes the thread guarding for the lower thread DS over the lower thread tension means 25.

As shown in FIG. 1, the thread catching and holding member 48 is provided in the night part of FIG. 1 from the horizontal holder 4. In the case in which a supplied thread EDS or an upper thread US is selected as the lower thread DS to be supplied to the bobbin 22 during the thread winding operation, the thread catching and holding member 48 can hold or engage either of them to be the lower thread DS during the thread winding operation. The thread catching and holding member 48 has an almost plate-shaped thread holding and catching portion 49 shown in the left part of FIG. 1 and an attachment portion 50 extended downward on this side of FIG. 1 from the rear end of the thread holding and catching portion 49 shown in the right part of FIG. 1. An attachment surface 50*a* extended in parallel in the thickness direction of the thread holding and catching portion 49 is provided on the tip of the attachment portion 50, and a front attachment pin 51 and a rear attachment pin 52 making a longitudinal pair to be positioned in almost parallel with the thread holding and catching portion 49 are protruded from the attachment surface 50*a* toward this side of FIG. 1 apart from the thread holding and catching portion 49 at a desirable interval. The pair of longitudinal attachment pins 51 and 52 are supported to be movable by thread catching and holding member moving means 53 which will be described below.

Figure 7:
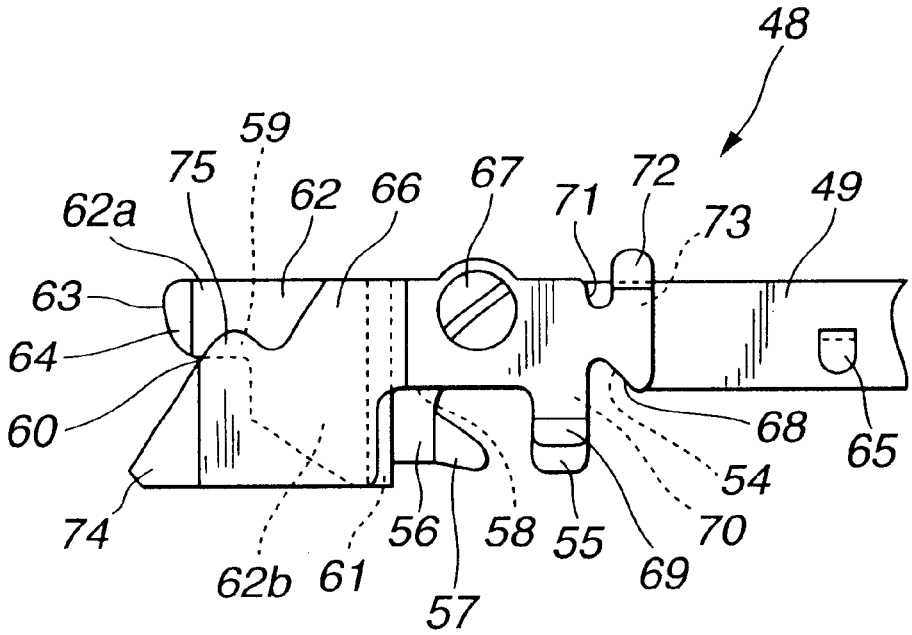
FIG. 7 is a plan view showing the main part of a thread catching and holding member.
Figure 8:
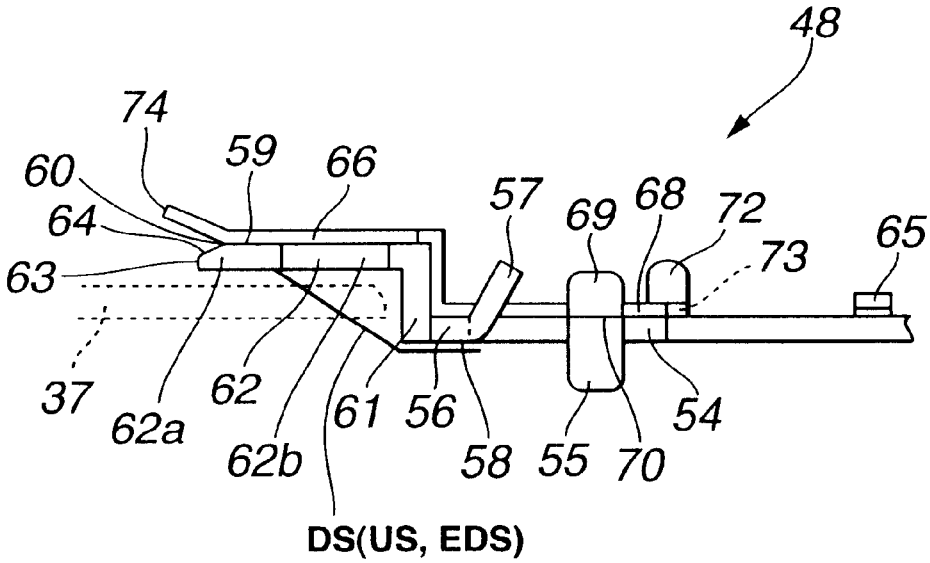
FIG. 8 is a front view showing a state in FIG. 7.

As shown in FIGS. 7 and 8, an almost sawtoothed hooking groove 54 through which the lower thread DS passes in the selection of the upper thread US as the lower thread DS to be supplied to the bobbin 22 during the thread winding operation is formed in an almost central part in a longitudinal direction shown transversely in FIG. 7 of the front edge of the thread holding and catching portion 49 constituting the thread catching and holding member 48 as shown in the lower part of FIG. 7. A rear tongue piece 55 is protruded toward this side shown in the lower part of FIG. 7 and is bent and extended to be inclined downward as shown in FIG. 8 in an adjacent position to the tip side of the hooking groove 54 shown in the left part of FIG. 7.

A protruded portion 56 protruded toward this side shown in the lower part of FIG. 7 is formed at a proper interval on the tip side of the rear tongue piece 55 shown in the left part of FIG. 7, and a front tongue piece 57 protruded toward the rear end side shown in the right part of FIG. 7 and bent and extended to be inclined upward as shown in FIG. 8 is formed on this side of the rear edge of the protruded portion 56 shown in the right part of FIG. 7 at a proper interval from the front edge of a portion positioned on the rear end side of the protruded portion 56 shown in the right part of FIG. 7. A portion provided at the inner side on the lower surface of the base of the front tongue piece 57 shown in the upper part of FIG. 7 acts as a thread position regulating portion 58 to position the supplied thread EDS positioned on the supply side from a thread holding portion 59 and a thread engaging portion 60 which will be described below or the upper thread US supplied as the lower thread DS to abut on the upper flange 37 of the bobbin 22 during the thread winding operation.

The tip side of the protruded portion 56 shown in the left part of FIG. 7 is formed to have an almost transverse L-shaped front face by an erected portion 61 having the greatest width which is protruded toward this side shown in the lower part of FIG. 7 from the tip edge of the protruded portion 56 shown in the left part of FIG. 7 and a horizontal portion 62 extended in a horizontal direction from the upper end of the erected portion 61. The horizontal portion 62 is formed by a front horizontal portion 62*a* having a small width and an almost rectangular plane which is positioned in the left part of FIG. 7, is provided with a straight inner edge as shown in the upper part of FIG. 7 and is positioned on the tipmost side of the thread holding and catching portion 49, and a rear horizontal portion 62*b* having a great width and an almost rectangular plane which connects the front horizontal portion 62*a* to the upper end of the erected portion 61. The corner portion of the rear horizontal portion 62*b* shown in the lower left part of FIG. 7 is obliquely chamfered. Moreover, the tip of the front horizontal portion 62*a* acts as a thread holding and catching tip 63, and the upper corner portion of the thread holding and catching tip 63 is provided with a guide inclined surface 64 having a thickness gradually decreased toward the tip as shown in FIG. 8. Furthermore, the corner portion of the thread holding and catching tip 63 shown in the lower left part of FIG. 7 is chamfered to be rounded and the thread holding and catching tip 63 is wholly formed to have an almost rounded convex plane toward the tip as shown in FIG. 7.

An almost transverse L-shaped thread guide tongue piece 65 to act as the guide of the lower thread DS in the selection of the supplied thread EDS to be the lower thread DS supplied to the bobbin 22 during the thread winding operation is formed to have a free end protruded upward toward this side shown in the lower part of FIG. 7 in an almost central part in the width direction of the upper surface on the rear end side shown in the right part of FIG. 7 from the rear tongue piece 55 of the thread holding and catching portion 49.

A thread holding leaf spring 66 is provided in close contact with an upper surface on the tip side of the thread holding and catching portion 49 with a screw 67 (FIG. 7). The thread holding leaf spring 66 is provided with an upper hooking groove 68 having the same planar shape as that of the hooking groove 54 formed in the thread holding and catching portion 49, and the tip side of the upper hooking groove 68 shown in the left part of FIG. 7 is provided with an upper rear tongue piece 69 protruded toward this side shown in the lower part of FIG. 7 to be positioned on the rear tongue piece 55 and bent and extended to be inclined upward as shown in FIG. 8. The inside of the base of the abutment portion of the upper rear tongue piece 69 and the rear tongue piece 55 acts as a rear holding portion 70 for an upper thread which holds the lower thread DS on the supply side of the thread position regulating portion 58 when the upper thread US is selected as the lower thread DS to be supplied to the bobbin 22 during the thread winding operation.

A concave hooking groove 71 which is almost the same as the upper hooking groove 68 is formed on the inner edge of the upper hooking groove 68 of the thread holding leaf spring 66 shown in the upper part of FIG. 7, and a thread hooking tongue piece 72 protruded toward the inner side shown in the upper part of FIG. 7 and bent and extended to be inclined upward as shown in FIG. 8 is formed adjacently in the right part of the concave hooking groove 71. The inside of the base of the abutment portion of the thread hooking tongue piece 72 and the upper surface of the thread holding and catching portion 49 acts as a special rear holding portion 73 for a lower thread which holds the supplied thread EDS on the supply side of the thread position regulating portion 58 when the supplied thread EDS is selected as the lower thread DS which is to be supplied to the bobbin 22 during the thread winding operation.

The tip side of the thread holding leaf spring 66 shown in the left part of FIG. 7 is formed to have an almost transverse L-shaped front face with a straight front edge shown in the lower part of FIG. 7, and a corner portion shown in the lower left part of FIG. 7 acts as a thread holding leaf spring tip 74. The tip edge of the thread holding leaf spring 66 shown in the left part of FIG. 7 is obliquely inclined toward the rear edge side shown in the right part of FIG. 7 from the thread holding leaf spring tip 74 toward an inner edge shown in the upper part of FIG. 7 as shown in FIG. 7, and a convex portion 75 is formed upward in FIG. 7 in a middle portion superposed on the front horizontal portion 62*a* of the thread holding and catching portion 49. Moreover, a portion on the tip side from the thread holding leaf spring tip 74 to the convex portion 75 is bent and extended to be inclined upward on the tip side as shown in FIG. 8. The crossing portion of the tip edge of the thread holding leaf spring 66 and that of the thread holding and catching portion 49 acts as a thread engaging portion 60 which can engage the upper thread US to be the supplied lower thread DS to be positioned above the upper flange 37 of the bobbin 22 when it is placed in an entry position during the thread winding operation which will be described below, and the abutment portion of the convex portion 75 of the thread holding leaf spring 66 and the upper surface of the thread holding and catching portion 49 acts as a thread holding portion (thread holding portion) 59 capable of holding the supplied thread EDS above the upper flange 37 of the bobbin 22 when it is placed in the entry position during the thread winding operation which will be described below.

In the embodiment, there is used the thread catching and holding member 48 capable of holding or catching the supplied thread EDS or the upper thread US which is selected as the lower thread DS to be supplied to the bobbin 22. In the case in which only the supplied thread EDS is supplied as the lower thread DS to be supplied to the bobbin 22, a thread holding member having the thread position regulating portion 58, the thread holding portion 59 and the special rear holding portion 73 for a lower thread which is not shown may be used in place of the thread catching and holding member 48. In the case in which only the upper thread US is supplied as the lower thread DS to be supplied to the bobbin 22, moreover, a thread catching member having the thread position regulating portion 58, the thread engaging portion (thread holding portion) 60 and the rear holding portion 70 for an upper thread which is not shown may be used in place of the thread catching and holding member 48.

Returning to FIG. 1, the thread catching and holding member moving means 53 serves to cause the tip portion of the thread catching and holding member 48 to advance or retreat between a retreat position and an entry position, and has a moving groove 76 through which the front attachment pin 51 and the rear attachment pin 52 protruded from the attachment surface 50*a* of the thread catching and holding member 48 are inserted. The moving groove 76 is formed in the vicinity of the upper part of an erected portion 77*a* of a mechanism table 77 having an almost L-shaped section which is fixed to the base frame 33, and is formed by a slot-shaped horizontal portion 76*a* provided by setting a longitudinal direction to be almost horizontal as shown in the left part of FIG. 1 and a vertical portion 76*b* which has an almost central part in the longitudinal direction positioned in a vertical direction connected to the rear end side of the horizontal portion 76*a* shown in the right part of FIG. 1 and is provided like a convex circular arc toward the rear end side. The tips of the front attachment pin 51 and the rear attachment pin 52 are inserted through the moving groove 76 to be protruded toward this side, and furthermore, a snap ring 78 is attached to the tips of the front attachment pin 51 and the rear attachment pin 52 respectively as is well known. Consequently, the thread catching and holding member 48 is attached to the mechanism table 77.

A plate-shaped lower driving plate 79 is provided in parallel at a proper interval in the lower right part on this side of FIG. 1 in the erected portion 77*a* of the mechanism table 77, and the lower driving plate 79 is supported to be movable along a guide groove 81 by inserting the tips of a pair of longitudinal guide pins 80 (one of which is shown) protruded from a back face shown on the inner side of FIG. 1 in the lower driving plate 79 to be protruded through the guide groove 81 formed to be extended in parallel with the horizontal portion 76*a* of the moving groove 76 below the moving groove 76 of the mechanism table 77 and attaching the snap ring 82 to the tips of the guide pins 80 respectively as is well known.

Moreover, a plate-shaped upper driving plate 83 is provided in parallel at a proper interval in the upper right part on this side of FIG. 1 in the erected portion 77*a* of the mechanism table 77, and the lower end of the upper driving plate 83 is inserted through a guide rod 84 provided on the right side of the upper edge of the lower driving plate 79 and is always energized toward the tip side shown in the left part of FIG. 1 by means of an energizing spring 85 attached to an outer peripheral surface on the rear end side of the guide rod 84 shown in the right part of FIG. 1. An engagement groove 86 is formed on the lower edge of the upper driving plate 83 and an engagement pin 87 protruded upward in the right part of the guide rod 84 on the upper edge of the lower driving plate 79 is fitted in the engagement groove 86 so that the upper driving plate 83 can be prevented from being rotated around the guide rod 84. Furthermore, the upper driving plate 83 is provided with a cam groove 89 from the oblique upper left part toward the oblique lower right part which has an opening in the left part of FIG. 1 in order to form a cam face 88 for vertically moving the rear attachment pin 52, thereby vertically moving the tip of the thread catching and holding member 48 along the large diameter portion 7*a* of the outer holder 7, and the tip portion of the rear attachment pin 52 is formed to be fitted in the cam groove 89. Moreover, a rack 90 to be engaged with a pinion 92 attached to the output shaft of a driving motor 91 is formed on the lower edge of the lower driving plate 79 and the lower driving plate 79 is movable along the guide groove 81 by the rotation of the driving motor 91 so that the thread catching and holding member 48 can freely advance and retreat.

As shown in FIG. 1, furthermore, the driving motor 91 of the thread catching and holding member moving means 53 is electrically connected to a control portion 93 which will be described below, and is driven in a predetermined timing based on a control instruction sent from the control portion 93.

In the embodiment, there has been used the thread catching and holding member 48 capable of holding or catching the supplied thread EDS or the upper thread US which is selected as the lower thread DS to be supplied to the bobbin 22. In the case in which only the supplied thread EDS is supplied as the lower thread DS to be supplied to the bobbin 22, it is preferable that the thread catching and holding member moving means 53 should be used as second moving means which is not shown and causes the tip portion of the thread holding member which is not shown to advance or retreat between a retreat position and an entry position. In the case in which only the upper thread US is supplied as the lower thread DS to be supplied to the bobbin 22, moreover, it is preferable that the thread catching and holding member moving means 53 should be used as thread catching member moving means which is not shown and causes the tip portion of the thread catching member (not shown) to advance or retreat between the retreat position and the entry position.

Figure 9:
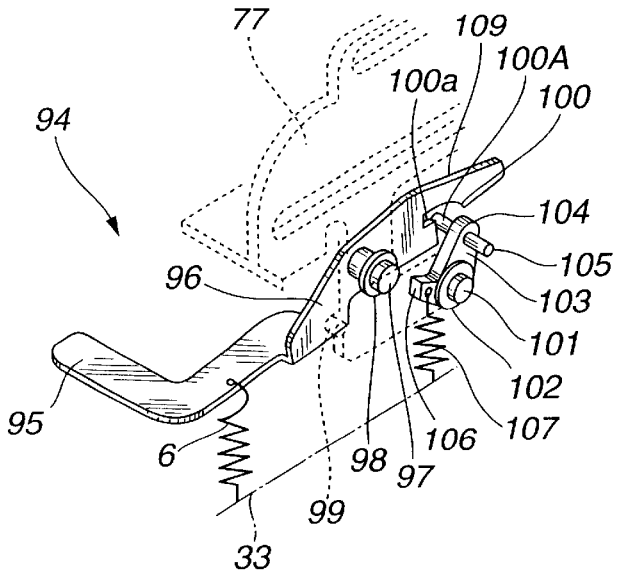
FIG. 9 is a perspective view showing the main part of first moving means.

As shown in FIG. 2, first moving means 94 is provided below the bobbin driving member 11. The first moving means 94 has an operating plate 95 having an almost L-shaped plane which is positioned below the bobbin driving member 11. A gear connecting link 96 is continuously provided on the rear end of the operating plate 95 shown in the right part of FIG. 2 as shown in FIGS. 1, 2 and 9. A link support pin 97 erected in the vicinity of the corner portion of the mechanism table 77 in the lower left part of FIG. 1 is inserted through an almost central part in the longitudinal direction of the gear connecting link 96 to be protruded toward this side in FIG. 1, and the gear connecting link 96 is attached to the mechanism table 77 to be supported rotatably around the link support pin 97 with a snap ring 98 attached to the tip side of the link support pin 97. Furthermore, the operating plate 95 is always energized in a counterclockwise direction around the link support pin 97 by means of a spring 6 having one of ends engaged with the operating plate 95 and the other end engaged with the base frame 33 as shown in FIG. 9, and the rotation of the operating plate 95 in the counterclockwise direction around the link support pin 97 is held in a position where the lower end face of the gear connecting link 96 abuts on a positioning pin 99 protruded from the mechanism table 77. As a result, the operating plate 95 is always provided below the bobbin driving member 11 and can hold such a separating position that the bobbin driving gear 14 provided on the upper end of the bobbin driving member 11 is engaged with the gear hole 17 of the outer holder bottom plate 16 and is separated from the bobbin driven gear 35.

As shown in FIG. 9, an arcuate convex groove portion 100 is formed in the lower right part of the gear connecting link 96 and an abutment edge 100A extended in an almost vertical direction is formed in the lower left part of the arcuate groove portion 100. A stopper pin 105 can abut on the abutment edge 100A. The stopper pin 105 is provided to penetrate in a thickness direction on an operating arm 104 of an almost bell crank-shaped stopper 103 rotatably attached through a snap ring 102 to a support pin 101 erected in the lower right part of the link support pin 97 of the mechanism table 77. A spring 107 having one of ends engaged with a driving arm 106 and the other end engaged with the base frame 33 is provided on a driving arm 106 of the stopper 103 shown in the left part of FIG. 9, and the stopper pin 105 is always energized toward the abutment edge 100A formed in an almost vertical direction in the lower left part of the arcuate groove portion 100 in such a state as to be energized in a counterclockwise direction by the energizing force of the spring 107. Moreover, an inclined cam face 109 is formed in the right part of FIG. 9 in the upper edge of the gear connecting link 96. An operating pin 108 protruded from the back face of the lower driving plate 79 shown in FIG. 1 can separate from or approach the inclined cam face 109 interlockingly with the advance and retreat motions of the lower driving plate 79, and the operating pin 108 abuts on the inclined cam face 109 in the middle of the advance of the lower driving plate 79 toward the advance side shown in the left part of FIG. 1 and the gear connecting link 96 energized in the counterclockwise direction around the link support pin 97 is rotated in a clockwise direction against the energizing force of the spring 6. As a result, the tip of the operating plate 95 is lifted in a predetermined timing to abut on the bobbin driving member 11 and to lift the bobbin driving member 11 and the bobbin driving gear 14 provided on the upper end of the bobbin driving member 11 is lifted so that the bobbin driving gear 14 engaged with the gear hole 17 of the outer holder bottom plate 16 is engaged with both of the gear hole 17 of the outer holder bottom plate 16 and the bobbin driven gear 35 and can be thereby set into a connecting position where the bobbin driving member 11 is connected to the bobbin 22. Moreover, when the operating pin 108 abuts on the inclined cam face 109 in the middle in which the lower driving plate 79 advances toward the advance side shown in the left part of FIG. 1 and the gear connecting link 96 energized in the counterclockwise direction around the link support pin 97 is rotated in the clockwise direction against the energizing force of the spring 6, the stopper pin 105 energized in the counterclockwise direction by the energizing force of the spring 107 is fitted in and engaged with a groove bottom 100*a* of the arcuate groove portion 100.

Furthermore, the stopper pin 105 fitted in the groove bottom 100*a* of the arcuate groove portion 100 abuts on an almost inverted L-shaped stopper pin operating arm 159 provided to be protruded from the tip portion of the lower driving plate 79 in the middle in which the lower driving plate 70 is moved from an advance end shown in the left part of FIG. 1 to a retreat end shown in the right part of FIG. 1, and is thereby separated from the groove bottom 100*a* of the arcuate groove portion 100, and the operating pin 108 is separated from the inclined cam face 109 and is opposed to the abutment edge 100A formed in the lower left part of the arcuate groove portion 100 by the counterclockwise rotation of the gear connecting link 96 energized in the counterclockwise direction by the energizing force of the spring 6.

Therefore, the stopper pin 105 according to the embodiment can maintain a separation state from the arcuate groove portion 100 to hold the bobbin driving member 11 and the bobbin 22 in a separating position when the lower driving plate 79 shown in FIG. 1 is positioned on the retreat end shown in the right part of FIG. 1, and can maintain a fitting state in the groove bottom 100*a* of the arcuate groove portion 100 to hold the bobbin driving member 11 and the bobbin 22 in a connecting position when the lower driving plate 79 shown in FIG. 1 is positioned on the advance end shown in the left part of FIG. 1.

More specifically, the first moving means 94 is formed to be operated interlockingly with the thread catching and holding member moving means 53.

It is also possible to employ such a structure that the first moving means 94 is driven by another independent driving motor.

Figure 10:
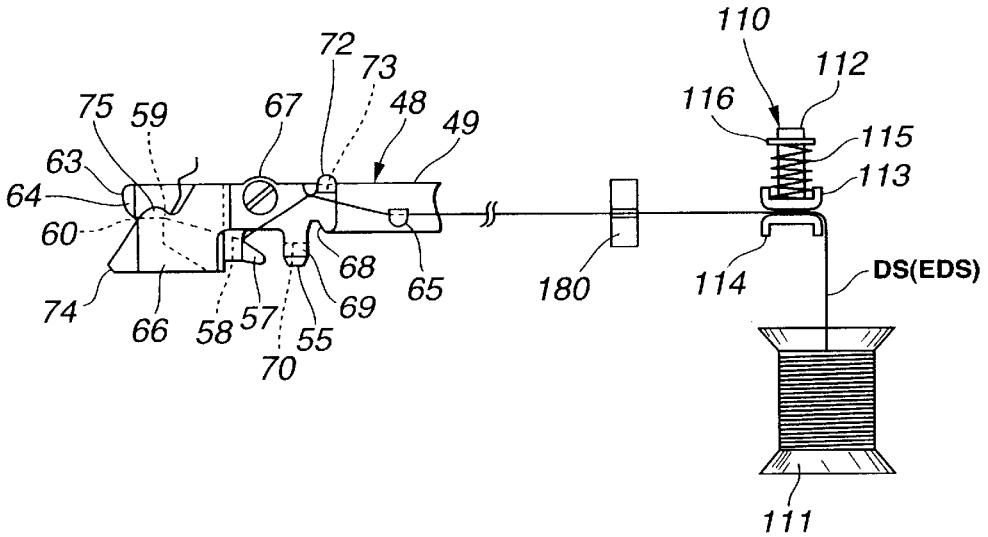
FIG. 10 is a view illustrating an example of a special lower thread reeling mechanism and a state in which a supplied thread is held in the thread catching and holding member.

With reference to FIG. 10, next, description will be given to an example of a special lower thread reeling mechanism to be used when a supplied thread is supplied as a lower thread to be supplied to a bobbin.

In the case in which the supplied thread EDS is supplied as the lower thread DS to be supplied to the bobbin 22 according to the embodiment, a special lower thread reeling mechanism 110 serves to apply a proper tension to the supplied thread EDS to be wounded upon the bobbin 22 during the thread winding operation. A lower thread piece 111 having the supplied thread EDS wound is rotatably supported in the desirable position of the sewing machine frame which is not shown before at least the winding operation is started, and the supplied thread EDS reeled from the lower thread piece 111 supported rotatably on a lower thread rod which is not shown during the thread winding operation is hung to hold the thread end side on the thread catching and holding member 48 through the special lower thread reeling mechanism 110 positioned on the supply side as shown in FIG. 10 at time of the start of the thread winding operation.

As shown in FIG. 10, the special lower thread reeling mechanism 110 has a lower thread tension pin 112 supported on an attachment stay which is not shown, and a movable disc 113 is movably provided on the outer peripheral surface of the lower thread tension pin 112 along the lower threat tension pin 112. A fixed disc 114 is provided on the lower end of the lower thread tension pin 112 to be mutually opposed to the movable disc 113. Furthermore, a lower thread tension spring 115 is externally provided over the outer peripheral surface of the lower thread tension pin 112 and the lower end of the lower thread tension spring 115 is caused to abut on the upper surface of the movable disc 113 and the upper end of the lower thread tension spring 115 is caused to abut on the lower surface of a snap ring 116 attached to the vicinity of the upper end of the lower thread tension pin 112 so that the movable disc 113 can be always energized toward the fixed disc 114. More specifically, the supplied thread EDS is interposed between the fixed disc 114 and the movable disc 113 by the energizing force of the lower thread tension spring 115.

Figure 11:
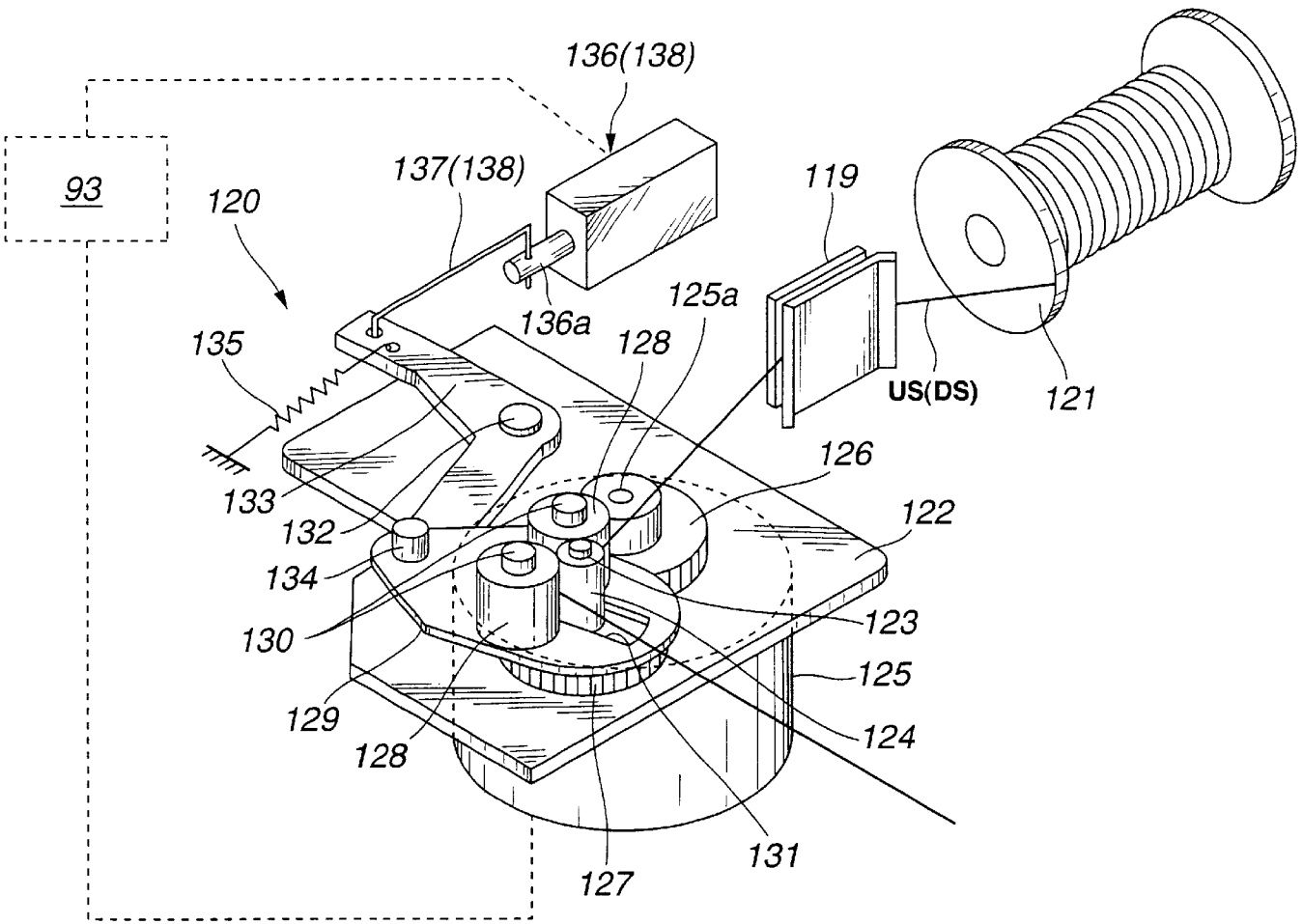
FIG. 11 is a view illustrating the structure of a main part according to an example of an upper thread reeling mechanism.

With reference to FIG. 11, next, description will be given to an example of an upper thread reeling mechanism to be used for supplying an upper thread as a lower thread to be supplied to a bobbin.

During the sewing operation and the thread winding operation in which the upper thread US is supplied as the lower thread DS to be supplied to the bobbin 22, an upper thread reeling mechanism 120 according to the embodiment serves to apply a proper upper thread tension to the upper thread US reeled from an upper thread piece 121, to hold the upper thread US in a proper timing at time of thread take-up thread fastening by a well-known thread take-up mechanism which is not shown after reeling the upper thread US required for forming a stitch during the sewing operation, to hold the upper thread US in a proper timing at time of the thread take-up thread fastening by the well-known thread take-up mechanism which is not shown after reeling the upper thread US required for engaging the upper thread US with the thread catching and holding member 48 during the thread winding operation, and to release the held upper thread US in a proper timing at time of the start of the thread winding operation for winding the upper thread US to be the lower thread DS supplied to the bobbin 22 during the thread winding operation.

As shown in FIG. 11, the upper thread reeling mechanism 120 has a driving roller 124 supported rotatably by a driving roller support shaft 123 erected on the upper surface of an attachment plate 122. The upper thread US reeled from the upper thread piece 121 supported rotatably on an upper thread rod which is not shown through an upper thread tension applying device 119 abuts to be wound upon a part of the outer peripheral surface of the driving roller 124. A driven gear 127 is coaxially formed on the lower end of the driving roller 124. The driven gear 127 is engaged with a driving gear 126 fixed to the tip portion of an output shaft 125*a* which is protruded upward from the attachment plate 122 in a driving motor 125 attached to the lower surface of the attachment plate 122. As a result, the driving roller 124 can be rotated by the rotation of the driving motor 125.

A pair of driven rollers 128 are provided on the outer peripheral surface of the driving roller 124 in parallel at a certain interval. The driven rollers 128 separate from or approach the outer peripheral surface of the driving roller 124 through the upper thread US wounded in abutment on a part of the outer peripheral surface of the driving roller 124. Each of the driven rollers 128 is rotatably supported on a driven roller support shaft 130 erected on the upper surface of a moving plate 129 provided above the attachment plate 122. The moving plate 129 is provided with a slot 131 penetrating in a thickness direction in which the driving roller 124 can be fitted, and the slot 131 is externally fitted over the outer peripheral surface of the driving roller 124 so that the lower surface of the moving plate 129 is supported on the upper surface of the driven gear 127. Moreover, one end shown in the lower part of FIG. 11 in a moving plate driving link 133 supported rotatably by a link support pin 132 formed like an almost bell crank and having an almost central part in a longitudinal direction erected on the upper surface of the attachment plate 122 is rotatably attached with a connecting pin 134 in the vicinity of the left end of the moving plate 129 shown in the left part of FIG. 11. By the rotating operation of the moving plate driving link 133 around the link support pin 132, the moving plate 129 advances or retreats in such a state that a moving locus is regulated by the slot 131 fitted externally over the outer peripheral surface of the driving roller 124. As a result, each of the driven rollers 128 is caused to separate from or approach the outer peripheral surface of the driving roller 124 through the upper thread US. Furthermore, one of the ends of an energizing spring 135 is engaged in the vicinity of the other end of the moving plate driving link 133 shown in the upper part of FIG. 11, and the energizing force of the energizing spring 135 always energizes the moving plate driving link 133 around the link support pin 132 in a counterclockwise direction to cause the moving plate 129 to advance rightward in FIG. 11, thereby causing each of the driven rollers 128 to abut on the driving roller 124 by predetermined abutment force. As a result, a predetermined upper thread tension can be applied to the upper thread US. Moreover, the driving motor 125 is electrically connected to the control portion 93 which will be described below as shown in a broken line of FIG. 11, and rotates the driving roller 124 in a predetermined timing based on a control instruction sent from the control portion 93, thereby reeling the upper thread US in a set amount.

More specifically, each of the driven rollers 128 is caused to abut on the driving roller 124 without rotating the driving motor 125, thereby bringing a holding state in which the upper thread US is held. By rotating the driving motor 125 in the holding state, the upper thread US can be reeled in a set amount with a predetermined upper thread tension applied.

One of the ends of a driving rod 137 is engaged in the vicinity of the other end of the moving plate driving link 133 shown in the upper part of FIG. 11. The other end of the driving rod 137 is attached to an output shaft 136*a* of a solenoid 136 attached to a support stay (not shown) which can freely advance or retreat. The output shaft 136*a* of the solenoid 136 is placed in such an advance position as to hold a state in which each of the driven rollers 128 always abuts on the driving roller 124 by the energizing force of the energizing spring 135 to apply a predetermined upper thread tension to the upper thread US. As shown in a broken line of FIG. 11, the solenoid 136 is electrically connected to the control portion 93 which will be described below. The output shaft 136*a* of the solenoid 136 is moved from the advance position to a retreat position in a predetermined timing based on the control instruction sent from the control portion 93 so that the energizing spring 135 is extended to separate the driven roller 128 from the driving roller 124. Consequently, the upper thread US set in the holding state can be released.

The solenoid 136 and the driving rod 137 constitute thread loosening means 138 for releasing, in a proper timing, the upper thread US held at time of the start of the thread winding operation according to the embodiment for winding the upper thread US to be the lower thread DS supplied to the bobbin 22 during the thread winding operation.

Moreover, a proper tension is applied to the lower thread DS by means of the upper thread tension applying device 119 between the upper thread piece 121 and the upper thread reeling mechanism 120 and the violent motion of the thread can be eliminated when the thread is moved from the upper thread piece 121 into the upper thread reeling mechanism 120. Moreover, a tension required for thread winding is applied.

Next, an example of an upper shaft clutch mechanism 410 will be described with reference to FIGS. 49 to 52.

Figure 49:
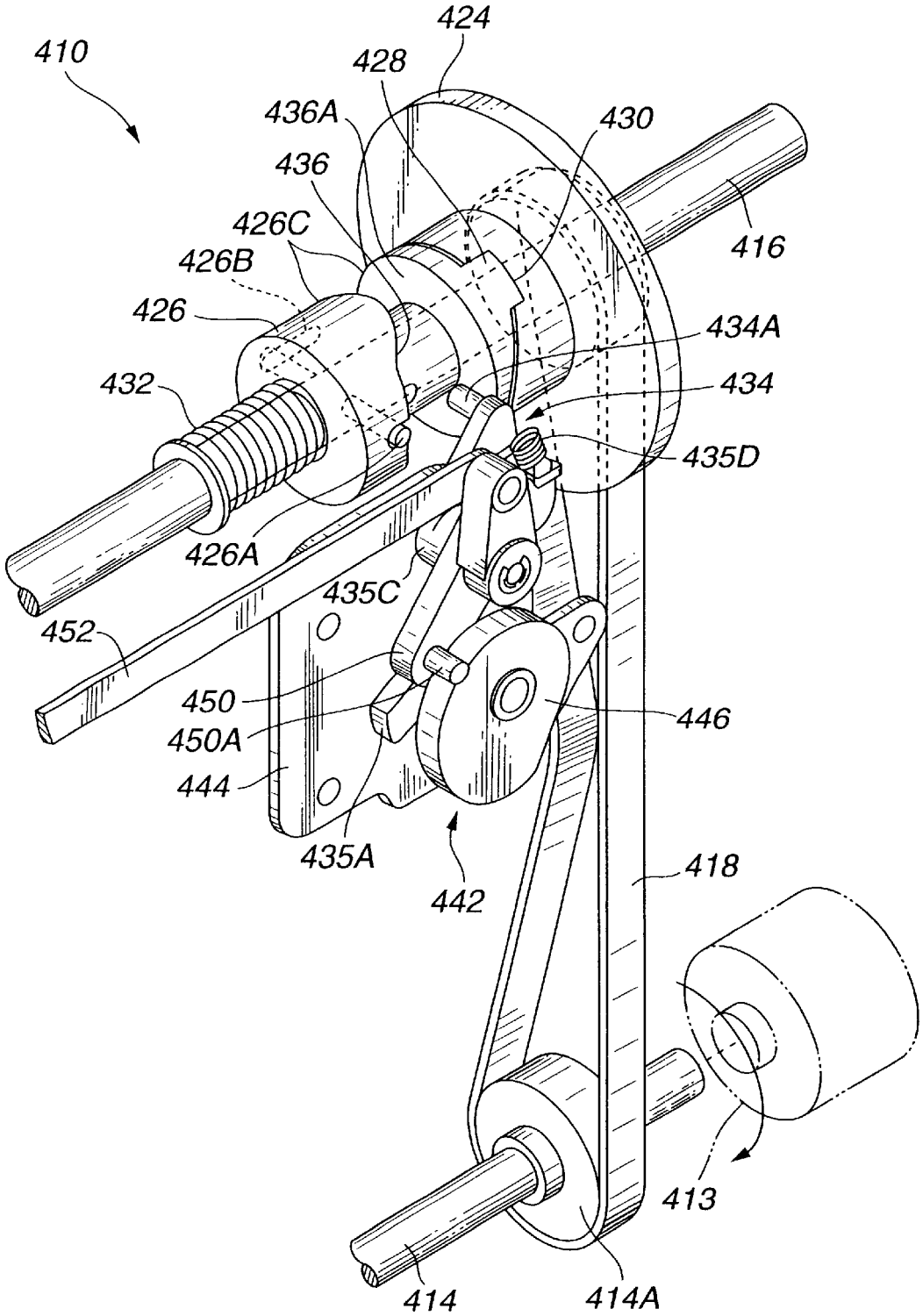
FIG. 49 is a perspective view showing an upper shaft clutch mechanism according to an example of the embodiment of the invention.
Figure 50:
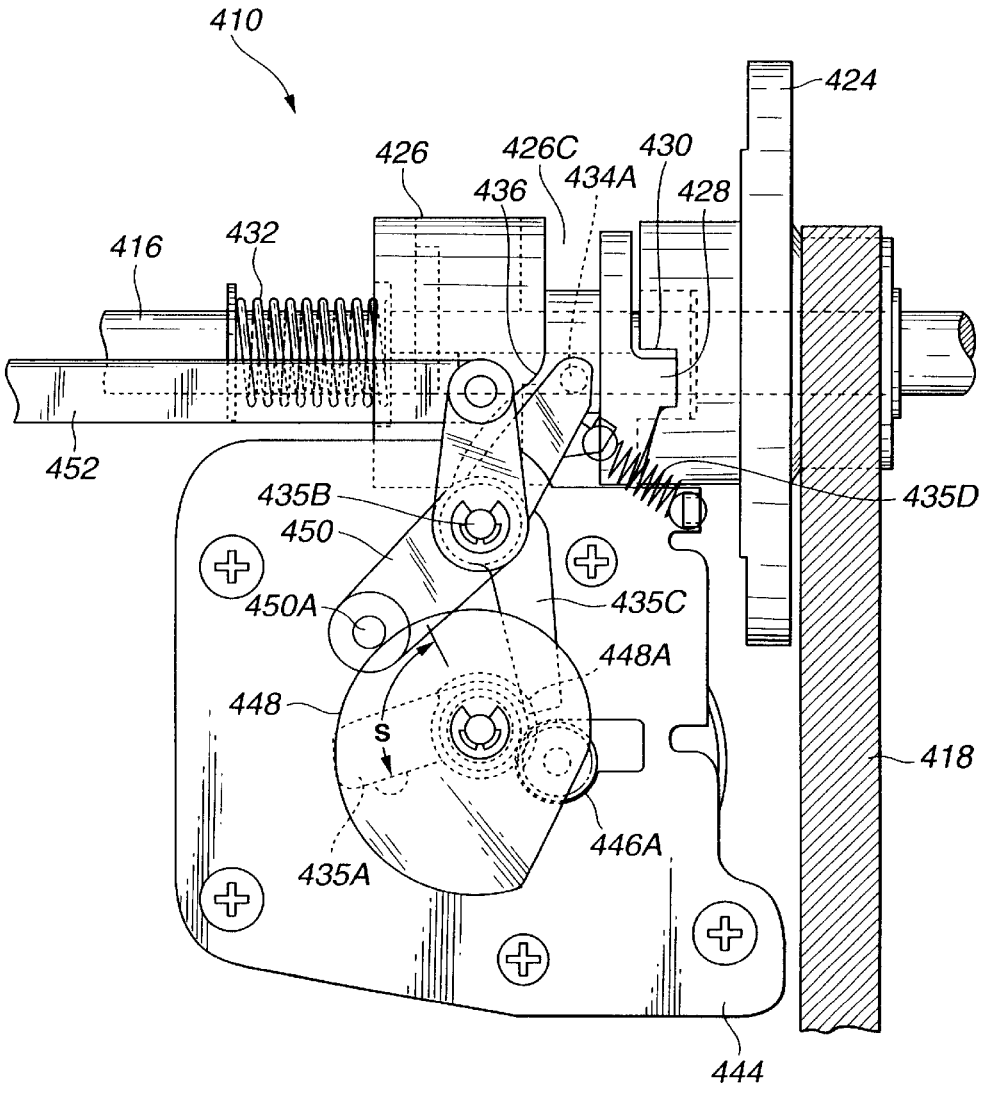
FIG. 50 is a side view showing an upper shaft clutch mechanism and a needle oscillation driving mechanism during the sewing operation.
Figure 51:
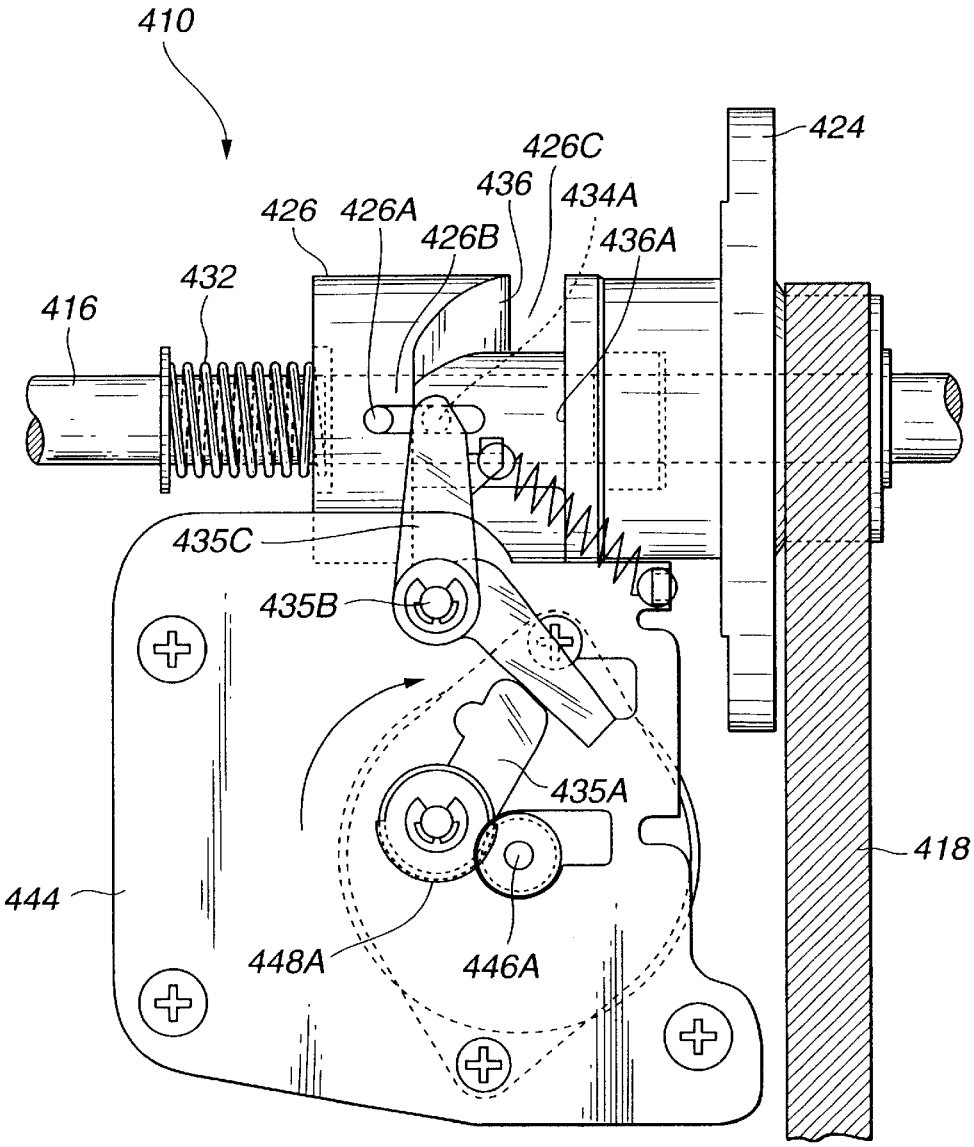
FIG. 51 is a side view showing a state in which a stepping motor is driven in order to separate an upper shaft clutch, thereby disconnecting a needle bar and a thread take-up.
Figure 52:
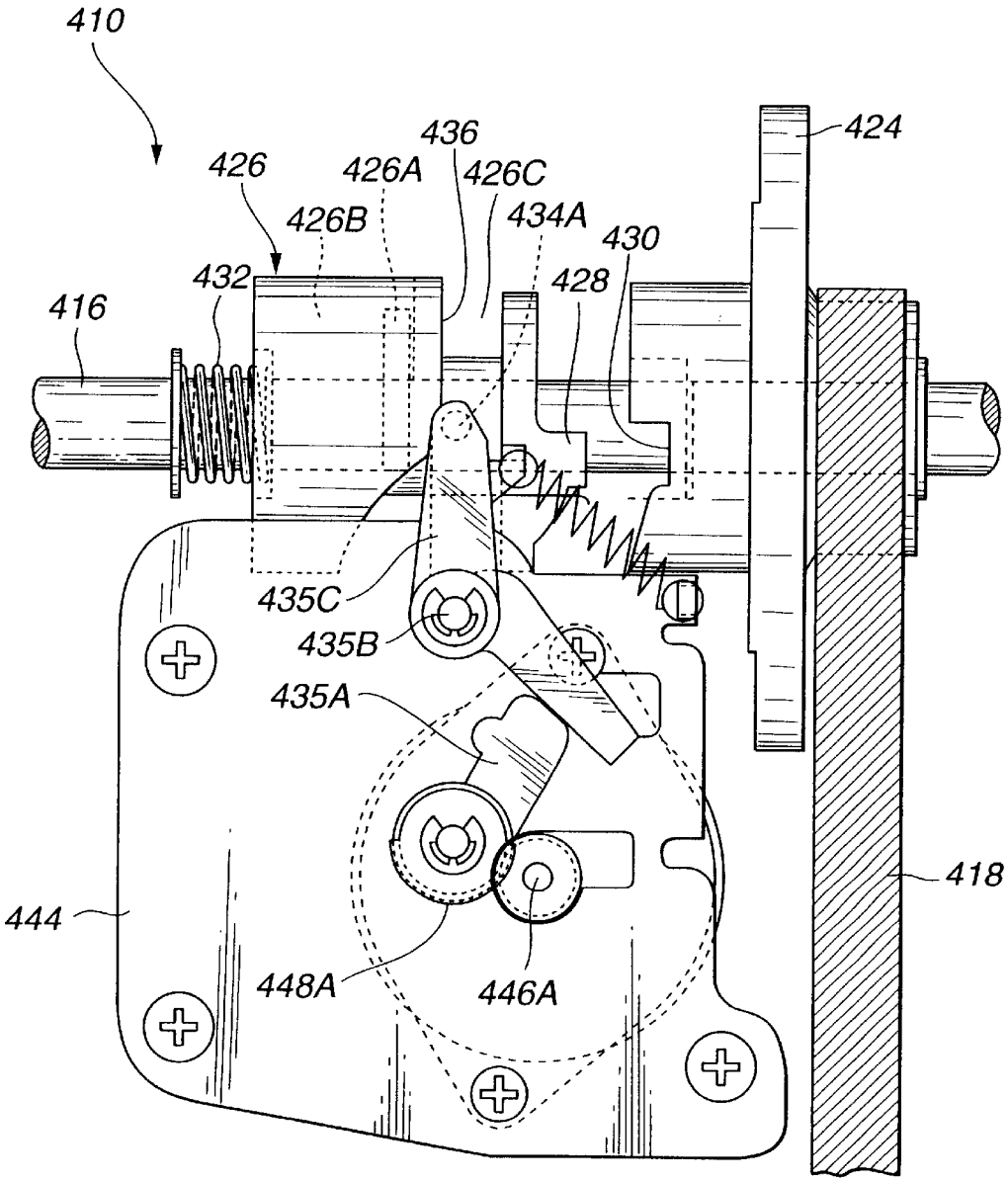
FIG. 52 is a side view showing a state in which the upper shaft clutch mechanism is separated to stop an upper shaft in an upper position.

FIG. 49 is a perspective view showing an upper shaft clutch mechanism according to an example of the embodiment of the invention, FIG. 50 is a side view showing the upper shaft clutch mechanism and a needle oscillation driving mechanism during a sewing operation, FIG. 51 is a side view showing the upper shaft clutch mechanism in a state in which a stepping motor is driven to separate an upper shaft clutch, thereby removing a needle bar and a thread take-up, and FIG. 52 is a side view showing the upper shaft clutch mechanism in a state in which the upper shaft clutch mechanism is separated to stop an upper shaft in an upper position.

As shown in FIG. 49, a sewing machine frame (not shown) to which the upper shaft clutch mechanism 410 according to the invention is applied has such a structure as to drive a cloth feed dog 438 and a lower shaft 414 for operating the holder 4 by the sewing machine motor 413 (see FIG. 12), to transmit a rotation from the lower shaft 414 to the upper shaft 416 through the belt 418 and to drive the needle bar 2 (see FIG. 12) to which the needle 3 is attached and the thread take-up 422 through the rotation of the upper shaft 416.

The upper shaft clutch mechanism 410 includes an upper shaft pulley 424 which is supported on the upper shaft 416 coaxially and relatively rotatably and rotated by the lower shaft 414 through the belt 418, an upper shaft separating cam 426 supported on the upper shaft 416 so as not to be relatively rotated and to be slideable in an axial direction to separate from or approach the upper shaft pulley 424, and a cam side engaging portion 428 and a pulley side engaging portion 430 which are formed on the opposed end faces of the upper shaft separating cam 426 and the upper shaft pulley 424, and can be engaged in a rotating direction when they approach at a constant relative rotating angle and are not engaged when they separate from each other in the axial direction. When the upper shaft separating cam 426 integral with the upper shaft 416 and the cam side engaging portion 428 to be a part thereof are engaged with or separate from the upper shaft pulley 424 and the pulley side engaging portion 430 to be a part thereof which are always rotated through the belt 418, the rotation of the lower shaft 414 is transmitted to the upper shaft 416 or blocked.

The upper shaft separating cam 426 has the cam side engaging portion 428 on the upper shaft pulley 424 side as described above and is energized in the direction of the upper shaft pulley 424 through a compression coiled spring 432.

The upper shaft separating cam 426 can be driven by an actuator 434 over the upper shaft 416 in an axial direction between a position in which the cam side engaging portion 428 is engaged with the pulley side engaging portion 430 and a position in which they are not engaged with each other.

The pulley side engaging portion 430 takes the shape of a straight groove which is almost orthogonal to the upper shaft 416 and the cam side engaging portion 48 is a straight convex portion to be fitted in the pulley side engaging portion 430 taking the shape of a straight groove and can be fitted (engaged) when both of them are coincident with each other in the direction of the rotation of the upper shaft 416.

The reference numeral 426A in FIG. 49 denotes a pin provided on the upper shaft 416 in a radial direction. When the pin 426A slides in a slot 426B formed on the upper shaft separating cam 426 in parallel with the upper shaft 416, the upper shaft separating cam 426 can be reciprocated in the axial direction in engagement with the upper shaft 416 in the radial direction.

A groove 426C in a circumferential direction in which a contact member 434A of the actuator 434 is to be inserted is formed in a middle position in the axial direction of the upper shaft separating cam 426.

The end face of the groove 426C on the upper shaft pulley 424 side acts as a flat surface 436A orthogonal to the upper shaft 416 and furthermore, an end face on the compression coiled spring 432 side opposed thereto acts as an inclined cam face 436 in which a protrusion height in the direction of the upper shaft pulley 424 is changed corresponding to the rotating angle of the upper shaft 416 as shown in FIG. 49.

The actuator 434 shown in FIG. 49 is caused to selectively drive the contact member 434A into two positions including an engagement position in which the contact member 434A is in the groove 426C in no contact with the inclined cam face 436 and the cam side engaging portion 428 is engaged with the pulley side engaging portion 430 and a non-engagement position in which the contact member 434A is moved toward the inclined cam face 436 side and the cam side engaging portion 428 is disengaged from the pulley side engaging portion 430 in contact therewith.

The protrusion height of the inclined cam face 436 in the direction of the upper shaft pulley 424, that is, a cam lift is set such that the inclined cam face 436 comes in contact with the contact member 434A driven into the non-engagement position with the rotation of the upper shaft 416 and is moved in such a direction as to press the compression coiled spring 432 and the cam side engaging portion 428 is disengaged from the pulley side engaging portion 430 and the upper shaft separating cam 426 is separated from the upper shaft pulley 424 when the contact member 434A is placed in the maximum lift position of the inclined cam face 436.

The position of the maximum lift portion of the inclined cam face 436 in the direction of the rotation of the upper shaft 416 is set such that the cam side engaging portion 428 is disengaged from the pulley side engaging portion 430 in an angular position in the rotating direction corresponding to the upper dead point position of the needle bar 2.

Accordingly, the contact member 434A is driven to such a position as to come in contact with the inclined cam face 436, that is, the non-engagement position, the inclined cam face 436 comes in contact with the contact member 434A in the non-engagement position by the rotation of the upper shaft 416. Consequently, a movement is carried out in such a direction as to compress the compression coiled spring 432 so that the needle bar 2 is always set in the upper dead point position when the cam side engaging portion 428 is disengaged from the pulley side engaging portion 430.

Next, a needle oscillation driving mechanism 442 will be described.

The needle oscillation driving mechanism 442 serves to drive a needle oscillating mechanism 440 (see FIG. 12) for reciprocating the needle bar 2 in a direction crossing the cloth feeding direction of the cloth feed dog 438.

The needle oscillation driving mechanism 442 includes an STM attachment plate 444 fixed to the upper part of the sewing machine (not shown), a needle oscillation STM 446 attached to the STM attachment plate 444 and serving to output rocking force to a central toothed wheel 446A (see FIG. 50), a needle oscillation cam 448 having a link gear 448A to be engaged with the toothed wheel 446A and rocked by the toothed wheel 446A through the link gear 448A, and a needle oscillation link 450 having a needle oscillation contact shaft 450A on one end and rocked by the contact of the needle oscillation contact shaft 450A with the outer periphery of the needle oscillation cam 448 corresponding to a cam lift amount in the vicinity of the lower side of the upper shaft separating cam 426, and is constituted such that when the needle oscillation link 450 is rocked around a shaft 435B by the reciprocation of the toothed wheel 446A, the rocking motion is transmitted to the needle oscillating mechanism 440 through a rocking rod 452.

In the example of the embodiment, the actuator 434 is constituted by an operating link 435A attached to the link gear 448A of the needle oscillation cam 448 to be rocked integrally therewith, a rocked link 435C pressed and rocked in a counterclockwise direction around the rocking shaft 435B in FIG. 50 when the operating link 435A is rocked and led beyond a normal needle oscillation rocking angle range S (see FIG. 50) together with the link gear 448A, the contact member 434A attached to the tip of the rocked link 435C on the opposite side of the operating link 435A to be protruded into the groove 426C of the upper shaft separating cam 426, and a spring 435D for energizing the rocked link 435C in a clockwise direction in the drawing.

In FIG. 12, the reference numeral 456 denotes a thread take-up crank for converting the rotation of the upper shaft 416 into the rocking motion of the thread take-up 422, and the reference numeral 458 denotes a needle bar crank for transmitting the rocking motion to a needle bar holder 460 provided on the upper end of the needle bar 2 interlockingly with the thread take-up crank 456. The other end of the rocking rod 452 is connected to the upper end of the needle bar 2.

Next, the function of the upper shaft clutch mechanism 410 will be described.

During a normal sewing operation in which the upper shaft 416 is not separated from the sewing machine motor 413, the rotation of the sewing machine motor 413 is transmitted to the upper shaft 416 through the lower shaft 414, the belt 418, the upper shaft pulley 424 and the upper shaft separating cam 426 engaged therewith.

At this time, the needle oscillation STM 446 rocks the link gear 448A through the toothed gear 446A within the needle oscillation rocking angle range S in FIG. 50. Consequently, even if the needle oscillation contact shaft 450A is rocked in conformity with the rocking motion of the needle oscillation cam 448, the rocking motion is transmitted to only the needle oscillating mechanism 440 through the rocking rod 452 and the actuator 434 is not driven.

In the case in which the upper shaft clutch mechanism 410 is to be operated, the needle oscillation STM 446 is operated and the link gear 448A is rocked by the toothed wheel 446A in the clockwise direction in FIG. 50 beyond the needle oscillation rocking angle range S.

Consequently, the operating link 435A connected to the link gear 448A is greatly rocked in the clockwise direction so that the rocked link 435C is rocked in the counterclockwise direction around the rocking shaft 435B.

Accordingly, the contact member 434A provided on the tip of the rocked link 435C is driven in the groove 426C of the upper shaft separating cam 426 to the non-engagement position leftwards in the drawing.

In the case in which the contact member 434A is moved to the left in the drawing and does not come in contact with the inclined cam face 436 as shown in FIG. 51, the inclined cam face 436 is being rotated together with the upper shaft 416 and the upper shaft separating cam 426 is thereby driven leftwards in the drawing against the energizing force of the compression coiled spring 432 through the contact member 434A when the lift portion of the inclined cam face 436 comes to the position of the contact member 434A and the cam side engaging portion 428 is disengaged from the pulley side engaging portion 430 as shown in FIG. 52.

Accordingly, the upper shaft pulley 424 is raced and the rotation is not transmitted to the upper shaft 416 through the upper shaft separating cam 426.

When the contact member 434A is moved leftwards and immediately comes in contact with the lift portion of the inclined cam face 436, the inclined cam face 436 is exactly pushed leftwards in the drawing against the energizing force of the compression coiled spring 432 to disengage the cam side engaging portion 428 from the pulley side engaging portion 430.

Since the needle bar 2 and the thread take-up 422 are interlocked with the upper shaft 416 as shown in FIG. 12, the upper shaft 416 is stopped so that the motions of the needle bar 2 and the thread take-up 422 are stopped.

At this time, the upper shaft pulley 424 is rotated by the belt 418 in a separation state from the upper shaft 416. For this reason, the lower shaft 414 is not stopped. More specifically, it is possible to stop the vertical motion of the needle bar 2 and the movement of the thread take-up 422 in the state of rotation of the lower shaft 414.

In the case in which the upper shaft clutch mechanism 410 is to be returned to a connecting position, the needle oscillation STM 446 is driven to return the link gear 448A in the counterclockwise direction in FIG. 50 within the normal needle oscillation rocking angle range by means of the toothed wheel 446A. Thus, the operating link 435A is separated from the rocked link 435C. Consequently, the rocked link 435C is returned in the clockwise direction in FIG. 50 by the tensile force of the spring 435D and the contact member 434A provided on the tip of the actuator 434 is moved in the groove 426C in the direction of the upper shaft pulley 424.

Accordingly, the contact member 434A is separated from the inclined cam face 436 so that the upper shaft separating cam 426 is moved rightwards in FIG. 50 by the restoring force of the compression coiled spring 432. Then, the sewing machine motor 413 is driven so that the upper shaft pulley 424 is rotated. When the positions in the directions of rotation of the cam side engaging portion 428 and the pulley side engaging portion 430 are coincident with each other, both of them are engaged and the upper shaft 416 is rotated so that a normal sewing state is returned.

Thus, the motions of the needle bar 2 and the thread take-up 422 can be stopped during automatic lower thread winding, the tensions of the upper and lower threads can be stabilized, the upper thread can be prevented from slipping off and the violence sound of the bobbin in the thread winding can be reduced.

Next, an example of thread winding diameter detecting means will be described with reference to FIGS. 13 and 14.

Thread winding diameter detecting means 160 according to the embodiment serves to detect the maximum thread winding diameter of the lower thread DS to be wounded upon the bobbin 22.

Figure 13:
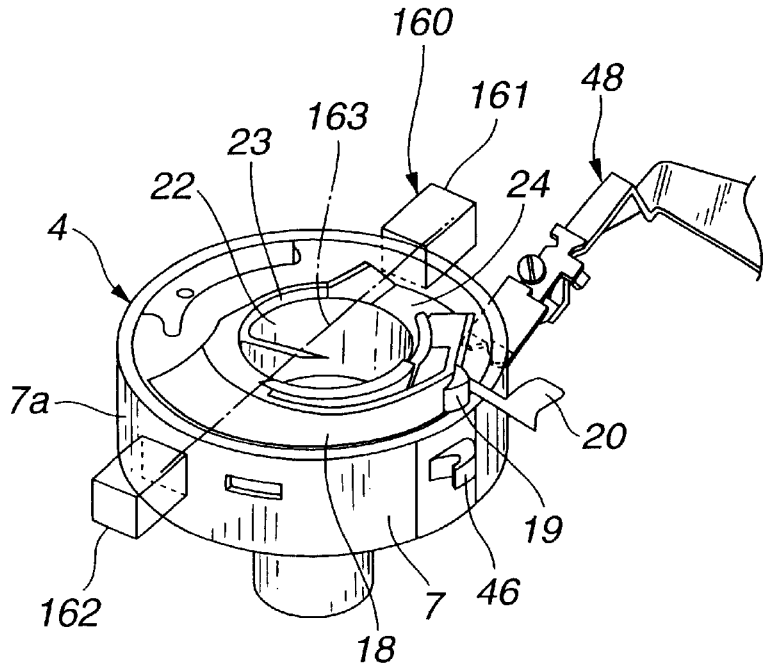
FIG. 13 is a perspective view showing the structure of a main part according to an example of thread winding diameter detecting means.
Figure 14:
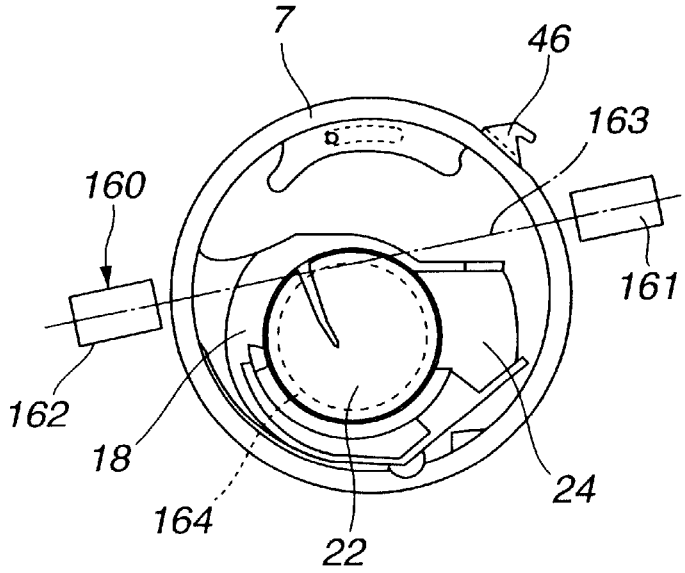
FIG. 14 is a plan view showing a state in FIG. 13.

As shown in FIGS. 13 and 14, the thread winding diameter detecting means 160 according to the embodiment has a light emitting element 161 and a right receiving element 162 which are provided in the vicinity of the upper end of the large diameter portion 7*a* of the outer holder 7 to be opposed to each other. An optical path 163 reaching the light receiving element 162 from the light emitting element 161 is positioned above the outer holder 7 and can detect a maximum thread winding diameter 164 of the lower thread DS shown in a broken line of FIG. 14 between the upper flange 37 and the lower flange 38 in the bobbin 22. Furthermore, the inner holder 18 is provided with an optical path hole coincident with the optical path 163 which is not shown in such a state that the inner holder 18 abuts on the inner holder detent 20, and the outer peripheral surface of the large diameter portion 7*a* of the outer holder 7 is provided with an optical path through hole coincident with the optical path 163 in a specific phase which is not shown.

The specific phase implies that the optical path hole formed on the inner holder 18 which is not shown and the optical path through hole formed on the outer peripheral surface of the large diameter portion 7*a* of the outer holder 7 which is not shown are rectilinearly coincident with the optical path 163. In other words, the optical path 163 is opened only in a specific phase section. The light receiving element 162 is turned ON in the specific phase section until the diameter of the thread wound upon the bobbin 22 blocks the optical path 163. When the thread is wound and the thread diameter blocks the optical path 163, the light receiving element is turned OFF. Since the optical path 163 is provided in the maximum position of the thread diameter, the maximum thread winding diameter 164 can be detected with a change in the signal of the light receiving element 162.

Next, an example of the operating portion will be described with reference to FIG. 15.

Figure 15:
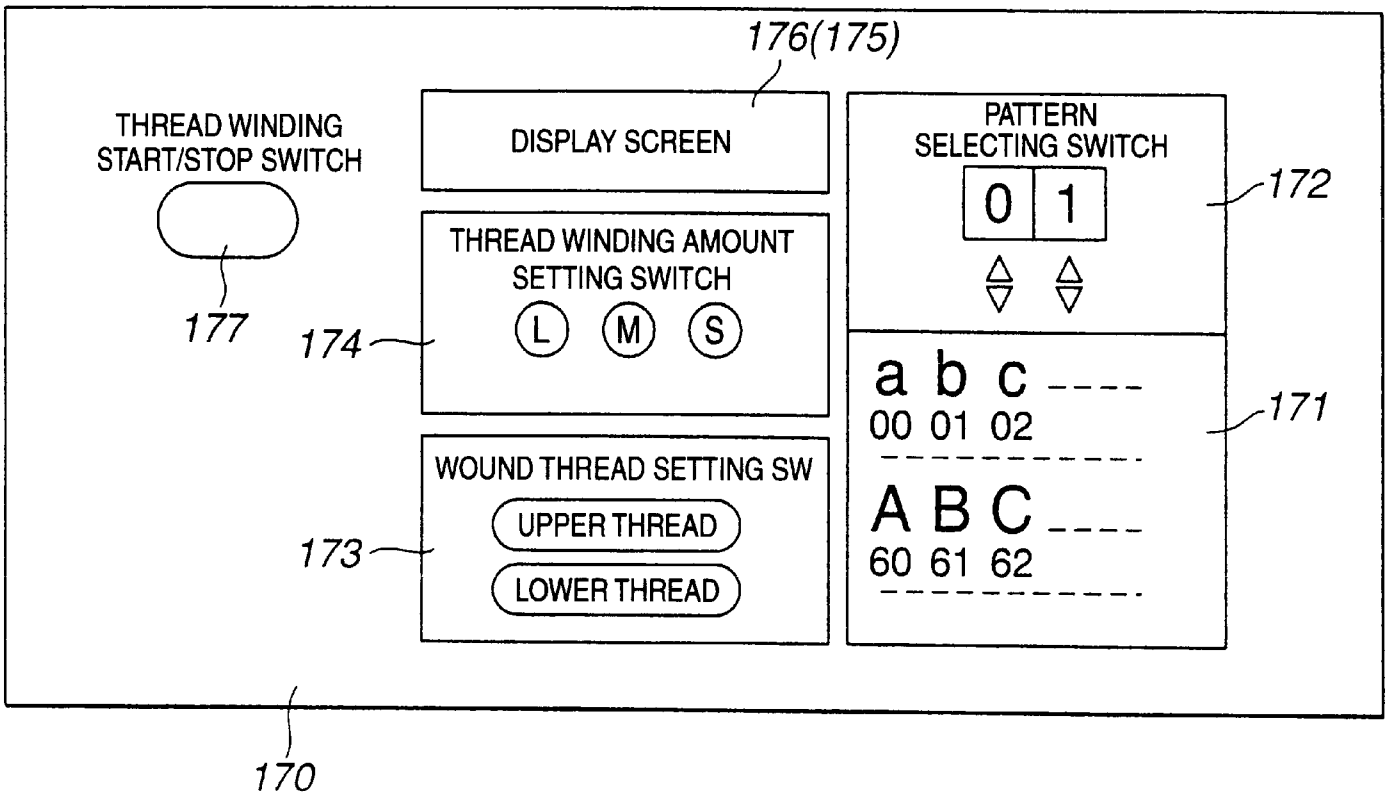
FIG. 15 is a view showing the structure of a main part according to an example of an operating portion.

An operating portion 170 according to the embodiment is provided in a desirable position such as a sewing machine frame which is not shown, and a pattern display screen 171 for displaying, in a simple pattern and number, a plurality of sewing data stored in the control portion 93 which will be described below is provided in the lower right part of FIG. 15 as shown in FIG. 15, and a pattern selecting switch 172 to be pattern selecting means for selecting a desirable one of the pattern sewing data by selecting the number of a pattern displayed on the pattern display screen 171 is provided on the pattern display screen 171. A wound thread setting switch 173 to be winding thread selecting means for selecting the supplied thread EDS or the upper thread US as the lower thread DS to be supplied to the bobbin 22 during the thread winding operation is provided on the left of the pattern display screen 171, and a thread winding amount setting switch 174 to be thread winding amount setting means for setting the thread winding amount of the lower thread DS to be wound upon the bobbin 22 during the thread winding operation in three stages of "large", "middle" and "small" is provided above the wound thread setting switch 173. Furthermore, a display screen 176 also serving as alarm means 175 for displaying various messages and setting states is provided above the thread winding amount setting switch 174, and a thread winding start/stop switch 177 for controlling ON/OFF of the thread winding operation is provided on the left thereof. The pattern display screen 171, the pattern selecting switch 172, the wound thread setting switch 173, the thread winding amount setting switch 174, the display screen 176 also serving as the alarm means 175, and the thread winding start/stop switch 177 are electrically connected to the control portion 93 which will be described below.

Referring to the structure of the operating portion 170, only a portion related to the thread winding operation has been described. As a matter of course, the operating portion 170 is also provided with various known switches and display screens (not shown) related to the sewing operation.

Moreover, in the case in which only the supplied thread EDS or the upper thread US is used as the lower thread DS to be supplied to the bobbin 22 during the thread winding operation, it is not necessary to provide the wound thread setting switch 173.

Next, an example of thread hold detecting means will be described with reference to FIGS. 10 and 16 to 18.

Figure 16:
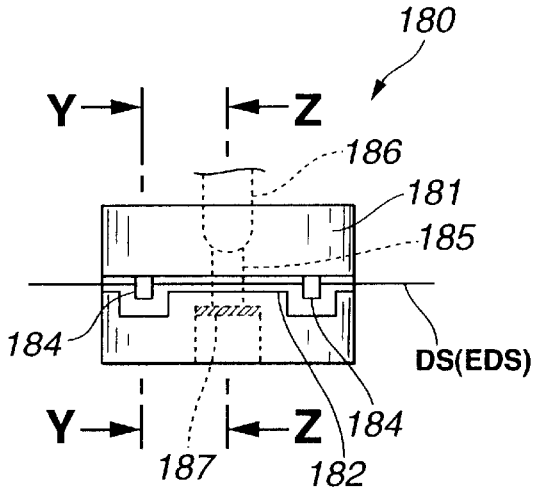
FIG. 16 is a front view showing the structure of a main part according to an example of thread hold detecting means.
Figure 17:
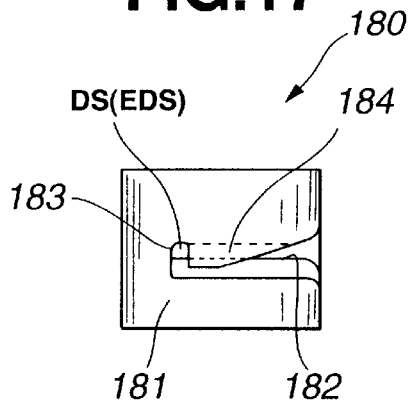
FIG. 17 is a sectional side view taken along a line Y—Y in FIG. 16.
Figure 18:
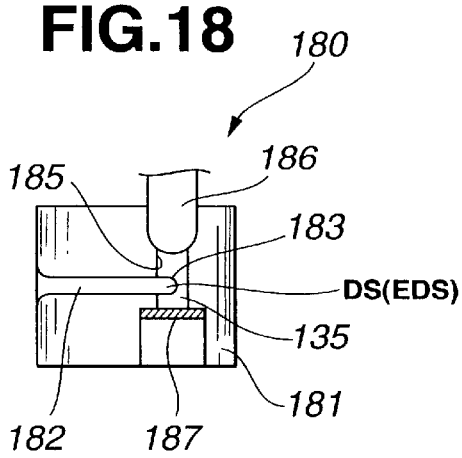
FIG. 18 is a sectional side view taken along a line Z—Z in FIG. 16.

As shown in FIG. 10, thread hold detecting means 180 according to the embodiment is provided between the thread catching and holding member 48 and the special lower thread reeling mechanism 110. The thread hold detecting means 180 has a body 181 formed to take an almost oblong shape as shown in FIGS. 16 to 18 and the body 181 is provided with a thread groove 182 which is concaved along the thread path of the supplied thread EDS. The thread groove 182 is provided with a pair of left and right guide ribs 184 taking the shape of an almost triangular plate at an interval. The guide ribs 184 serve to guide the supplied thread EDS passing in the thread groove 182 to the thread groove bottom portion 183 (FIGS. 17 and 18). A through hole 185 (FIGS. 16 and 18) penetrating in a vertical direction orthogonally to the supplied thread EDS passing the proximity of the thread groove bottom portion 182 is formed in a central part in a longitudinal direction of the body 181 transversely in FIG. 16 and a light emitting element 186 is provided above the through hole 185. Moreover, a light receiving element 187 is provided under the through hole 185. The light emitting element 186 and the light receiving element 187 are electrically connected to the control portion 93 which will be described below. Thus, detection data indicative of the presence of the supplied thread EDS passing through the proximity of the thread groove bottom portion 182 can be sent to the control portion 93.

Next, an example of the control portion will be described with reference to FIG. 19.

Figure 19:
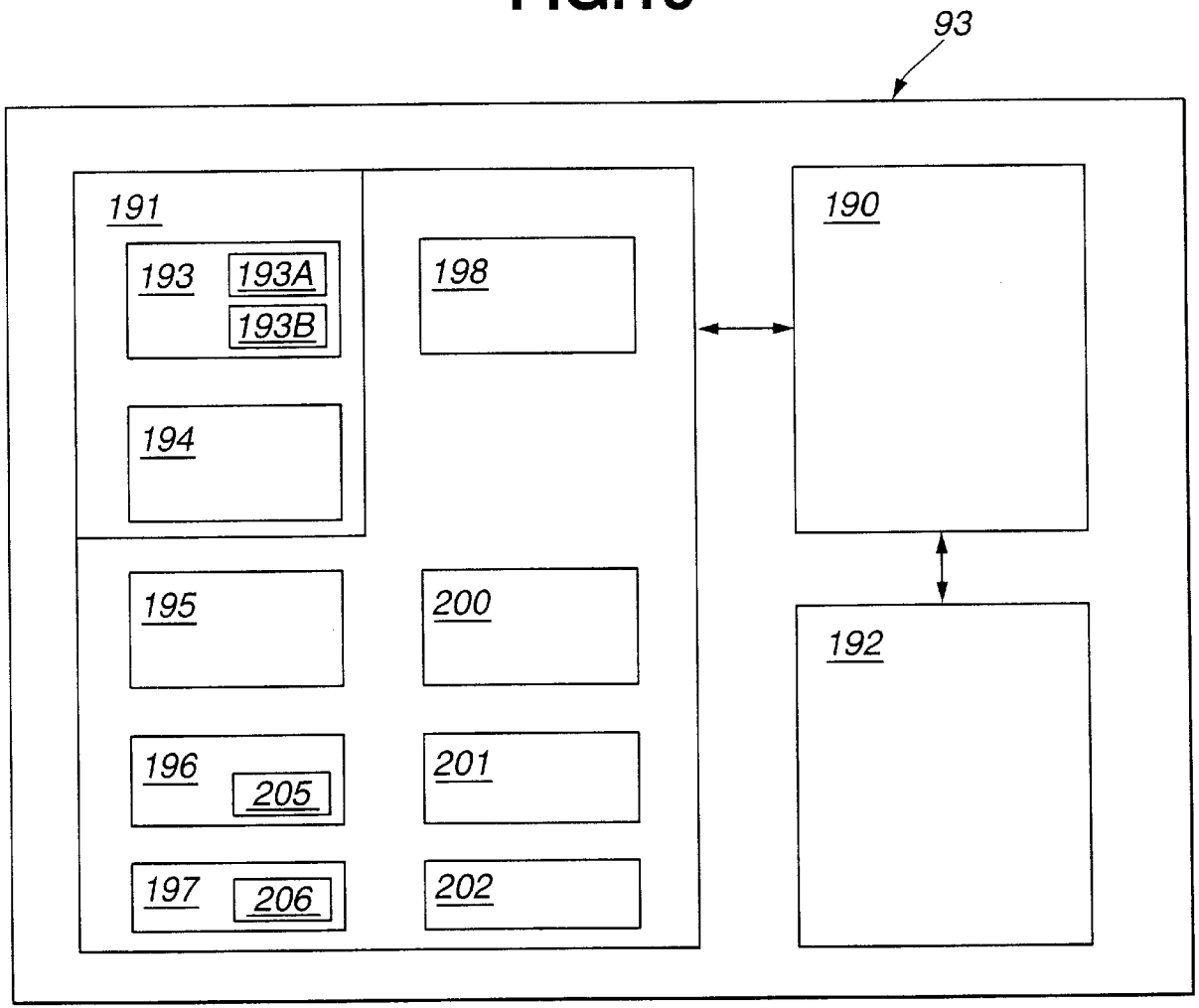
FIG. 19 is a block diagram showing an example of the structure of a control portion.

As shown in FIG. 19, the control portion 93 has at least a CPU 190, a memory 191 formed by an ROM or RAM having a proper capacity, and a controller 192 for driving each portion of a sewing machine.

The memory 191 has at least a thread winding operation control portion 193, a lower thread reholding operation control portion 194, an upper thread control portion 195, a lower thread tension applying portion 196, a thread winding amount control portion 197, a critical thread winding number setting portion 198, a sewing data storage portion 200, an automatic setting portion 201 and an erroneous winding operation preventing portion 202.

The thread winding operation control portion 193 has a first thread winding operation control portion 193A and a second thread winding operation control portion 193B.

The first thread winding operation control portion 193A stores a program for operating the upper shaft clutch mechanism 410, the horizontal holder 4, the first moving means 94 and the thread catching and holding member moving means 48 to cause the supplied thread EDS connected between the thread holding portion 59 and the thread position regulating portion 58 to enter the slit 39 and to wind the supplied thread EDS upon the bobbin 22 when selecting the supplied thread EDS as the lower thread DS to be wound upon the bobbin 22 during the thread winding operation. As a specific example of the program, it is preferable to employ a structure in which the upper shaft clutch mechanism 410, the horizontal holder 4, the first moving means 94 and the thread catching and holding member moving means 53 are operated in such a manner that the upper shaft clutch mechanism 410 is operated to separate the upper shaft 416 from the lower shaft 414 and the upper shaft pulley 424 which are driven by the sewing machine motor 413, thereby stopping the reciprocating motions in a vertical direction of the needle 3 and the thread take-up 422 which are driven by the upper shaft 416 and holding the needle 3 in an upper position, and the thread catching and holding member 48 is then set in an entry position to cause the supplied thread EDS connected between the thread holding portion 59 and the thread position regulating portion 58 to abut on at least the outer peripheral edge of the upper flange 37 of the bobbin 22 and the bobbin driving member 11 is thereafter set in a connecting position and the outer holder 7 is subsequently rotated to cause the supplied thread EDS connected between the thread holding portion 59 and the thread position regulating portion 58 to enter the slit 39, thereby winding the supplied thread EDS upon the bobbin 22.

The program of the first thread winding operation control portion 193A is not restricted to the specific example. Depending on the necessity for a design concept, it is preferable to determine the order of a timing in which the upper shaft 416 for driving the needle bar 2 and the thread take-up 422 is separated from the lower shaft 414 and the upper shaft pulley 424 which are driven by the sewing machine motor 413 and the needle 3 is thereby held in an upper position in relation to the upper shaft 416, a timing in which the thread catching and holding member 48 is set in the entry position, a timing in which the bobbin driving member 11 is set in the connecting position and a timing in which the outer holder 7 is rotated.

The second thread winding operation control portion 193B stores a program for operating the upper shaft clutch mechanism 410, the horizontal holder 4, the first moving means 94 and the thread catching and holding member moving means 53 in such a manner that the sewing machine is driven to vertically move the needle 3, to divide the loop of the upper thread US in the upper and lower parts of the inner holder 18 by means of the blade tip 42 of the outer holder 7 and to rotate the same loop when selecting the upper thread US as the lower thread DS to be wound upon the bobbin 22 during the thread winding operation, the upper thread US passing over the inner holder 18 is caught by the thread engaging portion 60 and the thread position regulating portion 58 in the thread catching and holding member 48, and the upper thread US connected between the thread engaging portion 60 and the thread position regulating portion 58 is caused to enter the slit 39 so that the upper thread US is wound as the lower thread DS upon the bobbin 22. As a specific example of the program, it is preferable to employ a structure in which the upper shaft clutch mechanism 410, the horizontal holder 4, the first moving means 94 and the thread catching and holding member moving means 53 are operated in such a manner that the thread catching and holding member 48 is set in the entry position and the sewing machine is then driven to cause the needle 3 to carry out one reciprocating motion in a vertical direction, to divide the loop of the upper thread US into the upper and lower parts of the inner holder 18 by means of the blade tip 42 of the outer holder 7 and to rotate the same loop when the upper thread US is selected as the lower thread DS to be wound upon the bobbin 22, the upper thread US passing over the inner holder 18 is caught by the thread engaging portion 60 and the thread position regulating portion 58 in the thread catching and holding member 48, the upper shaft 416 is thereafter separated from the rotation of the lower shaft 414 and the upper shaft pulley 424 which are driven by the sewing machine motor 413, thereby stopping the reciprocating motions in the vertical direction of the needle 3 and the thread take-up 422 which are driven by the upper shaft 416 and holding the needle 3 in an upper position, and the bobbin driving member 11 is subsequently set in the connecting position and the outer holder 7 is then rotated to cause the upper thread US connected between the thread engaging portion 60 and the thread position regulating portion 58 to enter the slit 39 so that the upper thread US is wound as the lower thread DS upon the bobbin 22.

The program of the second thread winding operation control portion 193B is not restricted to the specific example. Depending on the necessity for a design concept, it is preferable to determine the order of a timing in which the upper shaft 416 is separated from the lower shaft 414 and the upper shaft pulley 424 which are driven by the sewing machine motor 413 and the needle 3 to be driven by the upper shaft 416 is thereby held in an upper position, a timing in which the thread catching and holding member 48 is set in the entry position, a timing in which the bobbin driving member 11 is set in the connecting position and a timing in which the outer holder 7 is rotated. Moreover, in the case in which the supplied thread EDS or the upper thread US is used as the lower thread DS to be wound upon the bobbin 22, it is preferable that the first thread winding operation control portion 193A or the second thread winding operation control portion 193B should be provided as the thread winding operation control portion 193.

The lower thread reholding operation control portion 194 stores a program for operating the horizontal holder 4 and the thread catching and holding member moving means 53 in such a manner that the thread catching and holding member 48 is set in a thread catching position after the completion of the thread winding operation carried out when the supplied thread EDS is selected as the lower thread DS to be wound upon the bobbin 22 during the thread winding operation, the outer holder 7 is then rotated to move the supplied thread EDS positioned in the vicinity of the outer peripheral surface of the outer holder 7 in a separating direction from the outer holder 7, thereby holding the supplied thread EDS in the thread holding portion 59 of the thread catching and holding member 48, and the thread catching and holding member 48 is thereafter moved to the retreat position.

The upper thread control portion 195 stores a program for carrying out an operation in such a manner that the amount of the upper thread US reeled from the upper thread reeling device 120 is set to be a predetermined amount and the thread loosening means 138 releases the upper thread US when the bobbin 22 is to wind the upper thread US as the lower thread DS.

In the case in which only the supplied thread EDS is used as the lower thread DS to be wound upon the bobbin 22, a conventional known device is preferably used for the upper thread reeling device 120.

The lower thread tension applying portion 196 stores a program for operating the thread catching and holding member 48 and the outer holder 7 in such a manner that the thread connected to the bobbin 22 and positioned in the vicinity of the outer holder 7 is set into an upper thread catching position from the retreat position so as to be positioned below the upper surface of the outer peripheral surface of the outer holder 7 after the thread winding operation is ended, the thread connected to the bobbin 22 and positioned in the vicinity of the outer holder 7 can be caught by means of the thread catching hook 46, and the outer holder 7 is then rotated reversely to cause the thread connected to the bobbin 22 and positioned in the vicinity of the outer holder 7 to enter the thread introducing port 27. Moreover, the lower thread tension applying portion 196 according to the embodiment stores, as the outer holder reverse rotating mechanism 205, a program for reversely rotating the outer holder 7 by controlling the direction of the rotation of the sewing machine motor 413.

The thread winding amount control portion 197 stores a program for carrying out the thread winding operation until the thread winding diameter detecting means 160 detects a maximum thread winding diameter or thread winding number measuring means 206 which will be described below detects a critical thread winding number set by a critical thread winding number setting portion 198 if the thread winding amount of the lower thread DS is set to be a maximum set value (great) by the thread winding amount setting switch 174 to be thread winding amount setting means, and for carrying out the thread winding operation until the thread winding rotation number of the bobbin 22 is set corresponding to the thread winding amount set by the thread winding amount setting switch 174 and the thread winding number measuring means 206 detects the thread winding rotation number of the bobbin 22 which is set if the thread winding amount set by the thread winding amount setting switch 174 is smaller than the maximum set value.

Moreover, the thread winding amount control portion 197 according to the embodiment stores, as the thread winding number measuring means 206, a program for detecting the rotation number of the sewing machine motor 413 after the bobbin 22 starts the thread winding operation by means of an optical sensor and for comparing the rotation number of the sewing machine motor 413 with a prestored conversion table at this time, thereby detecting the thread winding rotation number of the bobbin 22.

In the case in which the thread winding amount control portion 197 does not use the critical thread winding number, it is preferable to store a program for carrying out the thread winding operation until the thread winding diameter detecting means 160 detects the maximum thread winding diameter 164 of the lower thread DS to be wound upon the bobbin 22 if the thread winding amount of the lower thread DS is set to be a maximum set value (great) by the thread winding amount setting switch 174 to be the thread winding amount setting means, and for carrying out the thread winding operation until the thread winding rotation number of the bobbin 22 is set corresponding to the thread winding amount set by the thread winding amount setting switch 174 and the thread winding number measuring means 206 which will be described below detects the set thread winding rotation number of the bobbin 22 which is set if the thread winding amount set by the thread winding amount setting switch 174 is smaller than the maximum set value.

Figure 20:
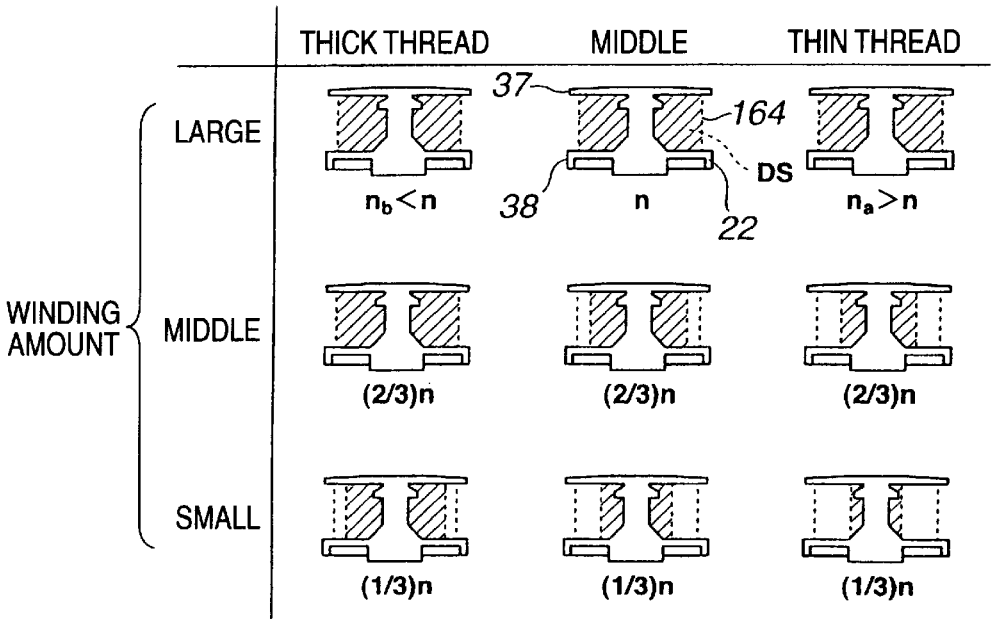
FIG. 20 is a view illustrating the thread winding amount of a lower thread.

The thread winding amount of the lower thread DS which is set by the thread winding amount setting switch 174 is set on the basis of a middle thread. In other words, such an amount that the thread wound upon the bobbin 22 does not overflow from the bobbin 22 is set and is managed with the diameter of the thread wound upon the bobbin 22 as shown in FIG. 20. The amount is set to be the maximum thread winding diameter (large) 164 and the thread winding operation is carried out until the maximum thread winding diameter 164 is detected by the thread winding diameter detecting means 160. The smaller thread winding amounts (middle) and (small) than the maximum thread winding diameter (large) 164 are managed by the rotation number of the bobbin. In contrast with a thread winding number n for winding a thread having a middle thickness indicated as "middle" in FIG. 20 up to the maximum thread winding diameter 164, the thread winding amount (middle) is decreased to a thread winding number (⅔)n and the thread winding amount (small) is decreased to a thread winding number (⅓)n. For this reason, the maximum thread winding diameter 164 in the thread winding amount (large) is equal irrespective of the thickness of the thread, while actual thread winding diameters in the thread winding amount (middle) and the thread winding amount (small) are varied depending on the thickness of the thread. Originally, it is ideal that the thread winding amount of the lower thread DS is managed depending on the length of the thread. For such a reason that the management of the thread winding amount of the lower thread DS depending on the length of the thread is complicated and an expensive device is required, it is hard to carry out the management. By managing the thread winding amount of the lower thread DS depending on the thread winding number, it is easy to almost realize the identity.

Figure 21:
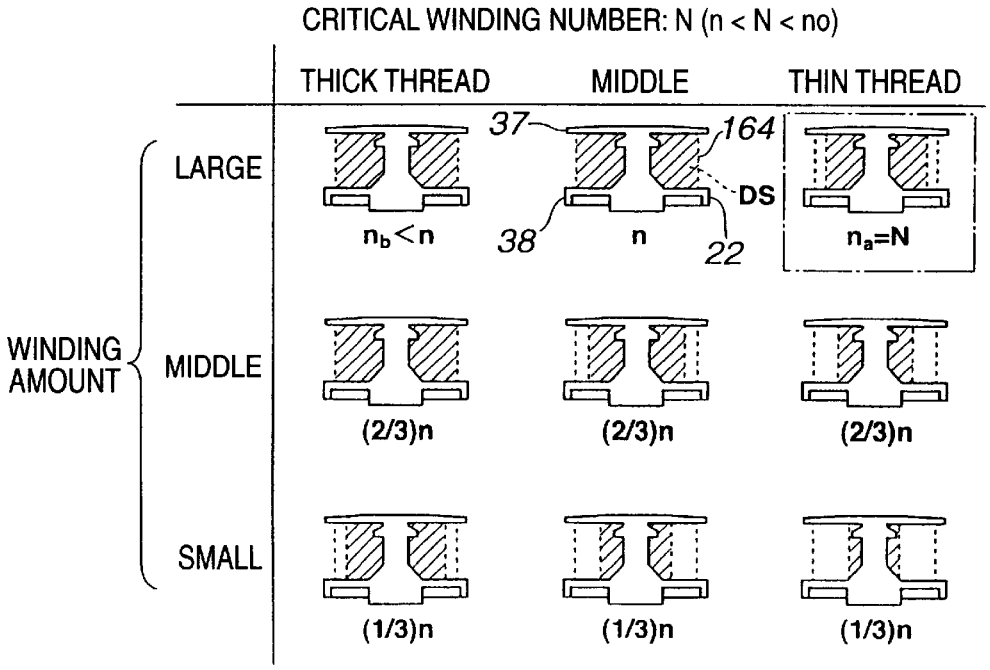
FIG. 21 is a view illustrating the critical thread winding number of the lower thread.

In FIGS. 20 and 21, na denotes a winding number obtained when a thin thread is wound up to the maximum thread winding diameter 164 and nb denotes a winding number obtained when a thick thread is wound up to the maximum thread winding diameter 164.

Moreover, it is also possible to set the thread winding amount for each thickness of the threads such as a thin thread, a middle thread and a thick thread without setting the thread winding amount of the lower thread DS on the basis of the middle thread. In this case, it is preferable that the operating portion 170 should be provided with means for selecting the thickness of a thread which is not shown.

The critical thread winding number setting portion 198 stores a critical thread winding number N. The critical thread winding number N will be described. In the case in which the thin thread is used, the amount of the thread wound upon the bobbin 22 is increased, and particularly, the lower thread DS cannot be used completely in a domestic sewing machine if the lower thread DS is wound upon the bobbin 22 up to the maximum thread winding diameter 164. As shown in FIG. 21, therefore, the critical thread winding number N ($n<N<na$) is set and the thread winding operation is ended with the critical thread winding number N even if the maximum thread winding diameter 164 is not reached.

It is also possible to set the critical thread winding number for each thickness of the threads such as a thin thread, a middle thread and a thick thread.

The sewing data storage portion 200 stores data for an operation such as a plurality of sewing patterns such as an embroidered stitch and a straight stitch and a cloth feed pitch, a needle oscillation pitch and a needle oscillation width for forming the stitches based on the sewing patterns, and various data such as the types of the upper thread US and the lower thread DS which are to be used depending on the sewing pattern, the type of the lower thread DS to be supplied to the bobbin 22 during the thread winding operation, the thread winding amount and the critical thread winding number.

The automatic setting portion 201 stores a program for automatically setting the selection of the lower thread DS to be supplied to the bobbin 22 depending on pattern data selected by a pattern selecting switch 172 to be the pattern selecting means of the operating portion 170, that is, the selection of the use of the supplied thread EDS or the upper thread US as the lower thread DS to be supplied to the bobbin 22, and/or the thread winding amount of the lower thread DS to be supplied to the bobbin 22.

More specifically, in the embodiment, the setting can variously be carried out automatically depending on the pattern data selected by the pattern selecting switch 172 to be the pattern selecting means of the operating portion 170, and furthermore, the setting can variously be carried out manually.

In the case in which the upper thread US or the supplied thread EDS is to be used as the lower thread DS during the thread winding operation, it is preferable that the automatic setting portion 201 should store a program for automatically setting various portions except for a portion related to the selection of the lower thread DS to be supplied to the bobbin 22.

The erroneous winding operation preventing portion 202 stores a program for deciding whether or not a setting state and the state of the lower thread winding device 1 are coincident with each other, and invalidating the thread winding operation for the upper thread US if the setting state and the state of the lower thread winding device 1 are not coincident with each other, that is, the thread hold detecting means 180 detects the supplied thread EDS and invalidating the thread winding operation for the supplied thread EDS if the thread hold detecting means 180 does not detect the supplied thread EDS. Moreover, the erroneous winding operation preventing portion 202 also stores a program for displaying an alarm as a message on a display screen 176 of the operating portion 170 which also functions as alarm means 175 or for driving a buzzer which is not shown when the thread winding operation is invalidated.

Next, description will be given to the function of the embodiment having the above-mentioned structure.

In the case in which the lower thread DS is gone in the middle of the sewing operation or the lower thread DS is to be wound for a sewing preparation, the lower thread winding device 1 according to the embodiment is used in such a state that an empty bobbin 22 is set into the inner holder 18 and a power is supplied to a sewing machine.

The thread winding operation of the lower thread winding device 1 according to the embodiment is started by operating the pattern selecting switch 172 of the operating portion 170 shown in FIG. 15, thereby selecting a pattern. By operating the pattern selecting switch 172 to select a pattern, the automatic setting portion 201 automatically sets the thread winding amount of the lower thread DS, the thread to be wound and the thread winding operation depending on the pattern selected by the pattern selecting switch 172 from various data stored in the sewing data storage portion 200. For example, the thread winding amount is set to "large" and the thread to be wound is set to be the supplied thread EDS for embroidering and the thread winding amount is set to (middle) and the thread to be wound is set to be the upper thread US for straight sewing. At this time, the control portion 93 selects either the first thread winding operation control portion 193A or the second thread winding operation control portion 193B as the control operation of the thread winding operation control portion 193, and also sets various operations related to the thread winding operation and an operation order.

The thread winding amount and the thread to be wound can also be changed manually by operating the wound thread setting switch 173 and the thread winding amount setting switch 174, that is, can be set by a manual operation.

When the automatic setting is carried out or the setting is carried out by the manual operation, the erroneous winding operation preventing portion 202 decides whether or not the setting state and the state of the lower thread winding device are coincident with each other, invalidates the thread winding operation for the upper thread US if the setting state and the state of the lower thread winding device 1 are not coincident with each other, that is, when the thread hold detecting means 180 detects the supplied thread EDS, invalidates the thread winding operation of the supplied thread EDS when the thread hold detecting means 180 does not detect the supplied thread EDS, and displays an alarm on the display screen 176 of the operating portion 170 which also functions as the alarm means 175 or drives a buzzer which is not shown. As a result, the erroneous winding operation preventing means 202 can prevent a malfunction and the alarm means 175 can cause an operator to easily recognize various alarms.

Moreover, in the case in which various setting operations are completed and the erroneous winding operation preventing portion 202 decided that the setting state and the state of the lower thread winding device 1 are coincident with each other, the thread winding start/stop switch 177 is operated to start the thread winding operation.

In the case in which bobbin thread absence detecting means such as an optical sensor which is not shown is provided, the sewing machine is stopped when the bobbin thread absence detecting means detects that the lower thread DS of the bobbin 22 is gone in the middle of the sewing operation, and the thread winding operation for the lower thread DS is then started on a preset condition.

The lower thread winding device 1 according to the embodiment can select and use either the upper thread US or the supplied thread EDS which has already been hung as the lower thread DS to be supplied to the bobbin 22 during the thread winding operation. In the case in which the upper thread US is used as the lower thread DS to be supplied to the bobbin 22, the thread is not hung on the thread catching and holding member 48 such that the thread catching and holding member 48 does not have the thread. Moreover, in the case in which the supplied thread EDS is used as the lower thread DS to be supplied to the bobbin 22, the supplied thread EDS is previously hung on the thread catching and holding member 48 through the special lower thread reeling device 110 as shown in FIG. 10.

Next, the thread winding operation for the supplied thread will be described with reference to FIGS. 22 to 26.

Figure 22:
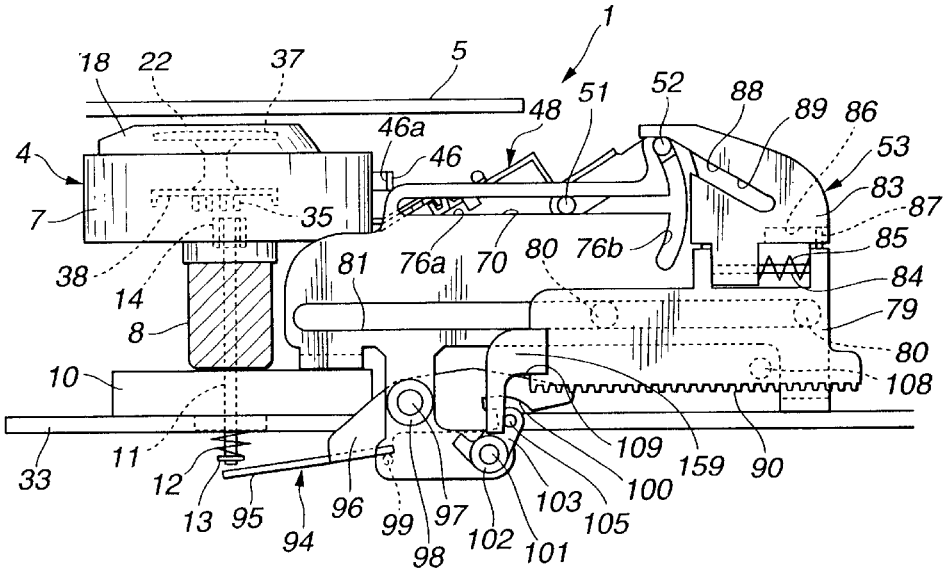
FIG. 22 is a front view showing a main part in an initial state at time of the thread winding operation of the lower thread winding device according to the invention.
Figure 23:
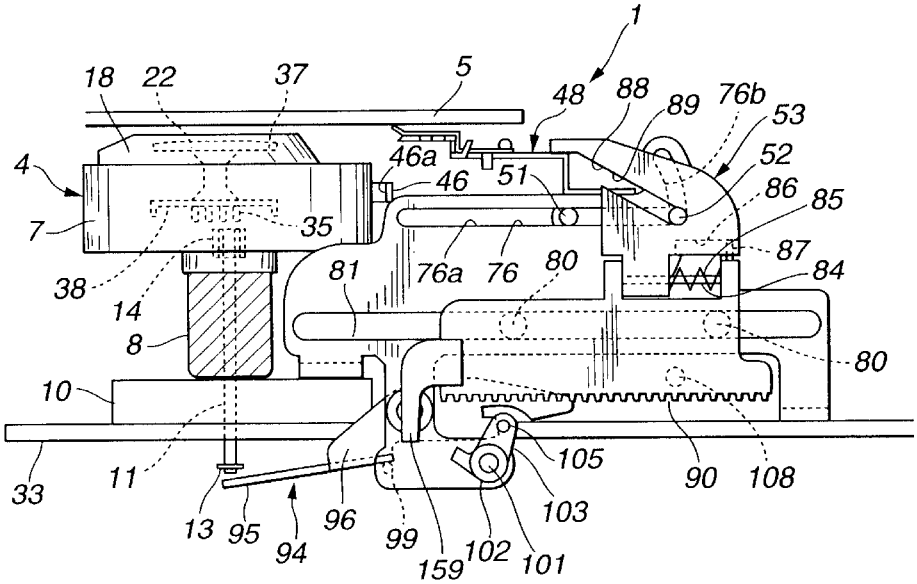
FIG. 23 is a view showing a state obtained before an advance is started succeeding to FIG. 22 in the same manner as FIG. 22.
Figure 24:
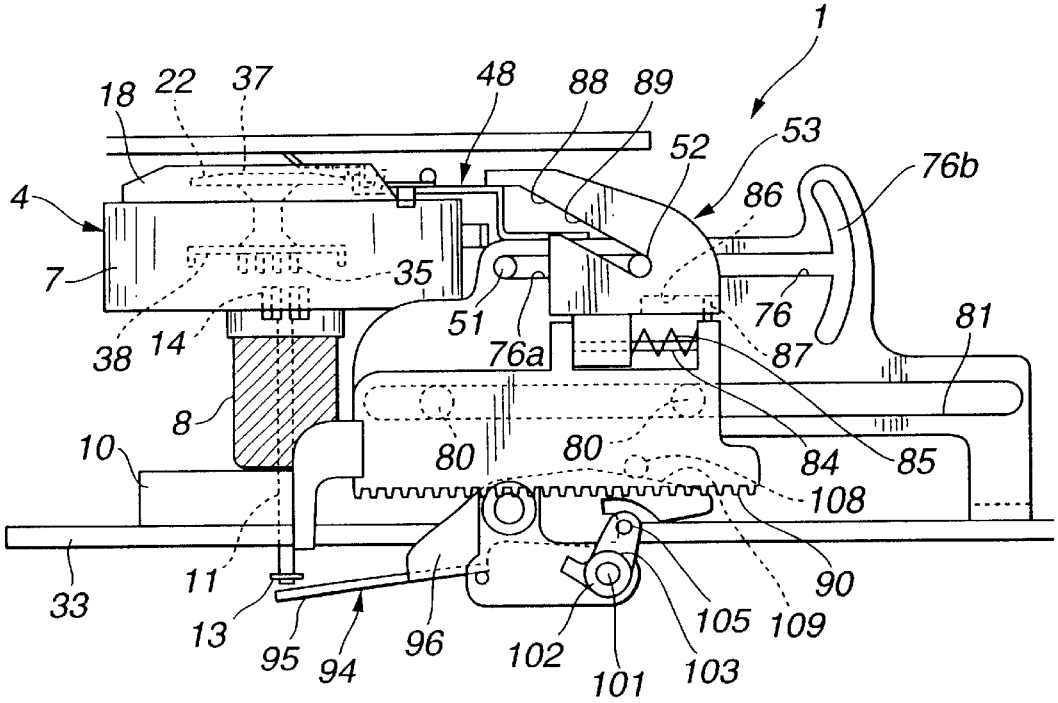
FIG. 24 is a view showing the state of the advance succeeding to FIG. 23 in the same manner as FIG. 22.
Figure 25:
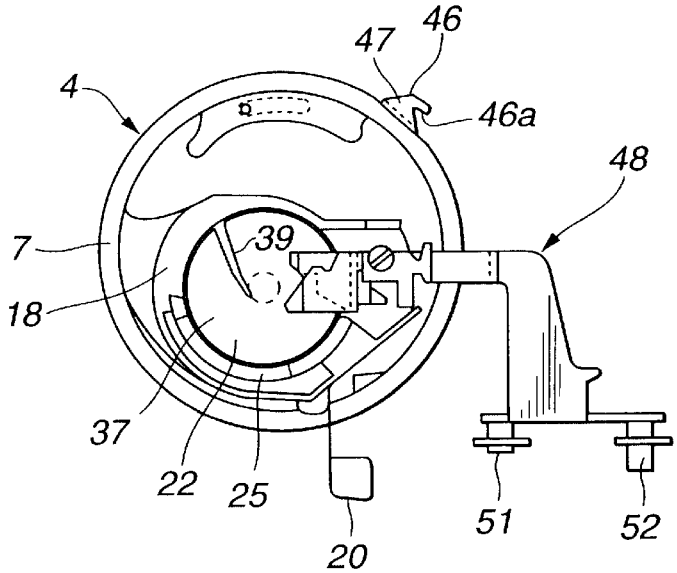
FIG. 25 is a plan view showing the state in FIG. 24.
Figure 26:
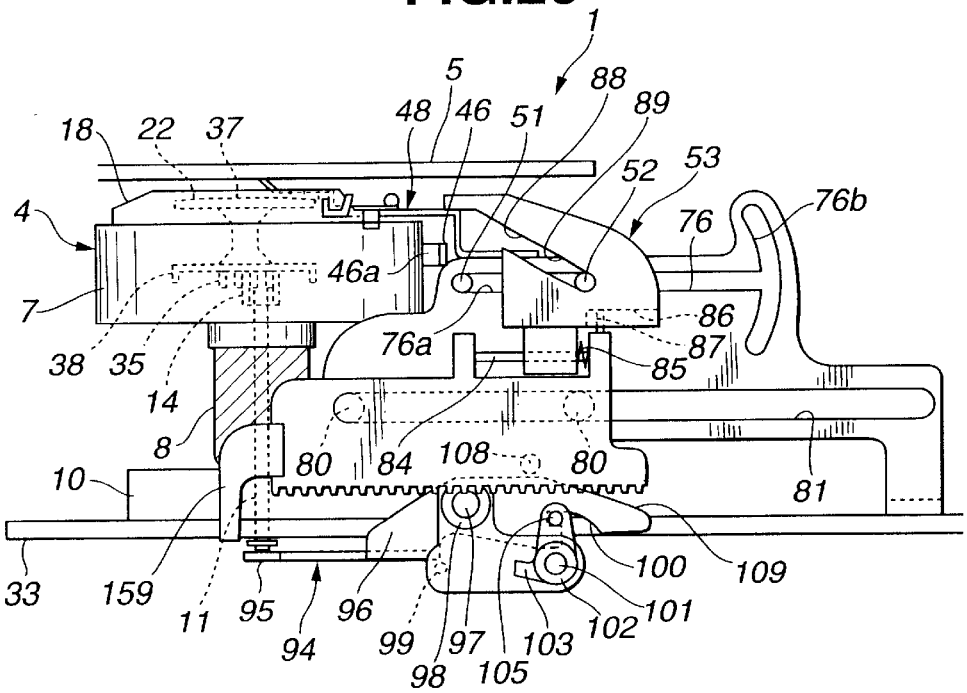
FIG. 26 is a view showing a state in which a thread can be wound succeeding to FIG. 24 in the same manner as FIG. 22.

FIGS. 22 to 26 show the thread winding operation for the supplied thread, and FIG. 22 is a front view showing a main part in an initial state at time of the thread winding operation of the lower thread winding device according to the invention, FIG. 23 is a view showing a state obtained before an advance is started in the same manner as FIG. 22, FIG. 24 is a view showing the state of the advance in the same manner as FIG. 22, FIG. 25 is a plan view showing the state in FIG. 24, and FIG. 26 is a view showing a state in which a thread can be wound in the same manner as FIG. 22.

As shown in FIG. 22, during the sewing operation of the lower thread winding device 1 or an initial state at time of the stop of the sewing machine, the tip portion in the longitudinal direction of the thread catching and holding member 48 is placed in the lower retreat position in the vicinity of the outer peripheral surface of the outer holder 7 by the thread catching and holding member moving means 53. More specifically, the lower driving plate 79 and the upper driving plate 83 in the thread catching and holding member moving means 53 are positioned on a retreat end shown in the right part of FIG. 22, and the rear attachment pin 52 of the thread catching and holding member 48 is positioned above the vertical portion 76*b* of the moving groove 76 of the thread catching and holding member moving means 53 and has a tip portion abutting from above in the vicinity of the tip of the cam face 88 of the cam groove 89 in this state.

Moreover, the bobbin driving member 11 is placed in the separating position in which it is separated from the bobbin 22 and the bobbin 22 is brought into a non-rotation state by the first moving means 94. More specifically, the lower driving plate 79 is positioned on the retreat end so that the operating pin 108 of the first moving means 94 is separated from the inclined cam face 109, the gear connecting link 96 is energized in a counterclockwise direction around the link support pin 97 by the energizing force of the spring 6 and the operating plate 95 is separated below the lower end of the bobbin driving member 11, and the bobbin driving member 11 is energized downward by the energizing force of the bobbin driving member energizing spring 12 and the bobbin driving gear 14 provided on the upper end of the bobbin driving member 11 is separated downward from the bobbin driven gear 35, is fitted in the gear hole 17 of the outer holder bottom plate 16 and is rotated integrally with the outer holder 7. Furthermore, the stopper pin 105 abuts on a stopper pin operating arm 159 and is thus opposed to the abutment edge 100A formed in the lower left part of the arcuate groove portion 100.

During the sewing operation, the upper thread US turned in the inner holder 18 passes through a clearance formed by the bottom face of the inner holder 18 and the upper surface of the bobbin driving gear 14.

Subsequently, the thread winding start/stop switch 177 is operated to send a control instruction from the control portion 93 to each portion, thereby starting the thread winding operation. In the case in which the bobbin thread absence detecting means such as an optical sensor which is not shown is provided, the control instruction is automatically sent from the control portion 93 to automatically start the thread winding operation.

When the control instruction is sent from the control portion 93 to each portion, the thread hold detecting means 180 first detects that the supplied thread EDS supplied during the thread winding operation is held in the thread catching and holding member 48 or not. The result of the detection is sent to the control portion 93 and it is decided whether or not the setting state and the state of the lower thread winding device 1 are coincident with each other by the erroneous winding operation preventing portion 202 of the control portion 93. If the thread hold detecting means 180 does not detect the supplied thread EDS, the thread winding operation is not carried out but an alarm is displayed as a message on the display screen 176 of the operating portion 170 which also functions as the alarm means 175 or a buzzer which is not shown is driven to end the operation. Consequently, it is possible to reliably prevent a malfunction.

Moreover, if the thread hold detecting means 180 detects the supplied thread EDS, the driving motor 91 of the thread catching and holding member moving means 53 is driven based on the control instruction sent from the control portion 93 and the lower driving plate 79 of the thread catching and holding member moving means 53 advances in such a direction as to approach the horizontal holder 4 shown in the left part of FIG. 22 along the guide groove 81 of the mechanism table 77. The advance of the lower driving plate 79 is transmitted to the upper driving plate 83 through the energizing spring 85 and the upper driving plate 83 advances integrally with the lower driving plate 79. Consequently, the cam groove 89 of the upper driving plate 83 advances and the rear attachment pin 52 of the thread catching and holding member 48 is pressed downward by the cam face 88 of the cam groove 89 so that the rear attachment pin 52 is moved downward from the vertical portion 76*b* of the moving groove 76. A distance between the centers of the rear attachment pin 52 and the front attachment pin 51 is set to be equal to the radius of curvature of the vertical portion 76*b* of the moving groove 76 which is arcuately formed. Therefore, the thread catching and holding member 48 is rotated in a clockwise direction in FIG. 22 around the rear attachment pin 52 and each portion shown in FIG. 22 is brought into such a state that the tip portion in the longitudinal direction of the thread catching and holding member 48 is positioned in an upper part along the outer peripheral surface of the outer holder 7 and can advance as shown in FIG. 23. Moreover, the stopper pin 105 abuts on the abutment edge 100A in such a state as to abut on the stopper pin operating arm 159.

Next, when the lower driving plate 79 further advances by the further driving operation of the driving motor 91, the thread catching and holding member 48 advances along the moving groove 76. In each portion shown in FIG. 23, the front attachment pin 51 abuts on the tip portion of the moving groove 76 shown in the left part of FIG. 24 and the advance of the thread catching and holding member 48 is stopped in the entry position in which the tip portion of the thread catching and holding member 48 enters the inner upper part of the inner holder 18 so that an advance state is brought as shown in FIGS. 24 and 25. At this time, the operating pin 108 of the first moving means 94 abuts on the inclined cam face 109. Moreover, the stopper pin 105 abuts on the abutment edge 100A in such a state as to be separated from the stopper pin operating arm 159.

Next, when the driving motor 91 is further driven, the lower driving plate 79 further advances. In each portion shown in FIGS. 24 and 25, as shown in FIG. 26, the operating pin 108 of the first moving means 94 pushes down the inclined cam face 109, the gear connecting link 96 is rotated in the clockwise direction, the operating plate 95 abuts on the lower end of the bobbin driving member 11 to lift the bobbin driving member 11 against the energizing force of the bobbin driving member energizing spring 12, the bobbin driving gear 14 provided on the upper end of the bobbin driving member 11 is engaged with both of the gear hole 17 of the outer holder bottom plate 16 and the bobbin driven gear 35 to connect the bobbin driving member 11 to the bobbin 22, and the bobbin 22 is set into the connecting position to bring a rotation state so that the lower driving plate 79 is positioned on the advance end to bring a state in which the thread winding operation can be carried out. At the same time, the stopper 103 is rotated in the counterclockwise reaction by the energizing force of the spring 107 (FIG. 9) so that the stopper pin 105 is fitted in the groove bottom 100*a* of the arcuate groove portion 100 in the gear connecting link 96. Moreover, while the lower driving plate 79 advances, the energizing spring 85 contracts in an axial direction so that the movement of the upper driving plate 83 holds a stop state. As a result, the thread catching and holding member 48 holds the entry position in which the tip portion of the thread catching and holding member 48 enters the inner upper part of the inner holder 18.

Referring to the positional relationship between the bobbin 22 and the thread catching and holding member 48 in the state in which the thread winding operation can be carried out, moreover, the supplied thread EDS connected obliquely between the thread holding portion 59 and the thread position regulating portion 58 in the thread catching and holding member 48 is pushed against the outer peripheral edge of the upper flange 37 of the bobbin 22 as shown in FIG. 8.

Next, the upper shaft clutch mechanism 410 is operated in response to the control instruction sent from the control portion 93 so that the upper shaft 416 is removed from the lower shaft 414 and the upper shaft pulley 424 which are driven by the sewing machine motor 413 and the reciprocating motions in a vertical direction of the needle 3 and the thread take-up 422 which are driven by the upper shaft 416 are stopped to hold the needle 3 in an upper position, and the sewing machine is then driven.

When the sewing machine is driven, the outer holder 7 is normally rotated. The rotation of the outer holder 7 normally rotates the bobbin driving gear 14 provided on the upper end of the bobbin driving member 11 through the outer holder bottom plate. As a result, the bobbin driven gear 35 engaged with the bobbin driving gear 14 is reversely rotated in an opposite direction to the direction of the rotation of the outer holder 7 and the bobbin 22 is reversely rotated in an opposite direction to the direction of the rotation of the outer holder 7.

By the reverse rotation of the bobbin 22, the supplied thread EDS pushed against the outer peripheral edge of the upper flange 37 of the bobbin 22 and connected obliquely between the thread holding portion 59 and the thread position regulating portion 58 in the thread catching and holding member 48 is caught into the opening 39*a* of the slit 39 in the bobbin 22 and the supplied thread EDS on the supply side, that is, the lower thread piece 111 side is guided into the concave groove 41 formed on the bobbin center shaft 36. When the supplied thread EDS is wound into the concave groove 41 by the rotation of the bobbin 22, it is wound upon the outer peripheral surface of the bobbin center shaft 36 beyond the wall portion 40 downward in FIG. 5 and the thread winding operation is further carried out by the continuous rotation of the bobbin 22. Moreover, the supplied thread EDS on the thread end side held in the thread holding portion 59 of the thread catching and holding member 48 is slightly pulled by the rotation of the bobbin 22 and becomes shorter, and projects from the slit 39.

The supplied thread EDS is wound upon the bobbin 22 until the thread winding amount stored in the thread winding amount control portion 197 or the critical thread winding number setting portion 198 is reached. When the winding of the supplied thread EDS upon the bobbin 22 reaches a preset thread winding amount, the sewing machine is stopped based on the control instruction of the first thread winding operation control portion 193A. At this time, the upper shaft clutch mechanism 410 is operated to remove the upper shaft 416 from the lower shaft 414 and the upper shaft pulley 424 which are driven by the sewing machine motor 413 and the reciprocating motions in the vertical direction of the needle 3 and the thread take-up 422 which are driven by the upper shaft 416 are stopped to hold such a state that the needle 3 is maintained in an upper position.

Next, an operation for hanging a supplied thread onto the lower thread tension means and an operation for cutting the supplied thread will be described with reference to FIGS. 27 to 31.

Figure 27:
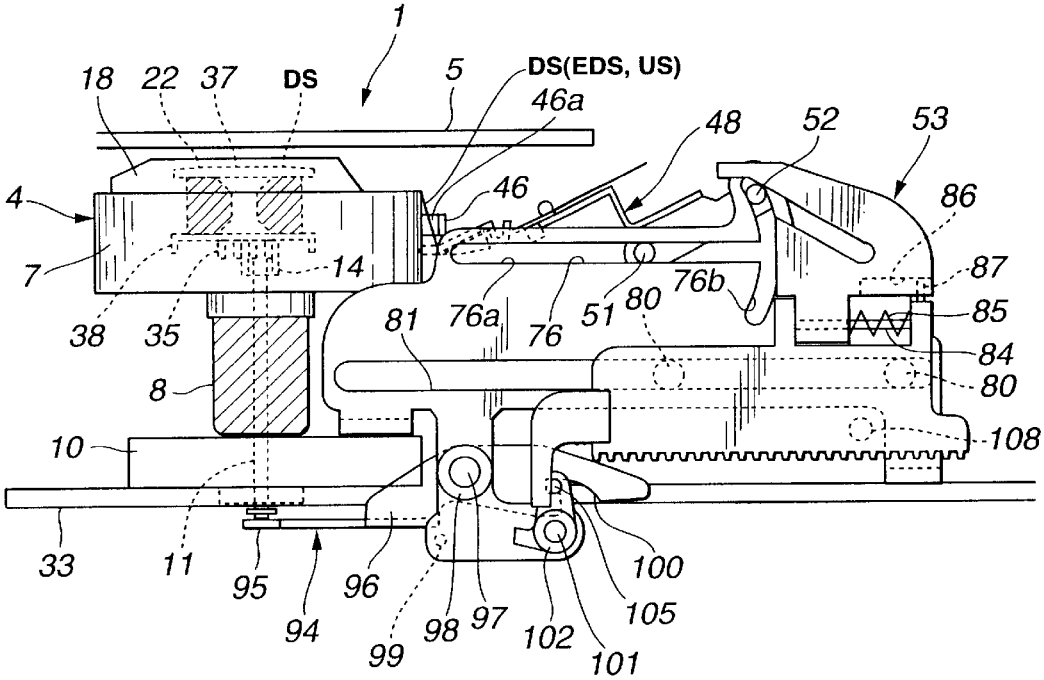
FIG. 27 is a view showing a state in which a lower thread can be caught succeeding to FIG. 26 in the same manner as FIG. 22.
Figure 28:
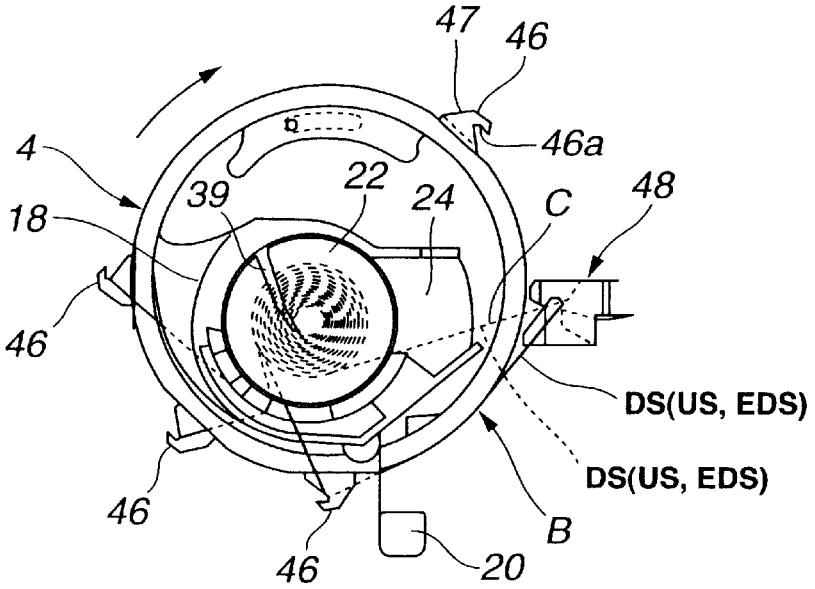
FIG. 28 is a view illustrating the main part of the positional relationship between a thread catching hook and a supplied thread in an operation for hanging a supplied thread onto the lower thread tension means after the thread winding operation is completed and an operation for cutting the supplied thread in the lower thread winding device according to the invention.
Figure 29:
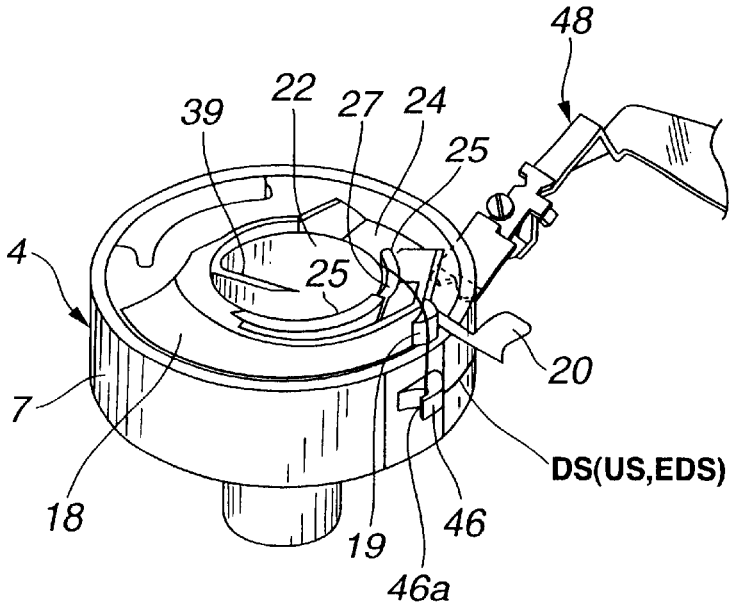
FIG. 29 is a perspective view showing the main part of a progress in the thread guarding operation and the cutting operation.
Figure 30:
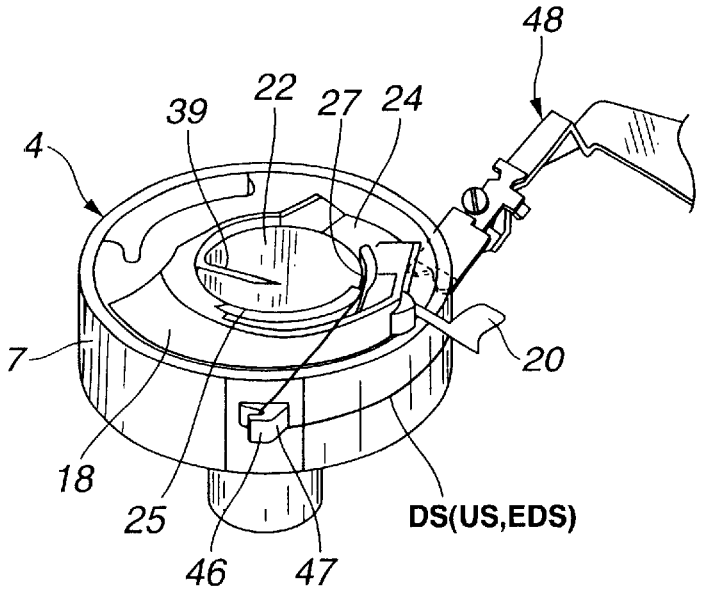
FIG. 30 is a view showing the progress succeeding to FIG. 29 in the same manner as FIG. 29.
Figure 31:
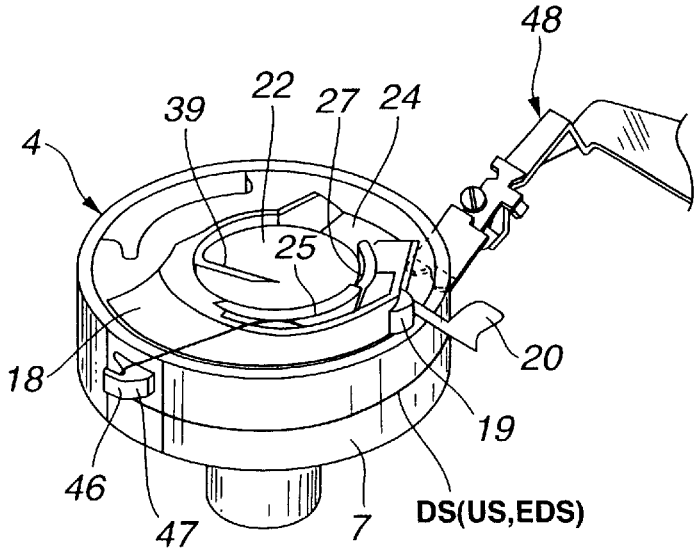
FIG. 31 is a view showing the progress succeeding to FIG. 30 in the same manner as FIG. 29.

FIGS. 27 to 31 show the operation for hanging a supplied thread onto the lower thread tension means and the operation for cutting the supplied thread, and FIG. 27 is a view showing a state in which a lower thread can be caught in the same manner as FIG. 22, FIG. 28 is a view illustrating a main part of the positional relationship between a thread catching hook and a supplied thread, FIG. 29 is a perspective view showing the main part of a progress in the thread guarding operation and the cutting operation, FIG. 30 is a view showing the progress succeeding to FIG. 29 in the same manner as FIG. 29, and FIG. 31 is a view showing the progress succeeding to FIG. 30 in the same manner as FIG. 29.

The supplied thread EDS is hung onto the lower thread tension means 25 in order to give a lower thread tension required for carrying out the sewing operation to the lower thread DS supplied to the bobbin 22.

After the thread winding operation is ended, the driving motor 91 is reversely rotated in response to a control instruction sent from the control portion 93 so that the lower driving plate 79 retreats. In the retreating movement of the lower driving plate 79, for each portion shown in FIG. 26, the tip portion in the longitudinal direction of the thread catching and holding member 48 is stopped in the slightly upper part of a retreat position below the vicinity of the outer peripheral surface of the outer holder 7, that is, in a thread catching position placed below the rotation locus of the thread catching hook 46 to bring a state in which the lower thread can be caught as shown in FIG. 27. At this time, the operating pin 108 of the first moving means 94 is separated from the inclined cam face 109, while the stopper pin 105 holds a state in which it is fitted in the groove bottom 100*a* of the arcuate groove portion 100 in the gear connecting link 96. Therefore, the bobbin driving member 11 maintains to be lifted and the bobbin driving gear 14 provided on the upper end of the bobbin driving member 11 is engaged with both of the gear hole 17 of the outer holder bottom plate 16 and the bobbin driven gear 35 to connect the bobbin driving member 11 to the bobbin 22, thereby holding a connecting position in which the bobbin 22 is brought into a rotation state. As shown in FIG. 27, the supply side of the supplied thread EDS wound upon the bobbin 22 is pulled by the thread catching and holding member 48 with the movement of the thread catching and holding member 48 to a thread catching position and is thus bent downward in the outer peripheral corner of the outer holder 7, and is not held in the thread holding portion 59 of the thread catching and holding member 48 but is engaged in the cross portion of the tip edge of the thread holding plate spring 66 of the thread catching and holding member 48 and that of the thread holding and catching portion 49.

Moreover, the thread end of the supplied thread EDS is held in the thread holding portion 59 of the thread catching and holding portion 48 in order to carry out the next thread winding operation using the supplied thread EDS. Consequently, the operation for hanging the supplied thread EDS onto the thread catching and holding member 48 can be omitted so that the thread winding operation can easily be carried out.

In the state in which the lower thread can be caught as shown in FIG. 27, the sewing machine is driven corresponding to one rotation of the lower shaft 414 in response to the control instruction sent from the control portion 93. Consequently, the outer holder 7 is normally rotated, the inclined surface 47 for thread separation of the thread catching hook 46 provided on the outer peripheral surface of the outer holder 7 pushes out the supplied thread EDS in the downward bent portion at the outer peripheral corner of the outer holder 7 in such a direction as to be separated from the outer peripheral surface of the outer holder 7, and the supply side of the supplied thread EDS wound upon the bobbin 22 is pushed into the thread holding portion 59 of the thread catching and holding member 48. As a result, the supplied thread EDS can be held in the thread holding portion 59.

When the driving motor 91 is further rotated reversely in response to the control instruction sent from the control portion 93 and the lower driving plate 79 reaches the retreat end, each portion set in the state in which the lower thread can be caught shown in FIG. 27 is returned to the initial state shown in FIG. 22. At this time, the tip portion of the thread catching and holding member 48 is moved downward along the outer peripheral surface of the outer holder 7. Therefore, the supplied thread EDS connected between the bobbin 22 and the thread holding portion 59 of the thread catching and holding member 48 is stretched. At the same time, the stopper pin 105 of the stopper 103 is rotated in the clockwise direction around the support pin 101 by the stopper pin operating arm 159 of the lower driving plate 79 so that the stopper pin 105 is separated from the arcuate groove portion 100 of the gear connecting link 96. Then, the stopper pin 105 is separated from the groove bottom 100*a* of the arcuate groove portion 100 in the gear connecting link 96 and the gear connecting link 96 is rotated in the counterclockwise direction around the link support pin 97 by the energizing force of the spring 6 so that the operating plate 95 is separated downward from the bobbin driving member 11. As a result, the bobbin driving member 11 is returned to the separating position in which it is separated from the bobbin 22 and the bobbin 22 is brought into the non-rotation state, and the bobbin 22 is thus brought into a free rotatable state.

Next, when the sewing machine is rotated reversely in response to the control instruction sent from the control portion 93, the outer holder 7 is rotated reversely so that the hook portion 46*a* of the thread catching hook 46 catches the supplied thread EDS positioned between the bobbin 22 provided in the vicinity of the outer periphery of the outer holder 7 and the thread holding portion 59 of the thread catching and holding member 48. When the hook portion 46*a* of the thread catching hook 46 is reversely rotated with the supplied thread EDS caught and reaches a position shown in the lower part of FIG. 28, the supplied thread EDS sent from the bobbin 22 gets over the upper edge of the board 26 of the lower thread tension means 25 to pass through a clearance between the projection 19 of the inner holder 18 and the inner holder detent 20 as shown in FIG. 29. Moreover, the supplied thread EDS sent from the lower part of the hook portion 46*a* of the thread catching hook 46 is wound upon the outer periphery of the large diameter portion 7*a* of the outer holder 7 and is connected to the thread holding portion 59 of the thread catching and holding member 48.

Next, when the supplied thread EDS getting over the upper edge of the board 26 of the lower thread tension means 25 slides over the upper end of the board 26 and reaches a position shown in an oblique lower left part of FIG. 28 by the further reverse rotation of the outer holder 7, it is led into the thread introducing port 27 formed on the upper edge of the board 26 of the lower thread tension means 25 so that the supplied thread EDS enters the thread introducing groove 28 as shown in FIG. 30.

Next, when the supplied thread EDS entering the thread introducing groove 28 reaches the left part of FIG. 28 and a position shown in FIG. 31 by the further reverse rotation of the outer holder 7, it is disposed in such a state as to be energized by the energizing force of the lower thread presser leaf spring 31 between the thread engagement hole 29 and the thread outlet 30 in the lower thread tension means 25 shown in FIG. 3. As a result, a proper lower thread tension required for the sewing operation can reliably be given to the supplied thread EDS.

Moreover, when the supplied thread EDS is positioned in the left part of FIG. 28, the blade tip of the cutting blade 43 provided in the outer holder 7 is positioned in the vicinity of a contact point in which the supplied thread EDS sent from the thread holding portion 59 indicated as B in FIG. 28 is started to be wound upon the outer peripheral surface of the outer holder 7. Therefore, the supplied thread EDS wound upon the outer peripheral surface of the outer holder 7 is pushed against the cutting blade 44 and is thus cut beyond the slant face of the inducing portion 44 shown in FIG. 1. The supplied thread EDS connected from the bobbin 22 to the thread holding portion 59 of the thread catching and holding member 48 is cut in this position. Consequently, the length of the lower thread DS sent from the lower thread tension means 25 required for binding a stitch can sufficiently be maintained and the residual thread on the thread end side which is sent from the thread holding portion 59 of the thread catching and holding member 48 can be reduced.

Subsequently, the reverse rotation of the outer holder 7 is stopped and the upper shaft clutch mechanism 410 is operated again in response to the control instruction sent from the control portion 93. Consequently, the reciprocating motions in the vertical direction of the needle bar 2 and the thread take-up 422 which are separated from the rotating motion of the lower shaft 414 is linked to the rotation of the lower shaft 414 so that each portion of the lower thread winding device 1 is returned to the initial state and the operation for winding the supplied thread EDS is completed.

Next, the thread winding operation of the upper thread will be described with reference to FIGS. 7, 8, 22 to 26 and 32. The description of the same portions as those in the thread winding operation for the supplied thread EDS will be omitted.

Figure 32:
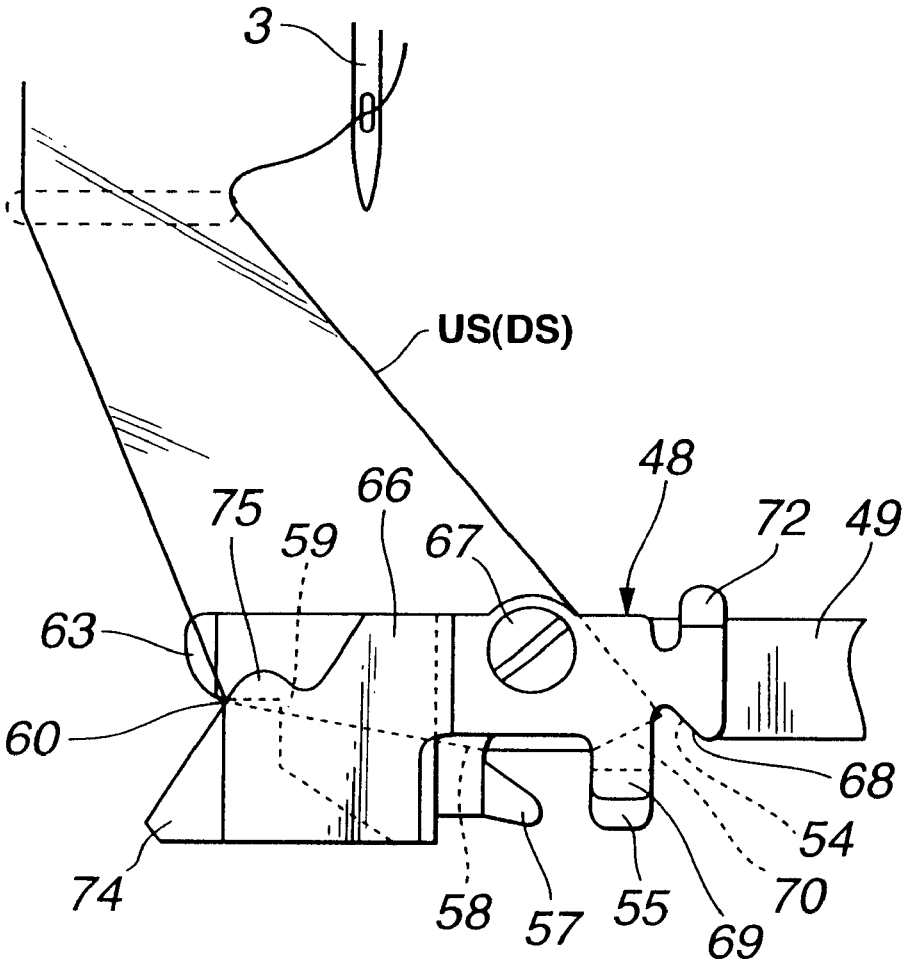
FIG. 32 is a view illustrating an upper thread catching state in which the thread catching and holding member catches an upper thread.

FIG. 32 is a view illustrating an upper thread catching state in which the thread catching and holding member catches the upper thread.

The thread winding operation for the upper thread US which is to be carried out by the lower thread winding device 1 according to the embodiment is started by operating the thread winding start/stop switch 177 to send a control instruction from the control portion 93 to each portion. In the case in which the bobbin thread absence detecting means such as an optical sensor which is not shown is provided, the control instruction is automatically sent from the control portion 93 so that the thread winding operation is started automatically.

When the control instruction is sent from the control portion 93 to each portion, the thread hold detecting means 180 detects that the supplied thread EDS supplied during the thread winding operation is held in the thread catching and holding member 48 or not. The result of the detection is sent to the control portion 93 and it is decided whether or not the setting state and the state of the lower thread winding device 1 are coincident with each other by the erroneous winding operation preventing portion 202 of the control portion 93. If the thread hold detecting means 180 detects the supplied thread EDS, the thread winding operation is not carried out but an alarm is displayed as a message on the display screen 176 of the operating portion 170 which also functions as the alarm means 175 or a buzzer which is not shown is driven to end the operation. Consequently, it is possible to reliably prevent a malfunction.

Moreover, if the thread hold detecting means 180 does not detect the supplied thread EDS, the driving motor 91 of the thread catching and holding member moving means 53 is driven based on the control instruction sent from the control portion 93 and the lower thread winding device 1 positioned in the initial state shown in FIG. 22 is positioned in the advance state shown in FIGS. 24 and 25 through a state obtained before an advance start shown in FIG. 23 in the same manner as in the thread winding operation of the supplied thread EDS. When the lower thread winding device 1 is positioned in the advance state shown in FIGS. 24 and 25, the driving motor 91 is stopped based on the control instruction sent from the control portion 93.

Next, when the lower thread winding device 1 is stopped in the advance state shown in FIGS. 24 and 25, the sewing machine is driven corresponding to one rotation of the lower shaft 414 based on the control instruction sent from the control portion 93. Consequently, the needle 3 placed in an upper stop position is once reciprocated corresponding to one stitch in a vertical direction by the vertical motion of the needle bar 2 and an upper thread loop sent from the needle eye of the needle 3 is caught by the blade tip 42 of the normally rotated outer holder 7 and is thereby turned in the inner holder 18. At this time, the upper thread US turned in the inner holder 18 is divided into the upper and lower parts of the inner holder 18 by means of the blade tip 42 and the upper thread US on the cloth side passes over the inner holder 18 and passes through a clearance formed by the bottom face of the inner holder 18 and the upper surface of the bobbin driving gear 14. In the case in which the upper thread US is to be wound in the middle of the sewing operation, there is no hindrance because one end of the upper thread US is connected to the stitch of a cloth as shown in FIG. 3. In other cases, it is important that the thread end of the upper thread US is held by a hand to drive the sewing machine.

Since the tip portion of the thread catching and holding member 48 is stopped in such an entry position as to enter the inner upper part of the inner holder 18 as shown in FIGS. 24 and 25, the upper thread US turned over the upper surface of the inner holder 18 is led into an opening portion formed by the thread engaging portion 60 which is provided by the cross portion of the tip edge of the thread holding leaf spring 66 and that of the thread holding and catching portion 49 which is shown in detail in FIG. 7. By the further rotation of the blade tip 42, the upper thread US passes through a clearance between the projection 19 of the inner holder 18 and the inner holder detent 20 and is then led through the thread position regulating portion 58 into an opening portion formed by the rear holding portion 70 for an upper thread which is provided by the upper rear tongue piece 69 of the thread holding leaf spring 66 and the rear tongue piece 55 of the thread holding and catching portion 49 which is shown in detail in FIG. 7, and the upper thread US then slips out of the inner holder 18 and is caught by the thread catching and holding member 48, and is thus brought into an upper thread catching state as shown in FIG. 32. At this time, as shown in FIG. 32, the upper thread US is not held in the thread holding portion 59 but is engaged with the thread engaging portion 60 and a portion connected between the thread engaging portion 60 and the rear holding portion 70 for an upper thread is stretched to be positioned in the thread position regulating portion 58 in almost the same manner as the supplied thread EDS shown in FIG. 8.

During the sewing operation, the upper thread US is reeled in only an amount required for each stitch by the driving motor 125 driven according to a control instruction sent from the control portion 93 by means of the upper thread reeling mechanism 120 shown in FIG. 11, and the driving motor 125 is stopped at time of thread fastening so that the upper thread US is held between the driving roller 124 and the driven roller 128. Thus, a proper thread tension can be obtained.

During the thread winding operation, moreover, the upper thread US is not required in an amount necessary for a stitch required for the sewing operation at a first stitch with which the horizontal holder 4 is driven immediately after the start of the thread winding operation but in an amount corresponding to a thread path shown in FIG. 32. Furthermore, a proper tension is also required for the upper thread US in order to reliably catch the upper thread US by means of the thread catching and holding member 48. Therefore, the upper thread US is reeled in an almost equal amount to the amount required for the thread path shown in FIG. 32 or a slightly small amount by means of the upper thread reeling mechanism 120 in accordance with the control instruction sent from the control portion 93 and the driving motor 125 is then stopped at time of the thread fastening to be carried out by a thread take-up mechanism which is not shown so that the upper thread US is held between the driving roller 124 and the driven roller 128 and can be thereby caught reliably by the thread catching and holding member 48.

In the state in which the lower thread winding device 1 is stopped in the advance state shown in FIGS. 24 and 25, moreover, the bobbin driving gear 14 is separated downward from the bobbin driven gear 35.

As described above, next, the upper shaft clutch mechanism 410 is operated in response to the control instruction sent from the control portion 93 so that the upper shaft 416 is removed from the lower shaft 414 and the upper shaft pulley 424 which are driven by the sewing machine motor 413 and the reciprocating motions in a vertical direction of the needle 3 and the thread take-up 422 which are driven by the upper shaft 416 are stopped to hold the needle 3 in an upper position, and the sewing machine is then driven.

Next, each portion shown in FIGS. 24 and 25 is brought into a state in which the thread can be wound as shown in FIG. 26 by the further driving operation of the driving motor 91 after the thread catching and holding member 48 catches the upper thread US as described above.

Referring to the positional relationship between the bobbin 22 and the thread catching and holding member 48 in the state in which the thread winding can be carried out, moreover, the upper thread US connected obliquely between the thread engaging portion 64 and the thread position regulating portion 58 in the thread catching and holding member 48 is pushed against the outer peripheral edge of the upper flange 37 of the bobbin 22 as shown in FIG. 8.

Next, when the sewing machine is driven in response to the control instruction sent from the control portion 93, the outer holder 7 is normally rotated. The rotation of the outer holder 7 normally rotates the bobbin driving gear 14 provided on the upper end of the bobbin driving member 11 through the outer holder bottom plate. As a result, the bobbin driven gear 35 engaged with the bobbin driving gear 14 is reversely rotated in an opposite direction to the direction of the rotation of the outer holder 7 and the bobbin 22 is reversely rotated in an opposite direction to the direction of the rotation of the outer holder 7.

By the reverse rotation of the bobbin 22, the upper thread US pushed against the outer peripheral edge of the upper flange 37 of the bobbin 22 and connected obliquely between the thread engaging portion 64 and the thread position regulating portion 58 in the thread catching and holding member 48 is caught into the opening 39*a* of the slit 39 in the bobbin 22 and the upper thread US on the needle side to be the supply side, that is, the upper thread piece 121 side is guided into the concave groove 41 formed on the bobbin center shaft 36. When the upper thread US is wound into the concave groove 41 by the rotation of the bobbin 22, and furthermore, is caught in the opening 39*a* of the slit 39 in the bobbin 22, the solenoid 136 constituting a part of the thread loosening means 138 is driven, the driven roller 128 is separated and released from the driving roller 124 and the upper thread US is led out of the upper thread piece 121 by the continuous rotation of the bobbin 22 so that the thread winding is further carried out. The upper thread US sent from the slit 39 of the bobbin 22 and connected to a cloth is repetitively rubbed and cut by the edge portion of the slit 39 every time the bobbin 22 is rotated.

The upper thread US is wound upon the bobbin 22 until the thread winding amount set by the thread winding amount control portion 197 or the critical thread winding number setting portion 198 is reached. When the winding of the upper thread US upon the bobbin 22 reaches a preset thread winding amount, the sewing machine is stopped based on the control instruction of the first thread winding operation control portion 193A. At this time, the upper shaft clutch mechanism 410 is operated to remove the upper shaft 416 from the lower shaft 414 and the upper shaft pulley 424 which are driven by the sewing machine motor 413 and the reciprocating motions in the vertical direction of the needle 3 and the thread take-up 422 which are driven by the upper shaft 416 are stopped to hold such a state that the needle 3 is maintained in an upper position.

Next, an operation for hanging an upper thread to be a lower thread supplied to a bobbin onto the lower thread tension means and an operation for cutting the upper thread will be described with reference to FIGS. 28 to 31.

The upper thread US to be the lower thread DS supplied to the bobbin 22 is hung onto the lower thread tension means 25 in order to give a lower thread tension required for carrying out the sewing operation to the lower thread DS supplied to the bobbin 22.

After the thread winding is completed, the driving motor 91 is reversely rotated in response to a control instruction sent from the control portion 93 to cause the lower driving plate 79 to retreat and each portion shown in FIG. 26 is returned to an initial state shown in FIG. 22. Differently from the operation for hanging the supplied thread EDS onto the lower thread tension means 25, the operation for hanging the upper thread US to be the lower thread DS supplied to the bobbin 22 onto the lower thread tension means 25 does not need to hold a thread end in the thread holding portion 59 of the thread catching and holding member 48. Therefore, the upper thread US to be the lower thread DS sent from the bobbin 22 is almost the same as a thread path indicated as C in FIG. 28 in the initial state. In the same manner as in the operation for hanging the supplied thread EDS onto the lower thread tension means 25, when the sewing machine is rotated reversely in the initial state in response to the control instruction sent from the control portion 93, the outer holder 7 is reversely rotated and the hook portion 46*a* of the thread catching hook 46 catches the upper thread US positioned between the bobbin 22 provided in the vicinity of the outer periphery of the outer holder 7 and the thread engaging portion 60 of the thread catching and holding member 48, the hook portion 46*a* of the thread catching hook 46 is reversely rotated with the upper thread US caught, the upper thread US sent from the bobbin 22 is induced into the thread introducing port 27 formed on the upper edge of the board 26 of the lower thread tension means 25 to enter the thread introducing groove 28, and the upper thread US to be the lower thread DS entering the thread introducing groove 28 is provided to be energized by the energizing force of the lower thread presser leaf spring 31 between the thread engagement hole 29 and the thread outlet 30 in the lower thread tension means 25 by the further reverse rotation of the outer holder 7. As a result, a proper lower thread tension required for the sewing operation can reliably be given to the upper thread US to be the lower thread DS.

Moreover, the upper thread US to be the lower thread DS is cut by the blade tip of the cutting blade 43 provided in the outer holder 7 in the same manner as the supplied thread EDS and a length required for binding a stitch can sufficiently be maintained as a residual thread on the needle side.

In response to the control instruction sent from the control portion 93, subsequently, the reverse rotation of the outer holder is stopped and the upper shaft clutch mechanism 410 links, to the rotation of the lower shaft 414, the reciprocating motions in the vertical direction of the needle bar 2 and the thread take-up 422 which are separated from the rotating motion of the lower shaft 414. Consequently, each portion of the lower thread winding device 1 is returned to the initial state and the thread winding operation for the upper thread US to be the lower thread DS is thus completed.

According to the lower thread winding device 1 in accordance with the embodiment, thus, the supplied thread EDS or the upper thread US to be the lower thread DS which is used for embroidering can be easily selected and supplied to the bobbin 22 without removing the upper thread US which is being used and without removing the bobbin 22 from the horizontal holder 4. More specifically, it is possible to easily select the type of the lower thread DS to be supplied to the bobbin 22 depending on a stitch.

According to the lower thread winding device 1 in accordance with the embodiment, furthermore, it is possible to easily carry out the operation for hanging the lower thread DS supplied to the bobbin 22 onto the lower thread tension means 25. After the thread winding operation is completed, therefore, a proper tension can easily be given to the lower thread DS wound upon the bobbin 22.

According to the lower thread winding device 1 in accordance with the embodiment, moreover, it is possible to automatically carry out the thread winding operation for the lower thread DS to be supplied to the bobbin 22, the operation for hanging the lower thread DS supplied to the bobbin 22 onto the lower thread tension means 25 and the operation for cutting the lower thread DS supplied to the bobbin 22. Therefore, the operability of the sewing machine can be enhanced and a labor and a time which are required for the thread winding operation can be reduced.

According to the lower thread winding device 1 in accordance with the embodiment, furthermore, the thread is hung onto the lower thread tension means 25 by the operation for reversely rotating the outer holder 7 after the thread winding is completed. Therefore, the thread outlet 30 in the lower thread tension means 25 can be provided on the inner holder 18 and it is possible to reliably eliminate the cause of the tension instability of the lower thread DS that a lower thread path from the bobbin to a cloth after conventional thread winding passes under the holder, resulting in an increase in a thread path bending resistance. Thus, a proper lower thread tension can easily be given to the lower thread DS.

According to the lower thread winding device 1 in accordance with the embodiment, moreover, in the case in which the supplied thread EDS is used as the lower thread DS to be supplied to the bobbin 222, the thread end of the supplied thread EDS can easily be held in the thread catching and holding member 48 after the thread winding operation is completed. Consequently, the thread winding operation can easily be repeated until the supplied thread EDS sent from the lower thread piece 111 is gone. According to the lower thread winding device 1 in accordance with the embodiment, furthermore, it is possible to select the amount of winding of the lower thread DS to be wound upon the bobbin 22 depending on a sewing condition.

According to the lower thread winding device 1 in accordance with the embodiment, moreover, it is possible to automatically set the selection of the lower thread DS and the amount of winding of the lower thread DS depending on pattern sewing data, that is, a sewing pattern during the sewing operation. Therefore, it is possible to easily carry out the operation related to the thread winding operation.

According to the lower thread winding device 1 in accordance with the embodiment, furthermore, the setting state of the thread winding operation and that of the lower thread winding device 1 can be coincident with each other. In the case in which the supplied thread EDS is used as the lower thread DS to be supplied to the bobbin 22, therefore, it is possible to reliably prevent the supplied thread EDS from being forgot to be hung onto the thread catching and holding member 48. In addition, a malfunction can be prevented.

According to the lower thread winding device 1 in accordance with the embodiment, moreover, in the case in which the upper thread US is used as the lower thread DS to be supplied to the bobbin 22, the thread loosening means 138 releases the holding state of the upper thread US held between the driven roller 128 and the driving roller 124 during the thread winding operation. Therefore, it is possible to easily carry out a smooth thread winding operation without applying excessive force to the upper thread US.

According to the lower thread winding device 1 in accordance with the embodiment, furthermore, the alarm means 175 is provided. Therefore, it is possible to cause an operator to easily recognize various alarms.

According to the lower thread winding device 1 in accordance with the embodiment, while the supplied thread EDS and the upper thread US can be selected as the lower thread DS to be supplied to the bobbin 22, it is also possible to employ such a structure that only the supplied thread EDS or the upper thread US is used as the lower thread DS to be supplied to the bobbin 22.

According to the lower thread winding device 1 in accordance with the embodiment, furthermore, while the thread on the supply side is cut by the cutting blade 43 provided in the outer holder 7 after the thread winding operation is completed, it is also possible to employ such a structure that the thread wound upon the outer periphery of the outer holder 7 is caught and cut.

According to the lower thread winding device 1 in accordance with the embodiment, moreover, in the case in which the upper thread US is used as the lower thread DS to be supplied to the bobbin 22, the thread sent from the bobbin 22 and connected to the cloth is cut by the edge of the slit 39 formed in the upper flange 37 of the bobbin 22 after the thread winding operation is completed. In order to cut the thread, it is also possible to employ such a structure that the center of the upper part of the bobbin 22 is pushed from above by means of a pushing member and the thread repetitively passes between the pushing member and the upper flange 37 of the bobbin 22 and is thus cut.

According to the lower thread winding device 1 in accordance with the embodiment, furthermore, the driving motor 91 of the thread catching and holding member moving means 53 is driven to move the thread catching and holding member 48. It is also possible to employ such a structure that the thread catching and holding member 48 is moved manually.

According to the lower thread winding device 1 in accordance with the embodiment, moreover, the detection is carried out by the light emitting element 186 and the light receiving element 187 to be the thread hold detecting means 180 for detecting the holding state of the lower thread DS. The thread hold detecting means 180 can have such a structure as to detect the tension of the lower thread DS.

In the upper shaft clutch mechanism 410 according to the embodiment, while the actuator 434 is driven by the needle oscillation driving mechanism 442, the invention is not restricted thereto but the actuator 434 may be driven by another actuator, for example, a solenoid.

Moreover, while the needle oscillation motor and the upper shaft clutch motor are shared and the operation is carried out by one motor, independent motors may be used.

Furthermore, while the upper shaft clutch mechanism 410 rotates the lower shaft 414 by means of the sewing machine motor 235 to carry out lower thread winding, racing and thread cutting, and to simultaneously disconnect the upper shaft pulley 424 from the upper shaft 416 in order to separate the thread take-up 422 and the needle bar 2 from the sewing machine motor 235, the invention is not restricted thereto but the needle bar 2 and the thread take-up 422 are preferably provided between any of the lower shaft 414, the lower shaft pulley 414A, the belt 418, the upper shaft pulley 424, the upper shaft 416 and the thread take-up crank 456 to be a plurality of connecting members provided from the thread take-up crank (balance weight) 456 to be a reciprocating member for reciprocating the needle bar 2 and the thread take-up 422 in a vertical direction to the lower shaft 414 to be driven by the sewing machine motor 413, and the needle bar 2 and the thread take-up 422 are connected to each other during sewing, and are disconnected from each other during the lower thread winding and are thus stopped, thereby stopping the needle attached to the tip of the needle bar 2 in an upper position.

For example, the lower shaft 414 and the lower shaft pulley 414A may be connected to each other by using the upper shaft clutch mechanism to be the lower shaft clutch mechanism. In this case, the needle oscillating mechanism having the needle oscillation motor is provided in the vicinity of the upper shaft and the lower shaft clutch mechanism including a clutch motor or a clutch solenoid is provided in the vicinity of the lower shaft. Moreover, it is also possible to provide a thread take-up crank clutch mechanism for disconnecting the upper shaft 416 from the thread take-up crank 456. For the disconnecting mechanism, the upper shaft clutch mechanism 410 may be changed properly for use.

Moreover, the thread winding amount setting switch 174 to be the thread winding amount setting means, the thread winding diameter detecting means 160, the thread winding number measuring means 206 and the thread winding amount control portion 197 in the lower thread winding device 1 according to the embodiment can properly and easily control the amount of the lower thread DS wound upon the bobbin 22 and provides an example of the embodiment of the lower thread winding amount control device according to the invention. Accordingly, the description of the lower thread winding amount control device according to the invention will be omitted.

The lower thread winding amount control device can be applied to various lower thread winding devices in addition to the lower thread winding device 1 according to the invention.

FIGS. 33 to 43 show an example of the embodiment of the lower thread winding device to which the lower thread winding amount control device according to the invention is applied. The lower thread winding device according to the embodiment has such a structure as to use only an upper thread as a lower thread to be supplied to a bobbin and has been described in JP-B-3-27230, and the detailed description of the structure will be omitted and only main parts will be described. The structures corresponding to those in the above-mentioned embodiment have the same reference numerals in the drawings.

Figure 33:
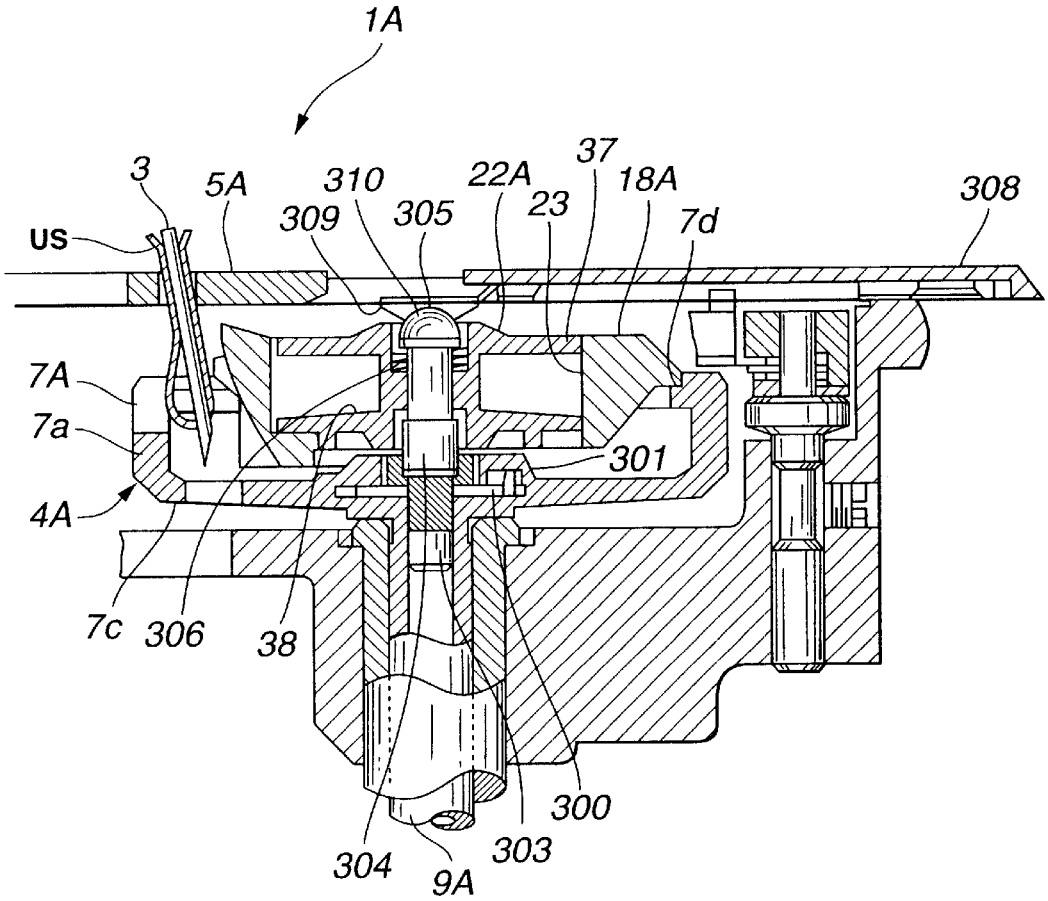
FIG. 33 is a longitudinal sectional view showing a main part according to an example of an embodiment of the lower thread winding device to which a lower thread winding amount control device is applied according to the invention.
Figure 34:
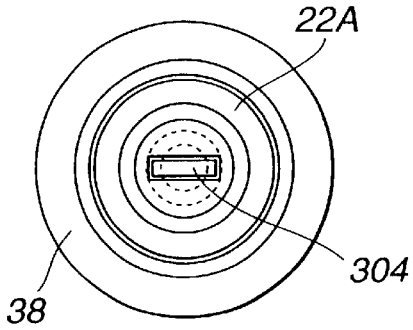
FIG. 34 is a bottom view showing a bobbin in FIG. 33.
Figure 35:
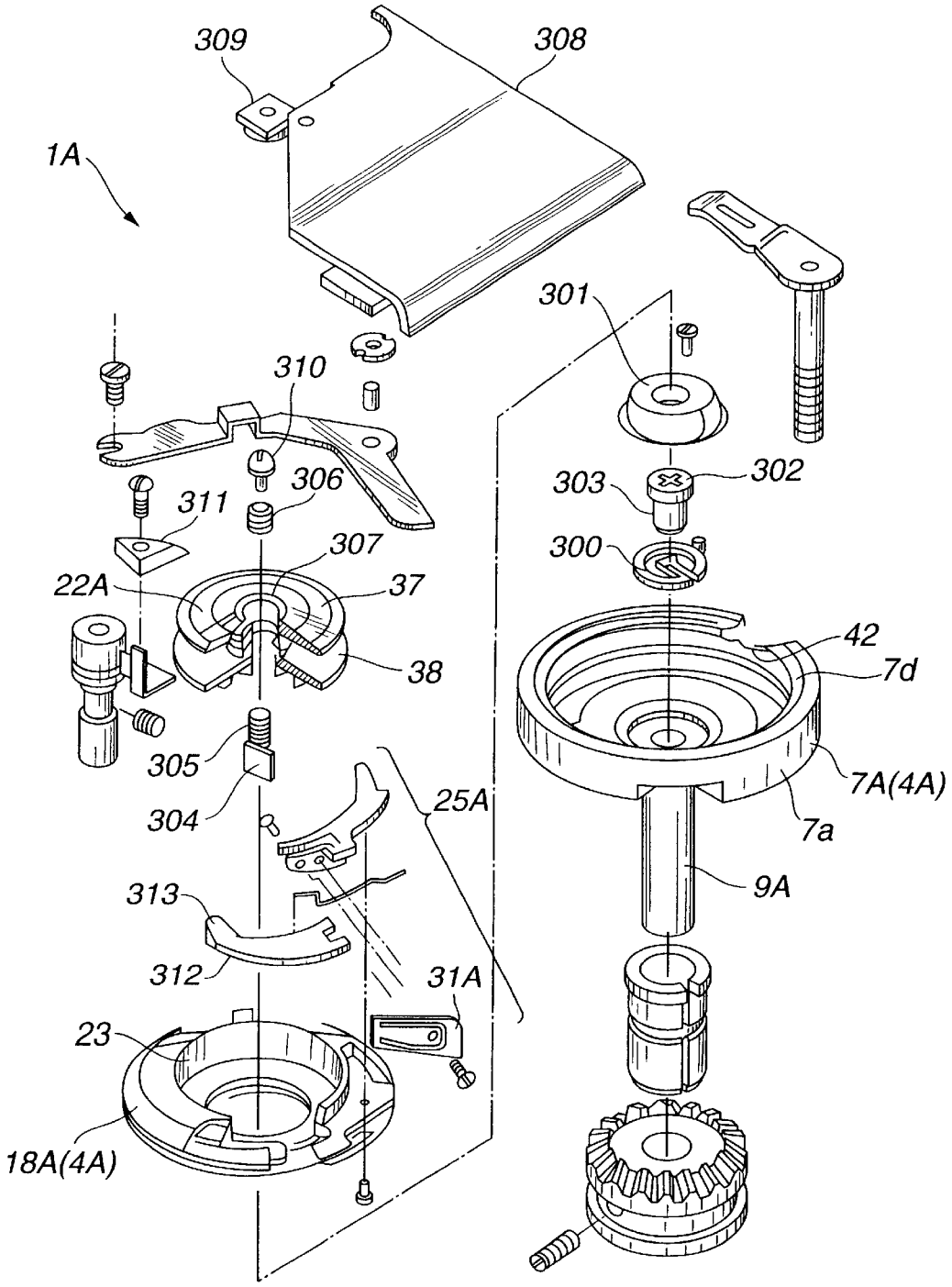
FIG. 35 is an exploded perspective view showing a main part in FIG. 33.
Figure 36:
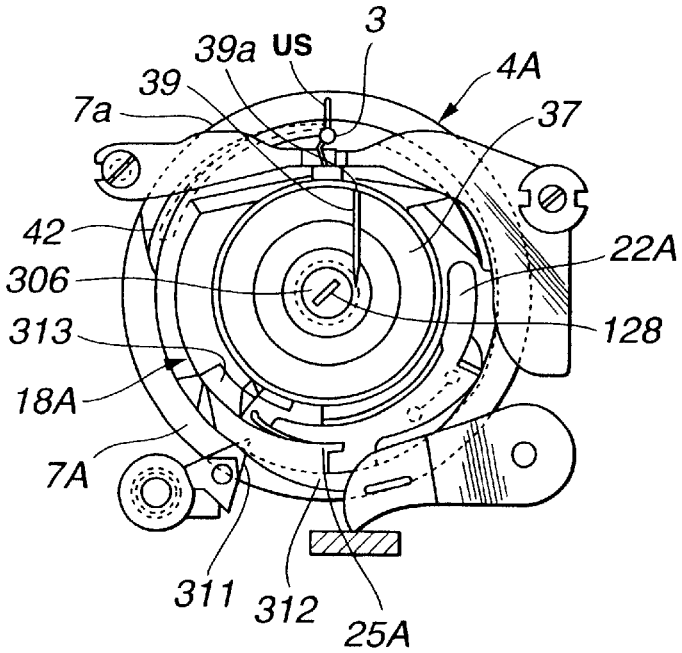
FIG. 36 is a view illustrating a state in a position where a blade tip scoops and catches an upper thread loop in the thread winding operation of the lower thread winding device in FIG. 33.
Figure 37:
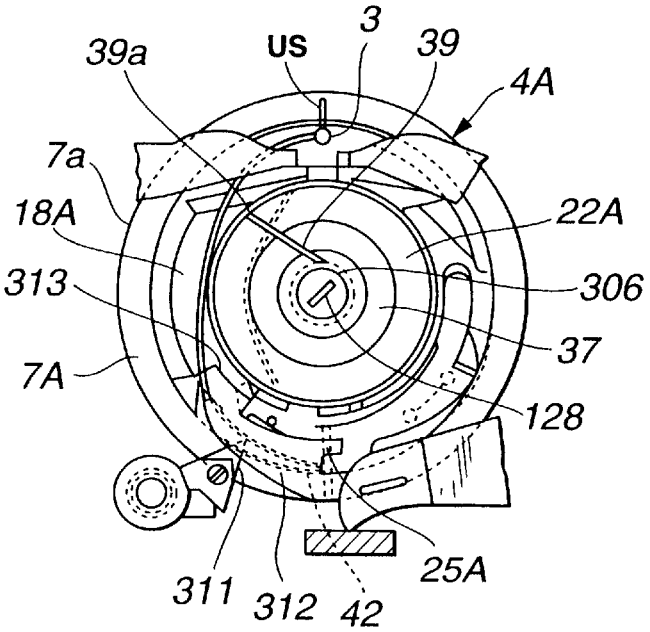
FIG. 37 is a view showing a state in a position where the upper thread loop is caught by the blade tip and is led into the lower thread tension means succeeding to FIG. 36 in the same manner as FIG. 36.
Figure 38:
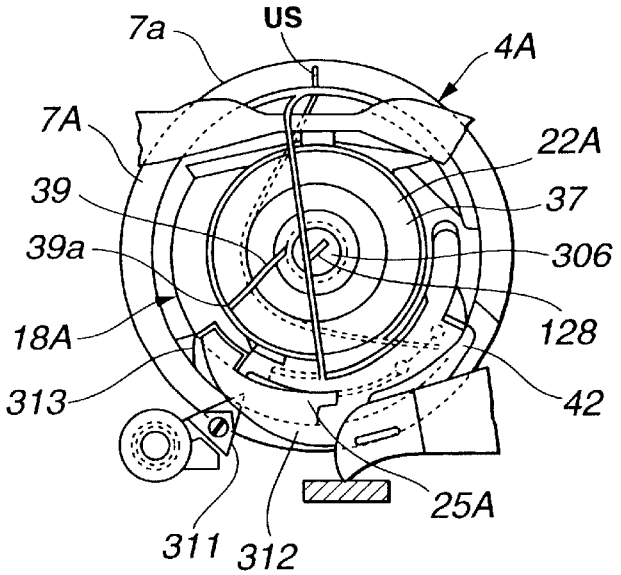
FIG. 38 is a view showing a state in a position where the upper thread loop caught by the blade tip is apt to slip off from the blade tip succeeding to FIG. 37 in the same manner as FIG. 36.
Figure 39:
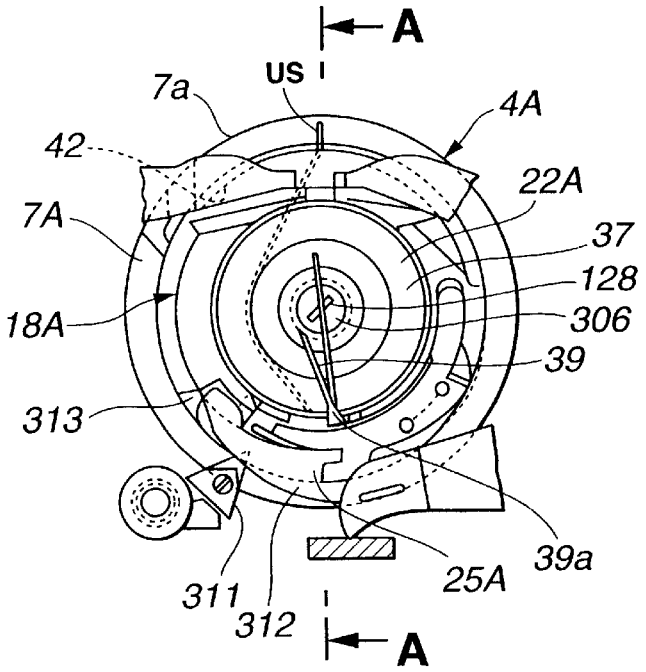
FIG. 39 is a view showing a state in a position where the upper thread loop is entering the slit of a bobbin succeeding to FIG. 38 in the same manner as FIG. 36.
Figure 40:
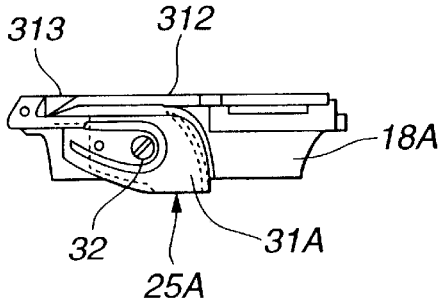
FIG. 40 is a front view showing the inner holder of the lower thread winding device in FIG. 33.

FIGS. 33 to 35 show the bobbin rotating mechanism of a lower thread winding device 1A according to the embodiment, and a spring 300 is fixed to the shaft center hole portion of a hollow holder shaft 9A of an outer holder 7A in a horizontal holder 4A with a thread leading member 301. A shaft 303 having a cross groove 302 (FIG. 35) provided on an upper surface is frictionally connected to the spring 300 and the outer holder 7A and the shaft 303 are rotated integrally. Moreover, a shaft 305 provided with a plate-shaped projection 304 in a lower part is energized upward by a spring 306 and is thus incorporated in the shaft center portion of the bobbin 22A. As shown in FIGS. 33 and 34, the projection 304 is always positioned in a bobbin hole 307 (FIG. 35) having a lower part stepped to have a large diameter and an upper thread US passes between the bottom of an inner holder 18A and the outer holder 7A during the sewing operation. During the thread winding operation, moreover, a holder cover 308 is opened to a thread winding position so that a protruded portion 309 of the holder cover 308 pushes down a bobbin shaft upper portion 310. As a result, the projection 304 of the shaft 305 is pushed down. Since the bobbin 22A is provided on the center of the outer holder 7A, the projection 304 thus pushed down is pushed against the cross groove 302 of the shaft 303 and is fitted in the cross groove 302 when the outer holder 7A is rotated in a next operation.

FIGS. 40 to 43 show such a structure that the upper thread US scooped by a blade tip 42 in the lower thread winding device 1A according to the embodiment and turned in an inner holder 18A is not led into a lower thread presser leaf spring 31A constituting a part of lower thread tension means 25A during a sewing operation but only a thread winding operation.

Figure 42:
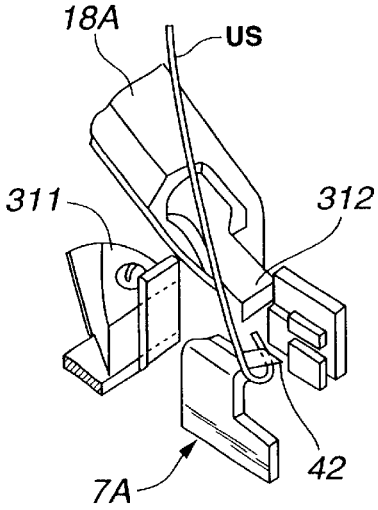
FIG. 42 is a view showing a main part in the sewing operation of the lower thread tension means of the lower thread winding device in FIG. 33 in the same manner as FIG. 41.
Figure 43:
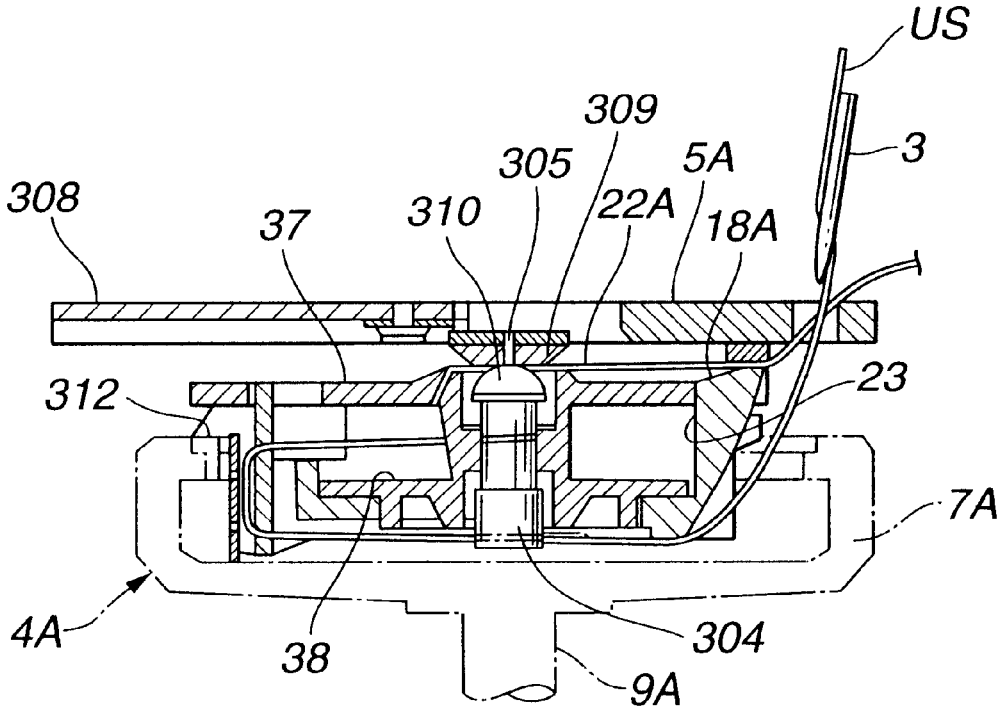
FIG. 43 is a sectional view taken along a line A—A in FIG. 39.

FIG. 42 shows a state obtained during the sewing operation, and the upper thread US scooped by the blade tip 42 of the outer holder 7A and turned in the inner holder 18A is not led into the lower thread tension means 25A attached to the inner holder 18A but passes therethrough.

Figure 41:
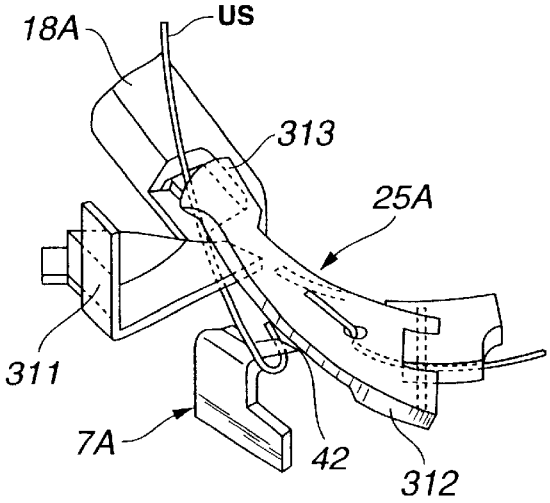
FIG. 41 is a perspective view showing a main part in the thread winding operation of the lower thread tension means of the lower thread winding device in FIG. 33.

FIG. 41 shows a state obtained during the thread winding operation, and an inducing member 311 constituting a part of the lower thread tension means 25A is rotated by the movement of the holder cover 308 as shown in FIG. 41 and lifts an end 313 of an arm 312 constituting a part of the lower thread tension means 25A so that the upper thread US turned in the inner holder 18A is led into the lower thread tension means 25A.

More specifically, in the lower thread winding device 1A according to the embodiment, the inducing member 311 constituting a part of the lower thread tension means 25A is rotated to control the presence of induction of the upper thread US into the lower thread presser leaf spring 31A.

During the thread winding operation, a needle bar 2 and a thread take-up 422 are disconnected after several needle locations and the holder cover 308 is set into a thread winding position so that a thread winding preparation is completed. When the sewing machine is started, the upper thread US scooped by the blade tip 42 of the outer holder 7A is turned separately in the upper and lower parts of the inner holder 18A and the upper thread US turning over the inner holder 18A is induced into the lower thread tension means 25A as shown in FIGS. 36 to 39. The upper thread US connected from the lower thread tension means 25A to a needle 3 is pushed against the outer periphery of an upper flange 37 of the bobbin 22A and is thus bent and is induced into a slit 39 through an opening 39*a* of the rotated bobbin 22A, and the upper thread US to be the lower thread DS is wound upon the bobbin 22A by the continuous rotation of the bobbin 22A. At this time, it is possible to properly and easily control the amount of the upper thread US to be the lower thread DS wound upon the bobbin 22A by using a lower thread winding amount control device (not shown) comprising the thread winding amount setting switch 174 to be the thread winding amount setting means, the thread winding diameter detecting means 160, the thread winding number measuring means 206 and the thread winding amount control portion 197 in the lower thread winding device 1 according to the embodiment.

FIGS. 44 to 48 show another example of the embodiment of the lower thread winding device to which the lower thread winding amount control device according to the invention is applied. The lower thread winding device according to the embodiment has such a structure as to use only an upper thread as a lower thread to be supplied to a bobbin and has been described in JP-B-60-42745, and the detailed description of the structure will be omitted and only main parts will be described. The structures corresponding to those in the above-mentioned embodiment have the same reference numerals in the drawings.

Figure 44:
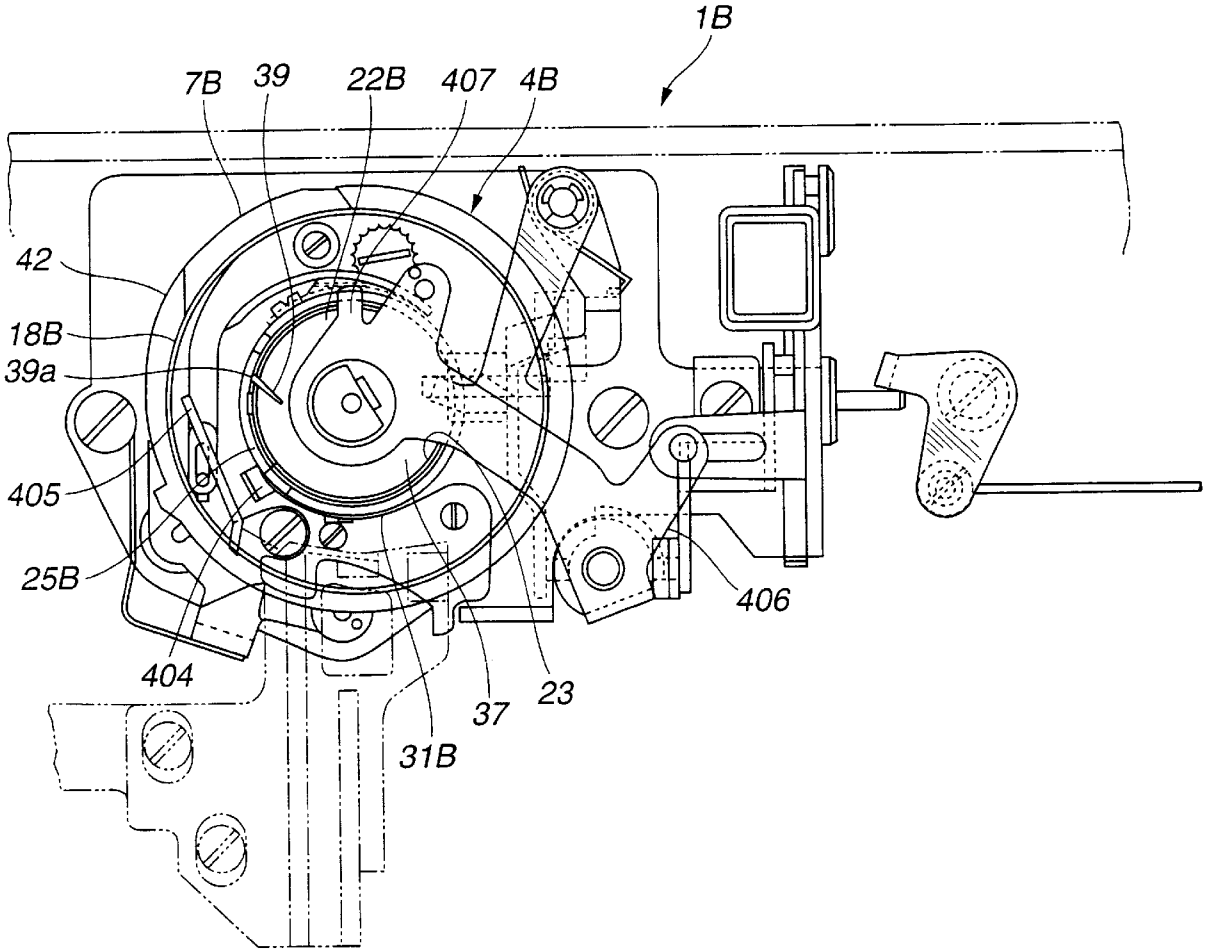
FIG. 44 is a plan view showing a main part according to another example of the embodiment of the lower thread winding device to which the lower thread winding amount control device is applied according to the invention.
Figure 45:
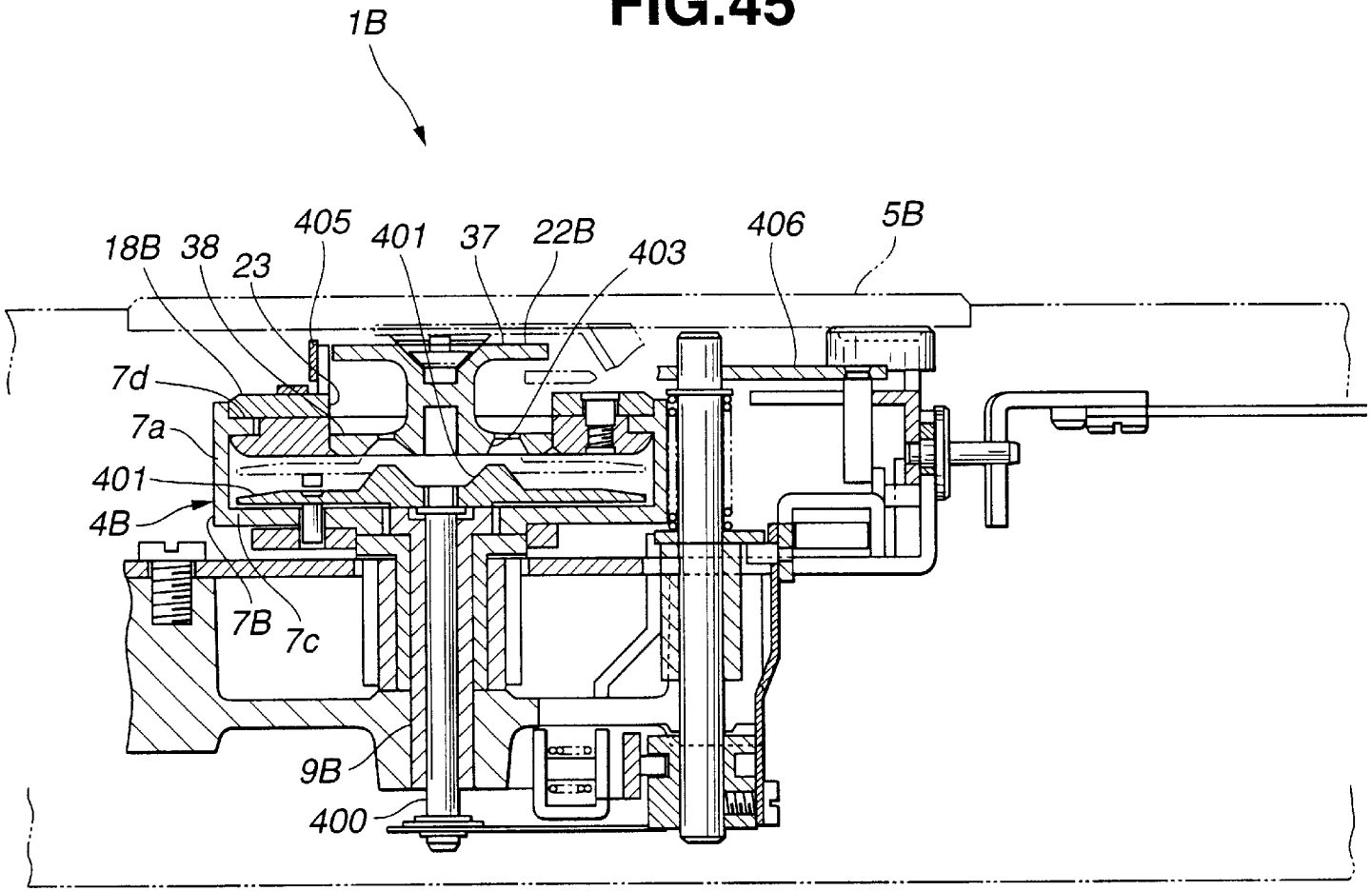
FIG. 45 is a longitudinal sectional view showing the main part in FIG. 44.

FIGS. 44 and 45 show the bobbin rotating mechanism of a lower thread winding device 1B according to the embodiment. In the lower thread winding device 1B according to the embodiment, a shaft 400 shown in FIG. 45 is pushed up and a projection 402 of a disc 401 to be rotated integrally with an outer holder 7B is engaged with a concave portion 403 formed on the lower end of a bobbin 22B so that the rotation of the outer holder 7B is transmitted to the bobbin 22B. By carrying out switching to cover a bent portion 404 to be the inlet of a lower thread presser leaf spring 31B with a control member 405 or releasing the bent portion 404, the presence of induction of an upper thread US into the lower thread presser leaf spring 31B is controlled. Furthermore, the rotation of the bobbin 22B and an operation for inducing the upper thread US into lower thread tension means 25B are carried out interlockingly with an operation for switching a lever 406 from a standby position to a thread winding position shown in FIGS. 44 and 45.

Figure 46:
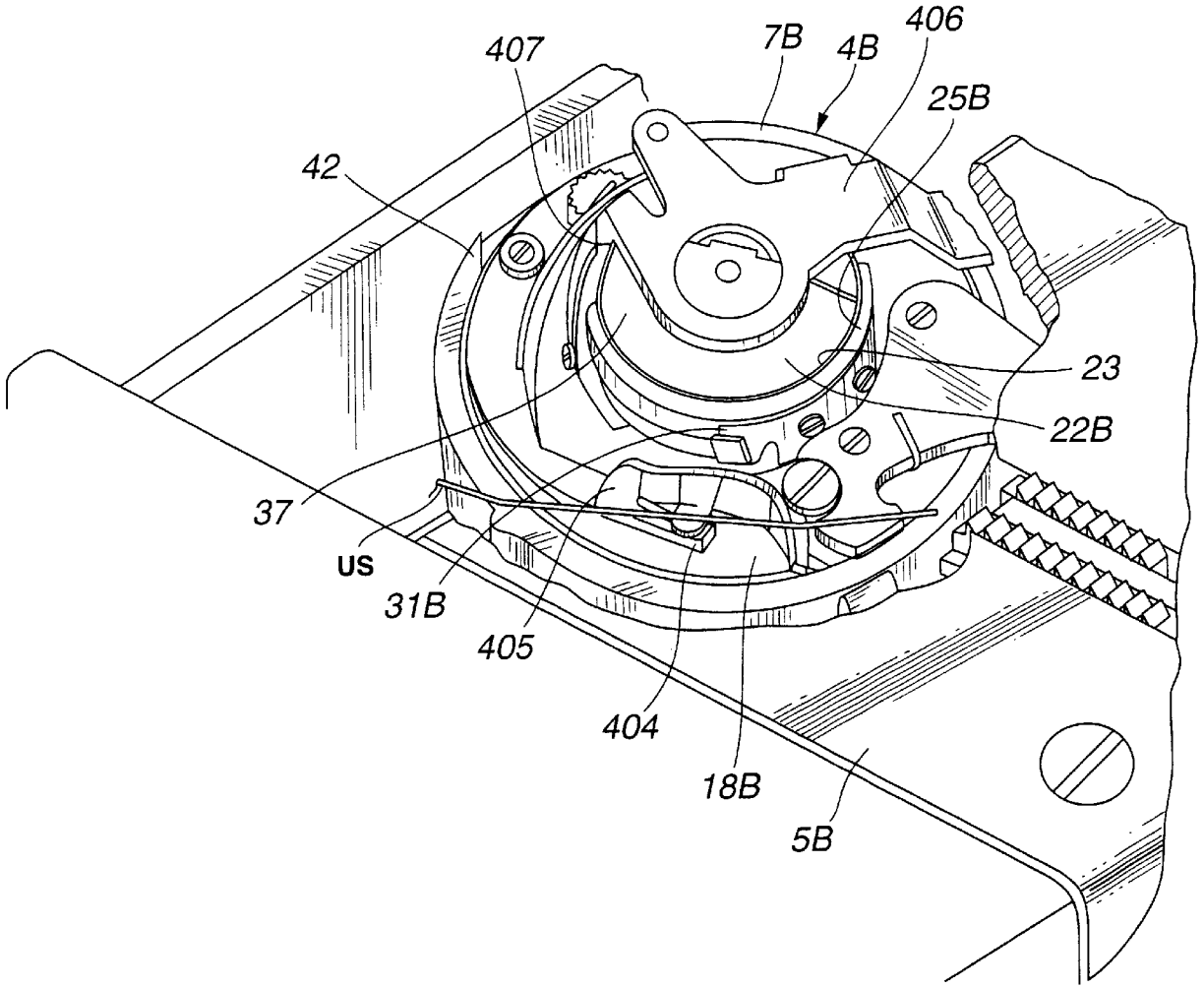
FIG. 46 is a perspective view showing a main part in the progress of the thread winding operation of the lower thread winding device in FIG. 44.
Figure 47:
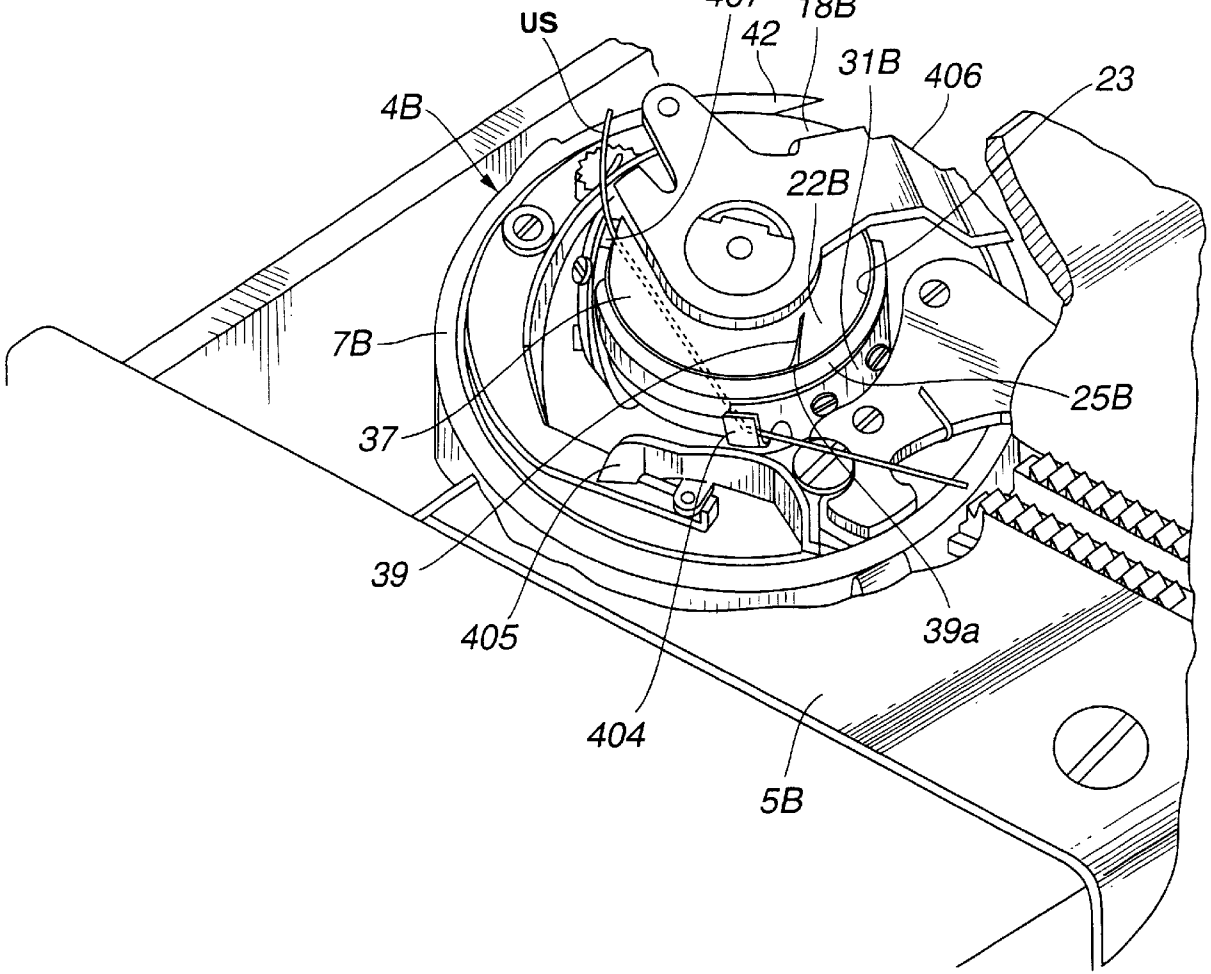
FIG. 47 is a view showing the progress succeeding to FIG. 46 in the same manner as FIG. 46.
Figure 48:
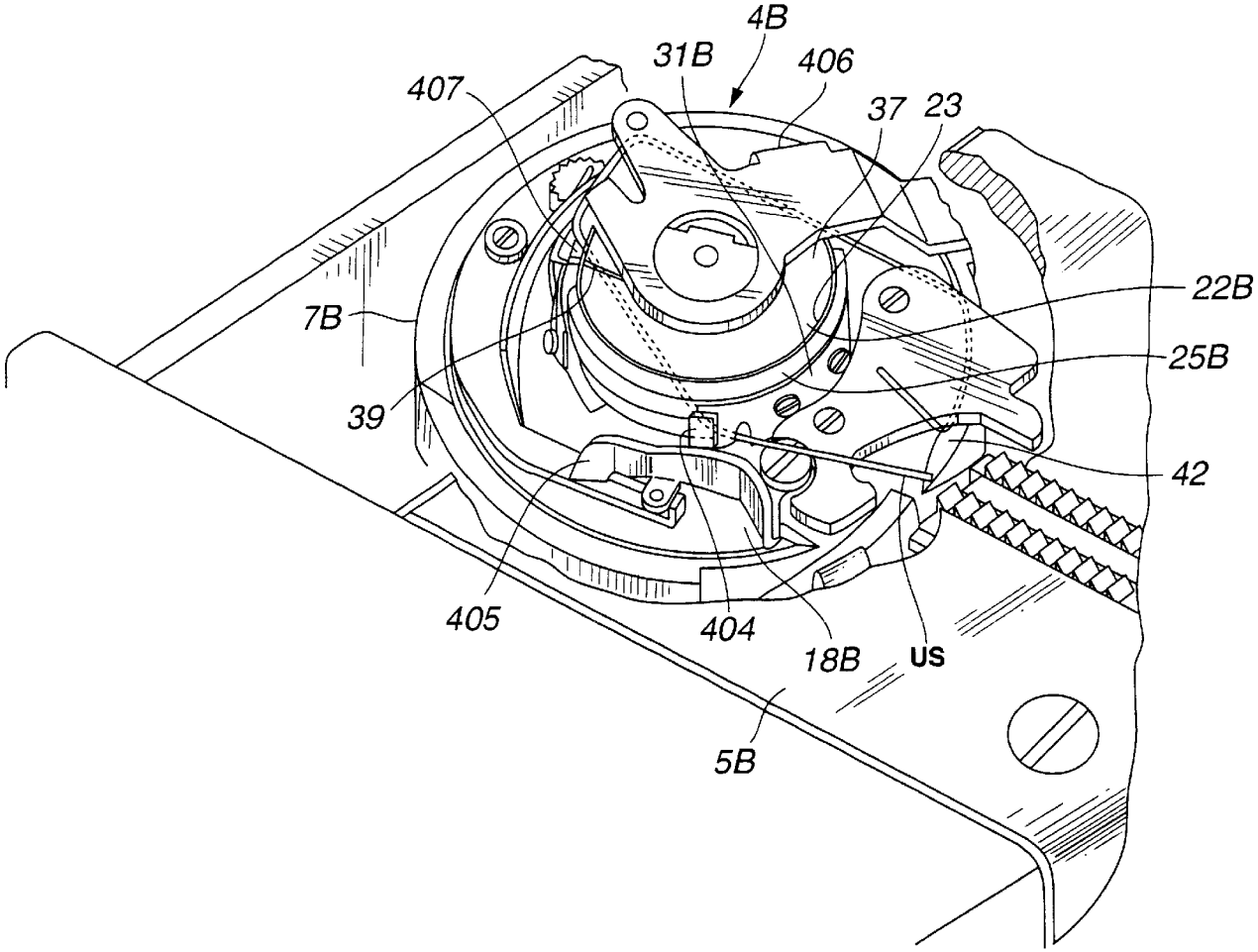
FIG. 48 is a view showing the progress succeeding to FIG. 47 in the same manner as FIG. 46.

During the thread winding operation, the upper thread US scooped by a blade tip 42 is induced into the lower thread tension means 25B and is then engaged with a thread engaging portion 407 of the lever 406, and is induced from an opening 39*a* of the rotated bobbin 22B into a slit 39 and the rotation of the bobbin 22B is continuously carried out so that the upper thread US to be a lower thread DS is wound upon the bobbin 22B as shown in FIGS. 46 to 48. At this time, it is possible to properly and easily control the amount of the upper thread US to be the lower thread DS wound upon the bobbin 22B by using a lower thread winding amount control device (not shown) comprising the thread winding amount setting switch 174 to be the thread winding amount setting means, the thread winding diameter detecting means 160, the thread winding number measuring means 206 and the thread winding amount control portion 197 in the lower thread winding device 1 according to the embodiment.

The invention is not restricted to each of the embodiments but can be changed if necessary.

As described above, according to the lower thread winding device and the lower thread winding amount control device in accordance with the invention, the motions of the needle bar 2 and the thread take-up 422 can be stopped by the upper shaft clutch mechanism during the automatic lower thread winding operation. Therefore, it is possible to produce a very excellent effect that the tensions of the upper thread and the lower thread can be stabilized, the upper thread can be prevented from slipping off and the violent movement of the bobbin and the slip-off of the thread can be reduced during the thread winding operation.

What is claimed is:

1. A lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread holding member including a thread holding portion capable of holding a thread end of the thread supplied to the bobbin during the thread winding operation and a thread position regulating portion for positioning the supplied thread on a supply side by the thread holding portion during the thread winding operation to abut on the upper flange, the thread holding portion being movable to a retreat position in the vicinity of an outer peripheral surface of the outer holder and an entry position in which the supplied thread is caused to enter an inner upper part of the inner holder to be positioned above the upper flange during the thread winding operation;

second moving means for moving the thread holding portion of the thread holding member to the retreat position and the entry position;

an upper shaft clutch mechanism provided between a drive shaft to be driven by a sewing machine motor and a reciprocating member for reciprocating a needle bar and a thread take-up in a vertical direction and capable of carrying out electrical switching into a connecting state in which the drive shaft is connected to the reciprocating member during the sewing operation and a holding state in which the connection is released and the thread take-up and the needle bar can be held in an upper position during a lower thread winding operation; and thread winding operation control means for operating the first moving means and the second moving means to cause a supplied thread connected between the thread holding portion and the thread position regulating portion to enter the slit and for bringing the upper shaft clutch mechanism into a release state so that the thread can be wound upon the bobbin without vertically moving the thread take-up and the needle bar during the thread winding operation.

2. The lower thread winding device according to claim 1, further comprising:

a thread separating portion protruded from the outer peripheral surface of the outer holder and capable of moving the supplied thread positioned in the vicinity of the outer peripheral surface of the outer holder in a separating direction from the outer holder when the outer holder is normally rotated; and a reholding operation control portion for setting the thread holding member or the thread catching and holding member into thread catching position which is placed above the retreat position, arid then rotating the outer holder to move the supplied thread positioned in the vicinity of the outer peripheral surface of the outer holder in the separating direction from the outer holder, thereby operating the thread holding member or the thread holding portion of the thread catching and holding member to hold the supplied thread after the thread winding operation is completed.

3. The lower thread winding device according to claim 1, further comprising a thread catching hook formed on the outer peripheral surface of the outer holder;

an outer holder reverse rotating mechanism for reversely rotating the outer holder;

lower thread tension means including a thread introducing port fixed to the inner holder and serving to introduce the lower thread to be the supplied thread to move along an upper surface of the inner holder when the outer holder is reversely rotated by means of the outer holder reverse rotating mechanism; and a lower thread tension applying portion for setting the lower thread connected to the bobbin into the retreat position to be positioned below an upper surface of the outer peripheral surface of the outer holder and causing the thread catching hook to catch the lower thread connected to the bobbin, then reversely rotating the outer holder and operating the lower thread connected to the bobbin to enter the thread introducing port after the thread winding operation is completed.

4. The lower thread winding device according to claim 3, further comprising a cutting blade fixed to the outer peripheral surface of the outer holder to be opposed to the blade tip in an almost tangential direction; and an opening portion formed on the outer peripheral surface of the outer holder at this side in a direction of rotation to be adjacent to the cutting blade when the outer holder is reversely rotated.

5. The lower thread winding device according to claim 1, further comprising thread winding amount setting means for setting an amount of winding of the lower thread to be wound upon the bobbin;

thread winding diameter detecting means for detecting a maximum thread winding diameter of the lower thread to be wound upon the bobbin;

thread winding number measuring means for detecting a thread winding rotation number during the thread winding operation of the bobbin;

a critical thread winding number setting portion for setting a critical thread winding number of the lower thread to be wound upon the bobbin to be more than the thread winding rotation number of the bobbin up to the maximum thread winding diameter in a thick thread and to be less than the thread winding rotation number of the bobbin up to the maximum thread winding diameter in a thin thread; and a thread winding amount control portion for carrying out the thread winding operation until the thread winding diameter detecting means detects the maximum thread winding diameter or the thread winding number measuring means detects the critical thread winding number set by the critical thread winding rotation setting portion if the thread winding amount of the lower thread has a maximum set value by the thread winding amount setting means, and carrying out the thread winding operation until the thread winding rotation number of the bobbin is set depending on the thread winding amount set by the thread winding amount setting means and the thread winding number measuring means detects the thread winding rotation number of the bobbin which is set if the thread winding amount set by the thread winding amount setting means is less than the maximum set value.

6. The lower thread winding device according to claim 1, further comprising thread hold detecting means for detecting that the thread supplied during the thread winding operation is held in the thread holding member or the thread catching and holding member.

7. The lower thread winding device according to claim 1, further comprising a sewing data storage portion for storing a plurality of pattern sewing data;

pattern selecting means for selecting desirable pattern sewing data from the pattern sewing data; and an automatic setting portion for automatically setting selection of the lower thread to be supplied to the bobbin depending on the pattern sewing data selected by the pattern selecting means and/or a thread winding amount of the lower thread.

8. A lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread holding member including a thread engaging portion capable of holding a thread end of an upper thread supplied to a needle during the thread winding operation and a thread position regulating portion for positioning the upper thread on a supply side by the thread engaging portion during the thread winding operation to abut on the upper flange, the thread engaging portion being movable to a retreat position in the vicinity of an outer peripheral surface of the outer holder and an entry position in which the supplied thread is caused to enter an inner upper part of the inner holder to be positioned above the upper flange during the thread winding operation;

second moving means for moving the thread engaging portion of the thread holding member to the retreat position and the entry position;

an upper shaft clutch mechanism provided between a drive shaft to be driven by a sewing machine motor and a reciprocating member for reciprocating a needle bar and a thread talk-up in a vertical direction and capable of carrying out electrical switching into a connecting state in which the drive shaft is connected to the reciprocating member during the sewing operation and a holding state in which the connection is released and the thread take-up and the needle bar can be held in an upper position during a lower thread winding operation; and thread winding operation control means for bringing the upper shaft clutch mechanism into the connecting state to drive a sewing machine, thereby catching the upper thread connected to the needle by means of the blade tip of the outer holder and separately rotating the upper thread in upper and lower parts of the inner holder, then causing the thread engaging portion of the thread holding member to catch the upper thread passing over the inner holder, and thereafter operating the first moving means and the second moving means to cause the supplied thread connected between the thread engaging portion and the thread position regulating portion to enter the slit and bringing the upper shaft clutch mechanism into a release state so that the thread can be wound upon the bobbin without vertically moving the thread take-up and the needle bar during the thread winding operation.

9. The lower thread winding device according to claim 8, further comprising an upper thread reeling mechanism including thread loosening means for releasing the upper thread supplied as the lower thread at time of start of the thread winding operation; and an upper thread control portion for causing an amount of reeling of the upper thread reeled from the upper thread reeling mechanism to be a set amount at time of the start of the thread winding operation and for operating the thread loosening means to release the upper thread when the bobbin winds the upper thread to be the low thread.

10. The lower thread winding device according to claim 8, further comprising a thread catching hook formed on the outer peripheral surface of the outer holder;

an outer holder reverse rotating mechanism for reversely rotating the outer holder;

lower thread tension means including a thread introducing port fixed to the inner holder and serving to introduce the lower thread supplied from the upper thread to move along an upper surface of the inner holder when the outer holder is reversely rotated by means of the outer holder reverse rotating mechanism; and a lower thread tension applying portion for setting the lower thread connected to the bobbin and positioned in the vicinity of the outer holder into the retreat position to be positioned below an upper surface of the outer peripheral surface of the outer holder and causing the thread catching hook to catch the lower thread connected to the bobbin and positioned in the vicinity of the outer holder, then reversely rotating the outer holder and operating the lower thread connected to the bobbin and positioned in the vicinity of the outer holder to enter the thread introducing port after the thread winding operation is completed.

11. The lower thread winding device according to claim 8, further comprising a sewing data storage portion for storing a plurality of pattern sewing data;

pattern selecting means for selecting desirable pattern sewing data from the pattern sewing data; and an automatic setting portion for automatically setting selection of the lower thread to be supplied to the bobbin depending on the pattern sewing data selected by the pattern selecting means and/or a thread winding amount of the lower thread.

12. A lower thread winding device comprising:

a bobbin including upper and lower flanges provided on a central shaft upon which a lower thread is to be wound and both ends thereof, the upper flange having a slit opened to an outer peripheral edge;

a horizontal holder having an inner holder capable of accommodating the bobbin and an outer holder provided with a blade tip for catching a thread;

a bobbin driving member provided on an axial center of the outer holder and capable of being rotated integrally with the outer holder;

first moving means for moving the bobbin driving member to a connecting position in which the bobbin driving member and the bobbin are connected to cause the bobbin to be rotatable during an operation for winding the thread upon the bobbin and a separating position in which the bobbin driving member is disconnected from the bobbin during a sewing operation;

a thread catching and holding member including a thread holding portion provided in a tip portion and serving to hold a thread supplied during the thread winding operation and a thread engaging portion for engaging an upper thread, and a thread position regulating portion provided on a rear end side from the thread holding portion and the thread engaging portion and serving to position a supplied thread on a supply side by the thread holding portion and the thread engaging portion or the upper thread supplied as a lower thread during the thread winding operation to abut on the upper flange of the bobbin, in which a tip portion is always placed in a retreat position in the vicinity of an outer peripheral surface of the outer holder and is placed in an entry position in which the tip portion enters an inner upper part of the inner holder during the thread winding operation;

second moving means for moving the thread holding portion and the thread engaging portion in the thread catching and holding member to freely advance or retreat between two positions including the retreat position and the entry position;

an upper shaft clutch mechanism capable of carrying out electrical switching into a connecting state in which a drive shaft to be driven by a sewing machine motor is connected to a reciprocating member for reciprocating a needle bar and a thread take-up in a vertical direction during the sewing operation and a holding state in which the connection is released and the thread take-up and the needle bar can be held in an upper position during a lower thread winding operation;

a first thread winding operation control portion for operating the first moving means and the second moving means to cause the supplied thread connected between the thread holding portion and the thread position regulating portion to enter the slit and for bringing the upper shaft clutch mechanism into a release state so that the thread can be wound upon the bobbin without vertically moving the thread take-up and the needle bar during the thread winding operation; and a second thread winding operation control portion for bringing the upper shaft clutch mechanism into the connecting state to drive a sewing machine during the thread winding operation, thereby catching the upper thread connected to a needle by means of the blade tip of the outer holder and separately rotating the upper thread in upper and lower parts of the inner holder, then causing the thread engaging portion and the thread position regulating portion in the thread catching and holding member to catch the upper thread passing over the inner holder, and thereafter operating the first moving means and the second moving means to cause the supplied thread connected between the thread holding portion and the thread position regulating portion to enter the slit and bringing the upper shaft clutch mechanism into a release state so that the thread can be wound upon the bobbin without vertically moving the thread take-up and the needle bar during the thread winding operation.

13. The lower thread winding device according to claim 12, further comprising:

a thread separating portion protruded from the outer peripheral surface of the outer holder and capable of moving the supplied thread positioned in the vicinity of the outer peripheral surface of the outer holder in a separating direction from the outer holder when the outer holder is normally rotated; and a reholding operation control portion for setting the thread holding member or the thread catching and holding member into a thread catching position which is placed above the retreat position, and then rotating the outer holder to move the supplied thread positioned in the vicinity of the outer peripheral surface of the outer holder in the separating direction from the outer holder, thereby operating the thread holding member or the thread holding portion of the thread catching and holding member to hold the supplied thread after the thread winding operation is completed.

14. The lower thread winding device according to claim 12, further comprising an upper thread reeling mechanism including thread loosening means for releasing the upper thread supplied as the lower thread at time of start of the thread winding operation; and an upper thread control portion for causing an amount of reeling of the upper thread reeled from the upper thread reeling mechanism to be a set amount at time of the start of the thread winding operation and for operating the thread loosening means to release the upper thread when the bobbin winds the upper thread to be the low thread.

15. The lower thread winding device according to claim 12, further comprising thread hold detecting means for detecting that the thread supplied during the thread winding operation is held in the thread holding member or the thread catching and holding member.

16. The lower thread winding device according to claim 12, further comprising a sewing data storage portion for storing a plurality of pattern sewing data;

pattern selecting means for selecting desirable pattern sewing data from the pattern sewing data; and an automatic setting portion for automatically setting selection of the lower thread to be supplied to the bobbin depending on the pattern sewing data selected by the pattern selecting means and/or a thread winding amount of the lower thread.

* * * * *